US006380926B1

(12) United States Patent
Ho

(10) Patent No.: US 6,380,926 B1
(45) Date of Patent: Apr. 30, 2002

(54) COMPUTER MOUSE

(75) Inventor: Stanley Ho, Warren, NJ (US)

(73) Assignee: Allure Home Creation Co., Inc., Boonton, NJ (US)

( * ) Notice: Subject to any disclaimer, the term of this patent is extended or adjusted under 35 U.S.C. 154(b) by 0 days.

(21) Appl. No.: 09/685,918

(22) Filed: Oct. 10, 2000

Related U.S. Application Data

(63) Continuation-in-part of application No. 09/466,447, filed on Dec. 17, 1999, which is a continuation-in-part of application No. 09/165,064, filed on Oct. 2, 1998, now Pat. No. 6,155,411.

(60) Provisional application No. 60/089,873, filed on Jun. 19, 1998.

(51) Int. Cl.[7] ..... G09G 5/08

(52) U.S. Cl. ..... 345/163; 345/156; 345/157; D14/402; D14/403; 40/409; 40/410

(58) Field of Search ..... 345/156, 157, 345/163; D14/402, 403, 407, 408, 409, 410; 40/406, 407, 409, 410, 411, 412

(56) References Cited

U.S. PATENT DOCUMENTS

| | | | | | |
|---|---|---|---|---|---|
| 4,582,498 | A | * | 4/1986 | Tamada | 446/267 |
| 4,928,412 | A | * | 5/1990 | Nishiyama | 40/324 |
| 5,156,283 | A | * | 10/1992 | Sampson | 215/383 |
| 5,256,457 | A | * | 10/1993 | Pantaleo et al. | 428/13 |
| 5,269,717 | A | * | 12/1993 | Tardif | 446/71 |
| 5,553,735 | A | * | 9/1996 | Kimura | 362/101 |
| 5,570,112 | A | * | 10/1996 | Robinson | 345/163 |
| D381,015 | S | * | 7/1997 | Morrison et al. | D14/454 |
| 5,851,623 | A | * | 12/1998 | Tarulli et al. | 428/68 |
| 5,948,520 | A | * | 9/1999 | Hirsch | |
| 6,016,138 | A | * | 1/2000 | Harskamp et al. | 345/163 |
| D420,339 | S | * | 2/2000 | Burke | D14/114 |
| 6,040,539 | A | * | 3/2000 | Hiegel | 200/302.1 |
| 6,066,021 | A | * | 5/2000 | Lee | |
| 6,099,929 | A | * | 8/2000 | Chinen | 428/40.1 |
| 6,099,934 | A | * | 8/2000 | Held | 428/100 |
| 6,106,909 | A | * | 8/2000 | Hirsch | |
| 6,117,502 | A | * | 9/2000 | Liao | |
| 6,138,870 | A | * | 10/2000 | Lin | |
| 6,155,411 | A | * | 12/2000 | Ho | |
| 6,160,540 | A | * | 12/2000 | Fishkin et al. | |
| 6,195,085 | B1 | * | 2/2001 | Becker et al. | 345/163 |

FOREIGN PATENT DOCUMENTS

EP 0899650 A2 * 3/1999

* cited by examiner

*Primary Examiner*—Steven Saras
*Assistant Examiner*—William C. Spencer
(74) *Attorney, Agent, or Firm*—Frommer Lawrence & Haug LLP; Edgar H. Haug; Grace L. Pan

(57) ABSTRACT

Disclosed and claimed is a decorative computer pointer device for use in association with a computer. The computer pointer device includes a sealed decorative vessel containing a first liquid, a second liquid and at least one structure, wherein the structure is insoluble in both the first and the second liquids and floats on the first liquid. The first and the second liquids are advantageously immiscible. The first and the second liquids advantageously have densities such that the first liquid is beneath the second liquid, the first liquid, or the second liquid, or both of the first and the second liquids, are optionally colored or colorless. The structure suspended in the sealed vessel is advantageously weighted so it can maintain its upright configuration irrelevant to the position of the sealed vessel, and capable of remaining in suspension when the computer pointer device is in motion. The structure can also optionally be affixed in the decorative sealed vessel so as to remain substantially stationary.

10 Claims, 94 Drawing Sheets

COMPUTER MOUSE

RELATED APPLICATIONS

This application is a Continuation-in-Part application of U.S. Ser. No. 09/466,447, filed Dec. 17, 1999. Which is a continuation-in-part of application Ser. No. 09/165,064 filed Oct. 2, 1998, now U.S. Pat. No. 6,155,411, which claims priority to U.S. patent application Ser. No. 08/844,225, filed Apr. 18, 1997, now U.S. Pat. No. 6,065,640 which claims priority from Taiwanese Patent Application No. 86200066, filed Jan. 15, 1997 and Chinese Patent Application No. 97204313.7, 1997, filed Feb. 3, 1997 and U.S. Provisional Patent Application Ser. No. 60/089,873 filed Jun. 19, 1998, converted to conventional U.S. patent application Ser. No. 09/334,806 filed Jun. 17, 1999, now issued as U.S. Pat. No. 6,105,819 all of which are incorporated herein by reference.

FIELD OF THE INVENTION

The present invention relates to a decorative utilitarian object having a sealed decorative vessel connected, fused, annealed, or removably contained within a utilitarian object, for example, a computer pointer device.

The present invention also relates to a container for holding goods. The container can be for a liquid, such as a tumbler, a pitcher, a barware, a beer mug, a cocktail shaker, a jar with a lid, a lotion bottle, a canister and an ice bucket; for instance, a container for consumable liquids, or the like. The container can also be for a solid, or for solids with liquids optionally present, such as a soap dish (the soap can be solid, but when wet may have some liquid associated with it), a wastebasket (which can hold a solid waste item and/or a liquid waste, such as paper and/or plastic), a bowl (e.g. to hold food and/or drinks, or other items one would store in a bowl), or a toothbrush holder to hold toothbrushes, a vase to hold flowers, a salt shaker to hold and/or dispense salt, a pepper shaker to hold and/or dispense pepper, a tooth brush holder to receive tooth brushes, or the like.

The present invention also provides a utilitarian object having at least one sealed decorative vessel connected to a useful object, wherein the decorative vessel can be connected to or fused or annealed to or removably contained or is an integral part of the useful object. Examples of such utilitarian objects include but not limited to a tissue box cover, a nail brush, a squeegee, a toilet brush and holder, a plunger and stand, a back scrubber, a kitchen brush, a hair brush, a tooth brush, a napkin ring, a telephone, a telephone receiver, a computer pointing device, for example, a computer mouse, a yo-yo, a napkin holder, a mirror, a towel stand, a wine stopper, a coaster, a Christmas ornament and a picture frame.

The container can be sized as desired; for instance to suit the purpose of the container. For example, the container may be sized so it is suitable for display on a shelf or a sink (e.g., a bathroom sink when it is a toothbrush holder or soap dish), or for use in the home to entertain guests (e.g., when it is a tumbler or bowl), or sized to be in a corner in a home or office (e.g., when it is a wastebasket). For instance, it can have a diameter of about four inches and a height of about seven inches when used as a tumbler.

The container includes a first vessel and a second vessel. The first vessel can be open or sealed and is capable of receiving either liquids and/or solids or has means for receiving solids. The second vessel can be hollowed and can be positioned below, or above the first vessel, or in surrounding relationship with the first vessel, thus, an exterior wall of the first vessel can be in contact with an interior wall of the second vessel and vice versa. The first vessel can be refillable. The second vessel can contain at least one three-dimensional insoluble decorative structure or sculpture and/or at least one fluid, preferable two immiscible fluids each having a different density. When present, the three-dimensional insoluble structure is capable of being suspended and floats on top of one of the two immiscible liquids. The Three-dimensional insoluble structure can resemble animals, e.g., birds, mammals, insects and/or plants.

Thus the invention can relate to a container comprising either a first open or a first sealed vessel and a sealed second vessel. The sealed second vessel contains at least one liquid, but preferable two, the two liquids can be different, can be miscible or immiscible. The liquids can have same or different densities, and if different densities, one liquid will be positioned atop the other. The liquid can be a fluid such as air, or that which is normally liquid including, but not limited to water, oil or any type, that could be clear or viscous etc. The second vessel can be a top or a closure or a portion for the first vessel, the second vessel can also be placed adjacent to or in surrounding relationship to the first vessel or vice versa either removable therefrom or affixed thereto; or, the second vessel can be a base attached to the first vessel or serve as a base support. The second vessel can contain at least one decorative particle that can be three-dimensional, such as a sculpture, or a two-dimensional object such as a picture or a drawing or any words or any design or any color of desire. The decorative particle is preferably insoluble in the liquids, preferably somewhat weighted, so it floats on one liquid and is immersed in the other liquid within the second vessel so it can move freely within the sealed second vessel and can remain in suspension. Either one or both of the liquids can be colored, or either one or both can be clear and the sculpture can be decorative that resembles any living thing or any object found on earth or imaginary.

Documents cited in the following text are incorporated herein by reference.

BACKGROUND OF THE INVENTION

In the era of computer data processing and the popularity of the word processing program Microsoft Word® and the information super highway, a pointer device for running and operating the program is inevitable. The basic features of a mouse are a flat-bottomed casing designed to be gripped by one hand; one or more buttons on the top; a multidirectional direction device (usually a ball) on the bottom; and a cable connecting the mouse to the computer. By moving the mouse on a surface (such as a desktop), the user typically controls an onscreen cursor. A mouse is a relative pointing device because there are no defined limits to the mouse's movement and because its placement on a surface does not map directly to a specific screen location. To select an item or choose commands on the screen, the user presses one of the mouse's buttons, producing a "mouse click". However, with all of the computer pointer devices, for example, a computer mouse commercially available, none of them ever have a decorative sealed vessel having liquids contained within to be connected to, fused, annealed, permanently connected, or removably attached, or removably contained within the functional portion of a computer mouse, such as the left, right, or middle buttons or any portion of the housing of the computer. In fact, one will not be motivated to make a liquid containing embodiment as a part of an electronic device, such as a computer pointer device, or a computer mouse for fear that if the liquid containing embodiment leaks, the liquid could short circuit and destroy the entire computer system. Thus, there is neither teaching nor motivation in the art to do so.

Containers for liquids and/or solids are varied. A consumable liquid such as soup, soft drinks, water, coffee, tea or the like may be contained in an open-mouthed container such as a cup. But, open-mouth containers are not aesthetically pleasing, and normally do not provide the stability desired.

A sealed container containing two immiscible liquids, one or both of which is optionally colored is known; for instance, a "wave" device which pivots back and forth generates the appearance of a wave. In addition, it is also known in the art to suspend and/or dispose a three-dimensional sculpture atop one of the two immiscible fluids. Such container is commonly shaped as a paperweight. However, it is believed that heretofore a tumbler and/or a container has not been combined with such sealed container.

Presently available containers for either liquid and/or solids are predominantly an open-mouth container which do not provide features that stabilizes the basis of the containers in order to prevent the container from tipping over. In addition, the available containers do not also it provide an aesthetically pleasing base or top which creates an aquatic motif.

Reference is made to Taiwanese laid-open publication No. 340349 laid open on Sep. 11, 1998, which is believed not to disclose or claim the present invention.

OBJECTS AND SUMMARY OF THE INVENTION

An object of the present invention is for a novel, useful utilitarian device having a sealed decorative vessel connected to or attached to or fused to or removably contained within or is an integral part of a utilitarian device. The utilitarian object can be, but not limited to, a computer pointer device such as a computer mouse. The sealed decorative vessel can be placed at the right button, left button, middle button, the housing base member surrounding the ball, or the ball can be the decorative sealed vessel or a portion of the sealed vessel or any portion of the computer pointer device.

Another object of the invention may include providing a novel container; providing a container which in certain embodiments may be refillable, providing a container which permits a wide range of design possibilities not dictated by the function of the container; providing a container which is suitable for holding any consumable hot and/or cold and/or lukewarm liquids, such as milk, water, soft drinks, coffee, tea, soup or the like, or for holding any solids such as a toothbrush, soap, paper, plastic, solid food or the like; providing a container which is aesthetically pleasing and thus encourages the user to refill and reuse it and thereby provide an environmental benefit; and, providing a container having a hollow decorative vessel capable of containing a three dimensional ornamental sculpture disposed in two immiscible liquids which, for example, can resemble an aquatic motif.

The present invention provides a computer pointer device such as a computer mouse comprising a sealed vessel containing at least one fluid, at least one structure that can be two-dimensional or three-dimensional, wherein the structure is insoluble in the fluid disposed within the sealed vessel, and floats on the fluid and the sculpture is capable of being temporarily in suspension when the sealed vessel is in motion. If the sealed vessel is to have more than one fluid, the fluids are immiscible; the first and second liquids have different densities such that the first liquid is beneath the second liquid and vice versa; and the volume of the second liquid may be the same, smaller or greater than the volume of the first liquid and vice versa.

The invention also provides a computer mouse wherein the sealed vessel is positioned posterior to a main housing of the control or removably placed at the left button, right button or middle or any portion of the computer pointer device of choice.

The sealed vessel can be permanently attached to or affixed to the computer mouse so as to be integral with, as in a non-removable from, or it can be removably attached like a module or a Lego® set that can be snapped-in or removed from the computer mouse. The process of permanently attaching the sealed vessel may include fusing, gluing, molding, welding, melting, annealing or any other method that would render the sealed vessel permanently attached The sealed vessel contains at least one liquid and at least one particle. The particle can be three-dimensional or two-dimensional, and if three-dimensional can optionally be a sculpture. The particle is insoluble in the liquids disposed in the vessel. The three-dimensional or two-dimensional particle is preferably weighted, so it floats on one liquid and is immersed in the other liquid within the sealed vessel. Either one or both of the liquids can be colored or colorless or clear, or they can have contrasting or complimentary colors and the sculpture can be, for example, decorative, scenic, informative, advertising, political, comical, entertaining or any combination thereof that pleases a user and designs to a user's liking to reflect a user's individualism.

The insoluble, three-dimensional sculpture could resemble animals, i.e., birds, mammals, insects and/or plants, and could take the shape of a fish, frog, boat, duck, turtle, swan, dolphin, penguin and the like. The sculpture could also convey company information or take the form of a company logo or represent a favorite sports team, a movie star, a motion picture, a favorite character either cartoon, imaginary or real. The insoluble particle can also be two-dimensional which can serve to provide a background to advertise, to preach, to campaign for political leaders, it can also be inspirational or philosophical statements, or comical characters, or cartoon characters in either two or three dimensions. The decorative particle can also be contemplated to be affixed inside the sealed vessel so as to remain essentially stationary during agitation of the liquids and/or the environment it is disposed in.

The sealed vessel can have discrete portions which prohibit viewing of the entire or a portion of the contents of the vessel. Thus, the sealed vessel can be selectively clear, transparent, translucent, colored, frosted or any combinations thereof. Further, the walls of the sealed vessel can be made of materials such as glass, plastic, polymer, resin of varying thickness, thereby producing a magnifying effect when the objects within the vessel are viewed.

The invention can still yet provide a container comprising a first vessel and a second vessel. The first vessel is hollow and open and the second vessel is hollow and sealed. The second vessel contains two immiscible liquids; the liquids have densities such that one liquid sits atop the other and vice versa.

The second vessel can be a top or closure for the first vessel, either removable therefrom or affixed thereto; or, the second vessel can be a base or a base support attached to the first vessel. The second vessel can contain at least one sculpture, insoluble in the liquids, preferably somewhat weighted, so it floats on one liquid and is immersed in the other liquid within the second vessel. Either or both of the liquids can be colored, and the sculpture can be decorative. If a removable top, the second vessel can snap on or screw into the first vessel.

Thus, the invention can provide a decorative utilitarian object comprising a first vessel and a second vessel, wherein the first and second vessels are connected, so the first vessel and the second vessel can be positioned to be on top of each other or below the other, can be adjacent or in a surrounding relationship with each other, the first vessel can contain the second vessel or vice versa, the first vessel can be open or sealed and comprises means for containing desired goods in its interior, and the second vessel comprises a hollow decorative vessel comprising means for permitting a user to view a sculpture within its interior.

The first vessel can comprise an open mouth, may or may not have a removable cover or can be sealed. The contents contained in the first vessel can be dispensed from by way of pouring. The removable cover can be a snap-on type cover (with a receiving portion for the cover on the open mouth bottle), or a threaded cap (with mating threads on the open mouth bottle). Thus, as can be understood from this description, the vessels can be any desired shape.

The second vessel can contain at least two different immiscible liquids. The liquid can be a fluid such as air. The liquids have densities such that one sits atop the other. The second vessel can optionally contain particles capable of being temporarily in suspension when the liquids in the second vessel is shaken or agitated.

The second vessel preferably contains at least one sculpture, insoluble in the liquids, and somewhat weighted so it floats on the lower liquid and is within the upper liquid. Either or both the liquids can be colored. The liquids preferably fill the second vessel.

The container can comprise means for receiving that which is to be contained, e.g., a solid or liquid, or both, i.e., the container has a means defining an opening in an interior open space in the first vessel for receiving and holding that which is to be contained.

The container can be constructed such that the first vessel is positioned below the second vessel, and optionally serves to display the aesthetic sculpture suspended in the second vessel; e.g., the second vessel can be a lid or top or closure for the first vessel; the second vessel can also be positioned above the first vessel; or the first vessel can be in surrounding relationship with the second vessel such as that an exterior wall of the first vessel is in contact with an interior wall of the second vessel and vice versa; or that the first vessel and the second vessel can share one common surface.

The first vessel can be any desired color including clear, as can the second vessel; e.g., the second vessel or the first can be translucent or frosted.

The container can also be constructed such that there are means for permitting a user to view a sculpture within the second vessel by viewing discrete portions of the interior of the second vessel, i.e., the second vessel can have discrete portions which prohibit viewing the contents of the second vessel. In other words, the second vessel can be selectively clear or transparent or translucent or selectively colored or frosted.

The first vessel can be refillable or replaceable.

The insoluble three-dimensional sculpture suspended within the decorative vessel could resemble animals, i.e., birds, mammals, insects and/or plants, and could take the shape of a fish, a frog, a boat, a duck, a turtle, a swan, a dolphin, a penguin and the like. There is preferably at least one insoluble three-dimensional sculpture and each is preferably weighted at the bottom as to provide, ensure and maintain an upright position irrelevant to the position of the decorative vessel.

When the second vessel is positioned below the first vessel, the second vessel can be a base support for the first vessel. The second vessel can be partially or completely below the first vessel.

The invention also provides a container comprising a hollow decorative vessel capable of containing at least one liquid, preferable two immiscible liquids having the insoluble three-dimensional sculpture suspended and afloat above one of the liquids and within the other. The vessel has an upper end and a lower end.

The present invention can function as identify the source or origin of the product, to distinguish the product from those of others, and, to convey an image.

The present invention provides a novel container having a second vessel containing a decorative device for displaying an ornamental object and a first vessel for containing any goods which may be either solid and/or liquid.

The invention comprehends methods of making and using the container, e.g., a method for storing a desired item by placing or pouring it into an inventive container.

The present invention also provides a useful object, wherein the decorative vessel is connected to or is part of the useful object. Thus, for example, a wine stopper having as a decorative vessel, the top, e.g., bulbous portion of a wine stopper (See FIG. 13).

In this disclosure, "comprising", "comprises" and the like can have the meaning ascribed to them in U.S. Patent Law and can mean "includes", "including", and the like.

These and other objects and embodiments of the invention are provided in, or are obvious from, the following detailed description. These drawings are by way of example are by no means limiting to the invention.

BRIEF DESCRIPTION OF THE DRAWINGS

In the following detailed description, reference will be made to the accompanying drawings, wherein.

DETAILED DESCRIPTION

Figure 1:
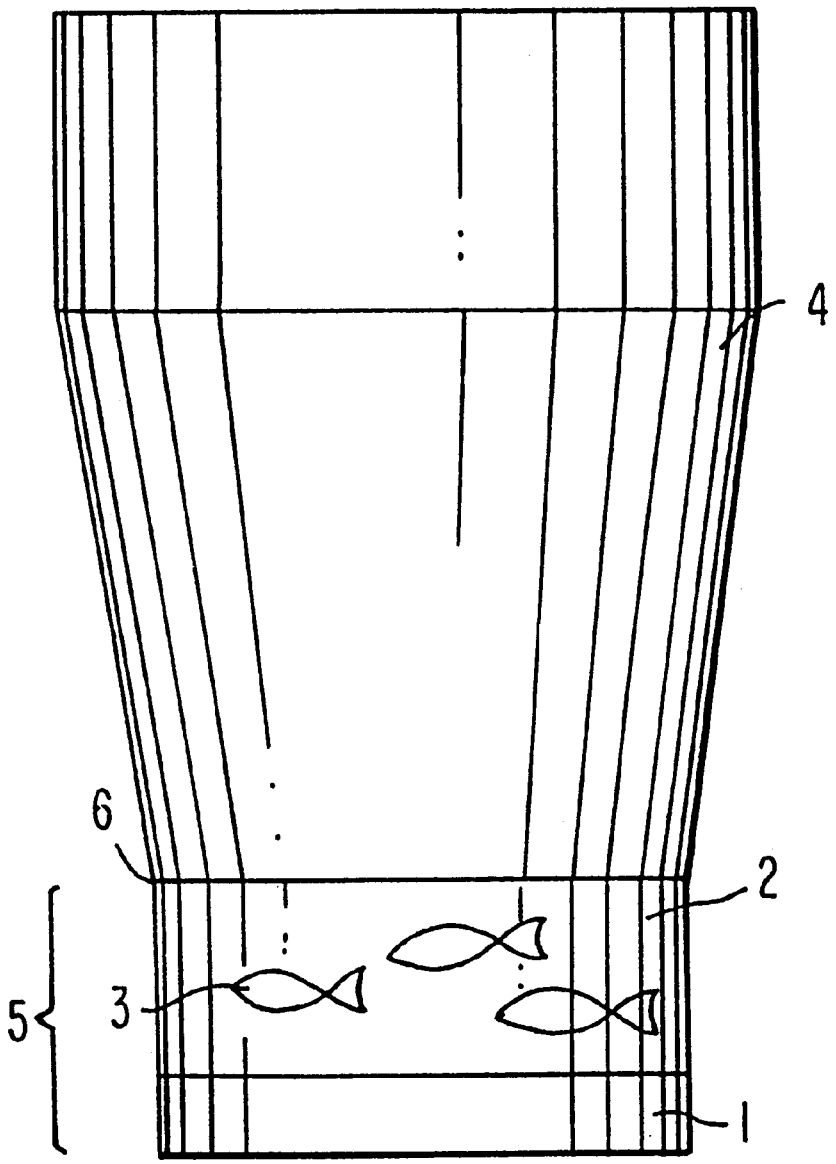
FIG. 1 shows a side view embodiment of a tumbler in accordance of the invention.
Figure 4:
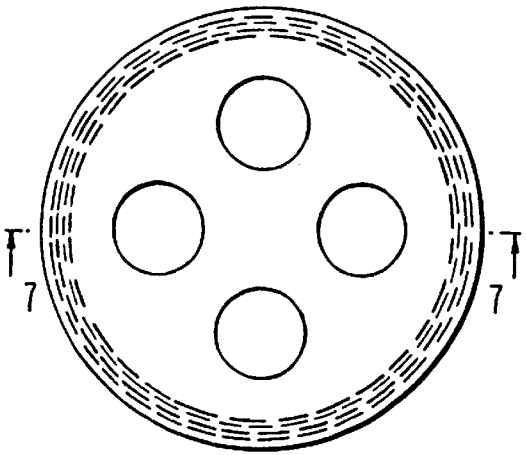
FIG. 4 shows a top view of the tumbler with decorative sculptures in liquids of the second vessel.
Figure 7:
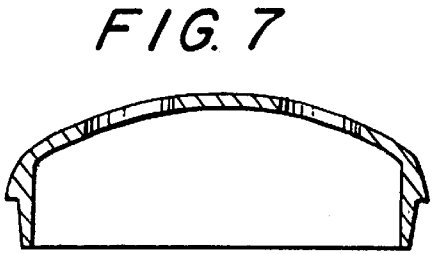
FIG. 7 shows an cross-section view along lines C–C4 of FIG. 4.
Figure 3:
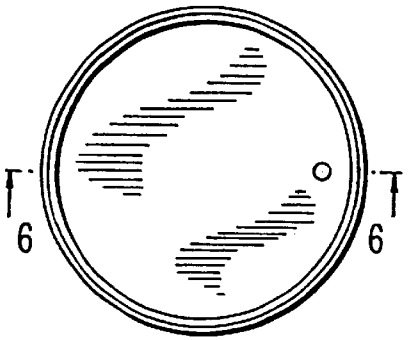
FIG. 3 shows a top view of the tumbler of the invention.
Figure 6:
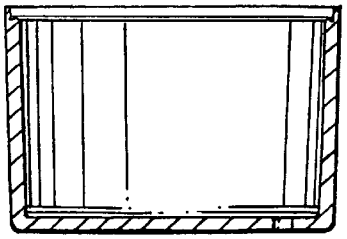
FIG. 6 shows a cross-section view of the sealed second vessel of the tumbler (which can contain the liquids) of the invention (along lines B–B4 FIG. 3)
Figure 2:
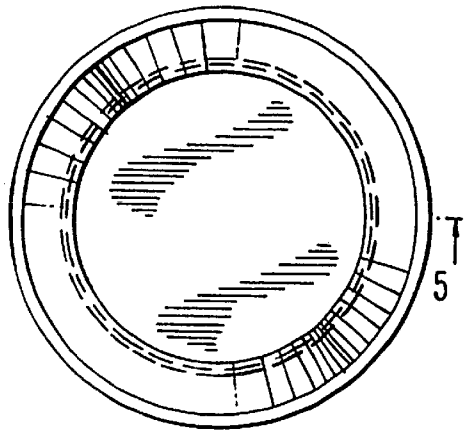
FIG. 2 shows a bottom view of a tumbler of the invention.
Figure 5:
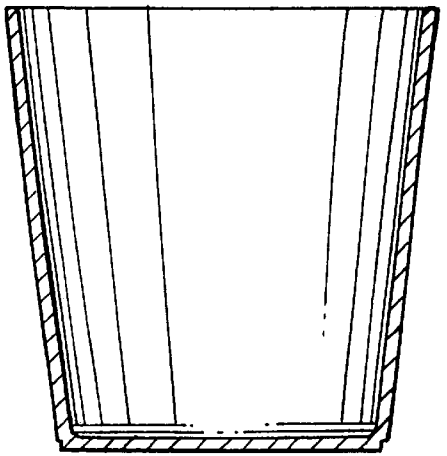
FIG. 5 shows a cross-section view of the first vessel of the tumbler of the invention (along lines A—A of FIG. 2.
Figure 8:
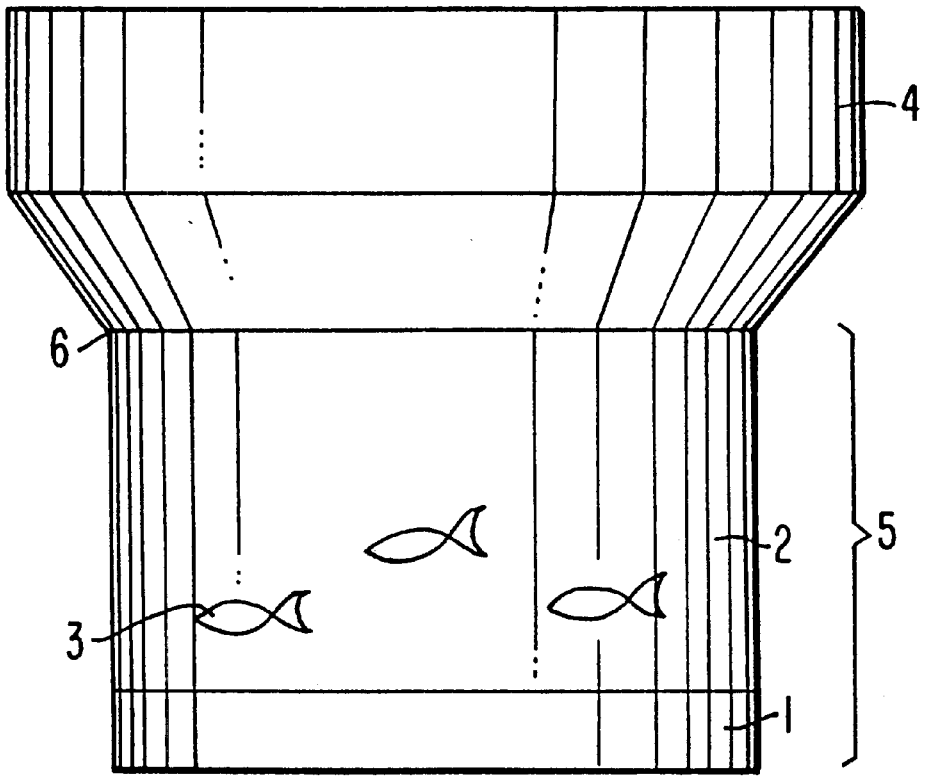
FIG. 8 shows a side view of a soap dish in accordance of the invention.
Figure 11:
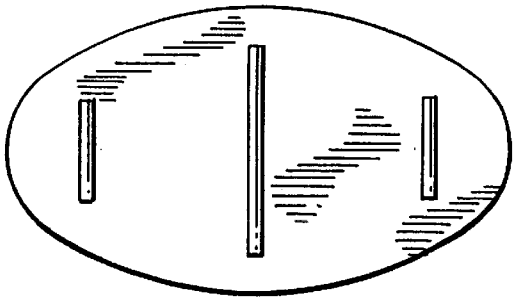
FIG. 11 shows a the top view of the soap dish of the invention.
Figure 12:
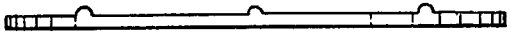
FIG. 12 shows a view of the top of the soap dish of the invention showing ridges for holding soap.
Figure 9:
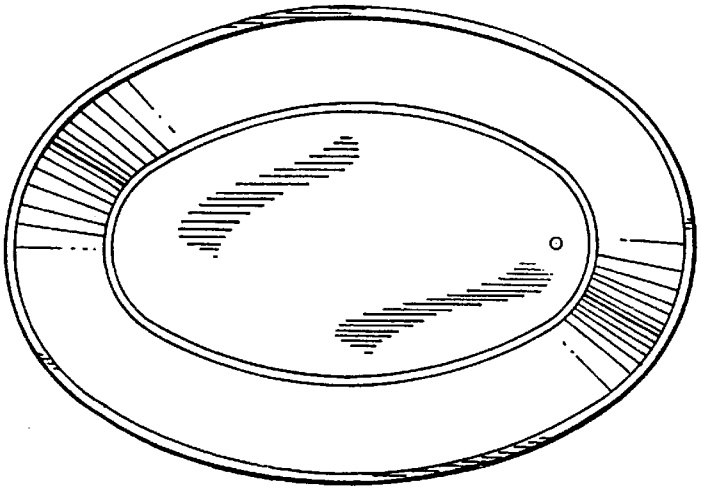
FIG. 9 shows a bottom of the soap dish of the invention.
Figure 10:
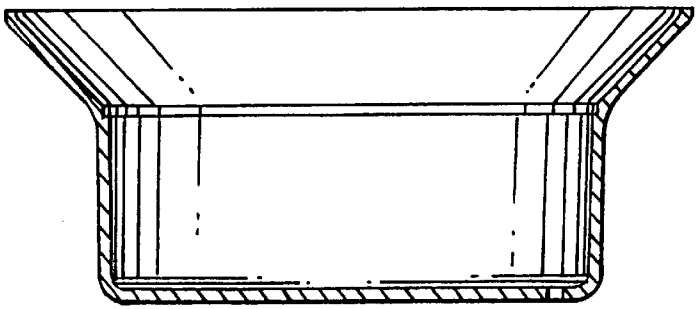
FIG. 10 shows a cross-sectional view of the soap dish of the invention.
Figure 13:
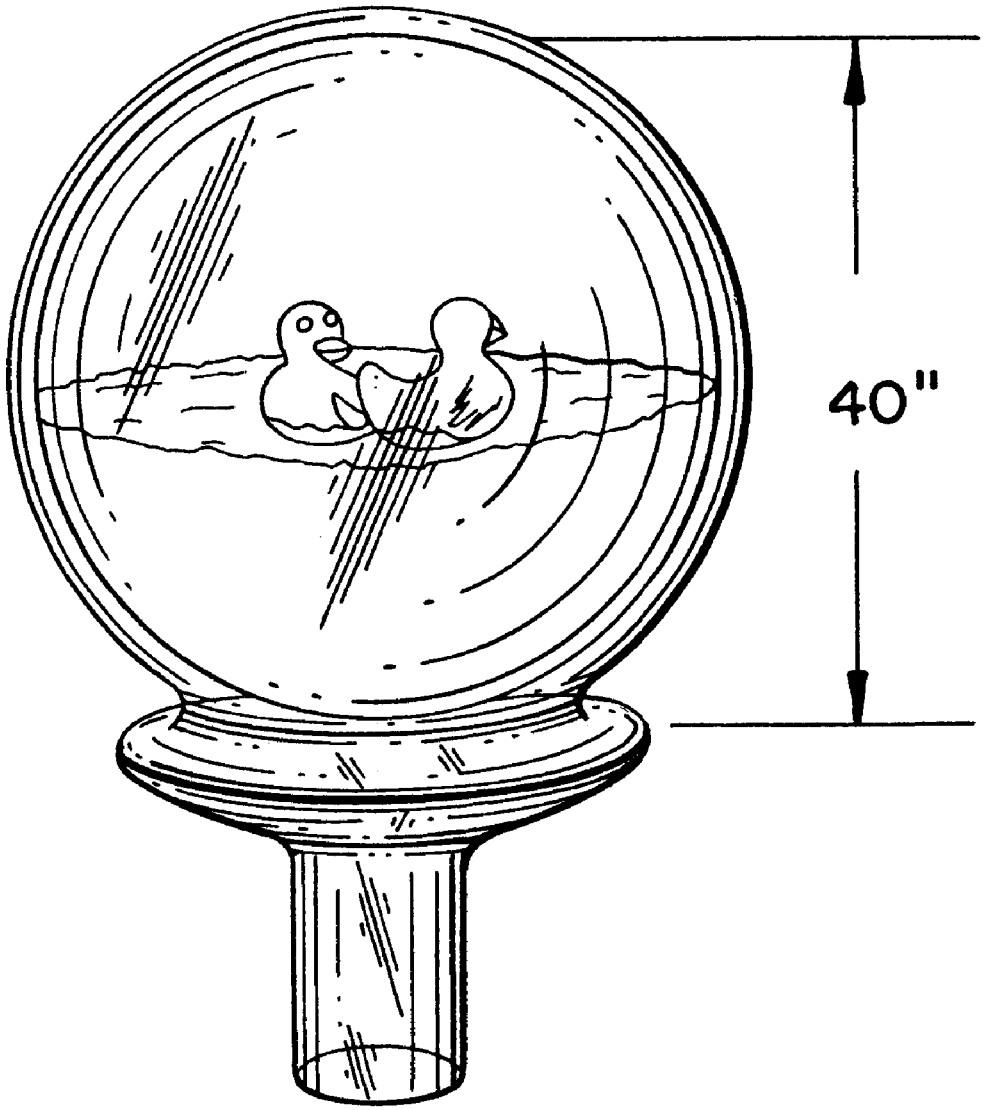
FIG. 13 shows a top and side view of a wine stopper in accordance with the present invention.
Figure 14:
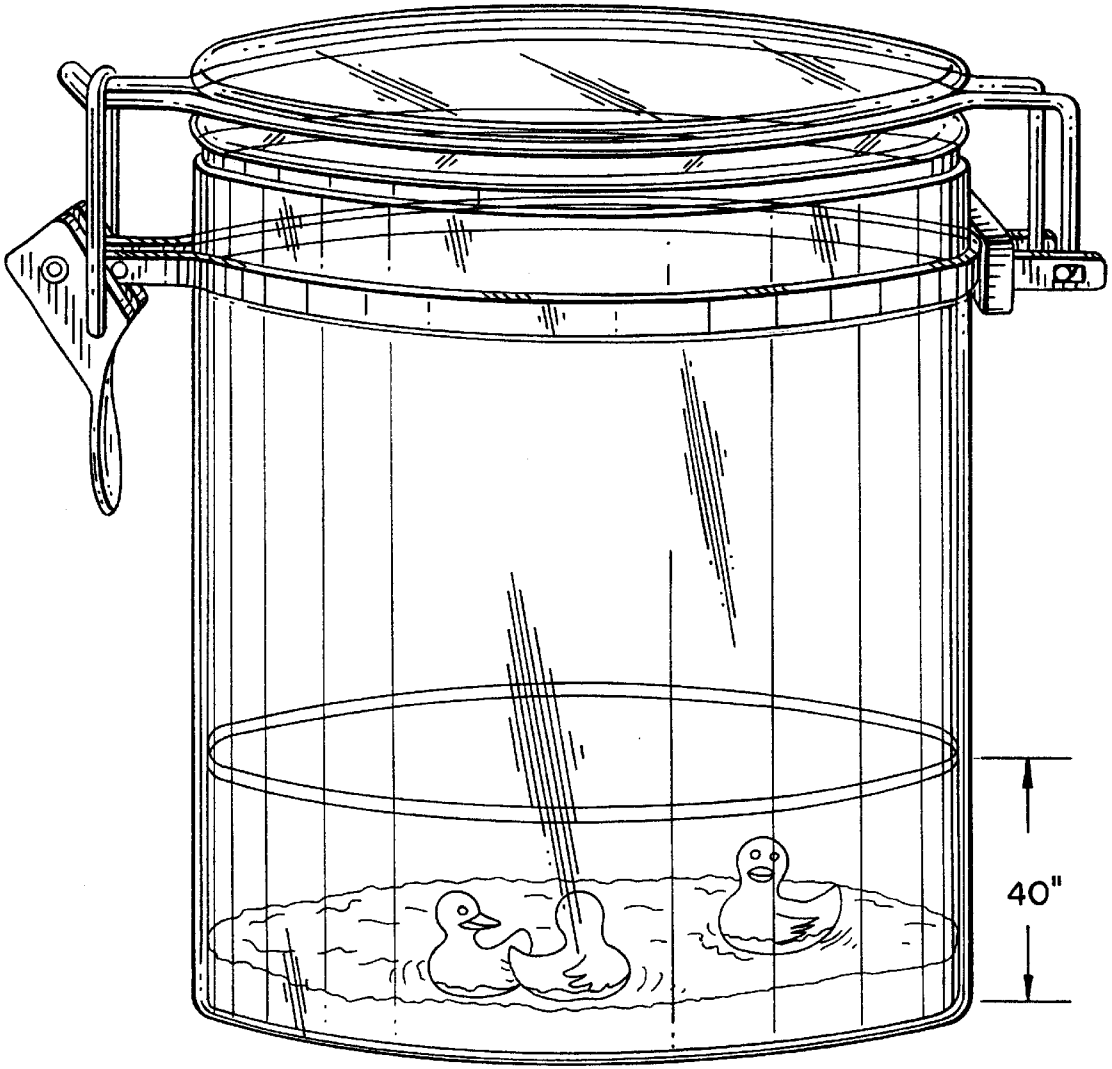
FIG. 14 shows a canister in accordance with the present invention.
Figure 15:
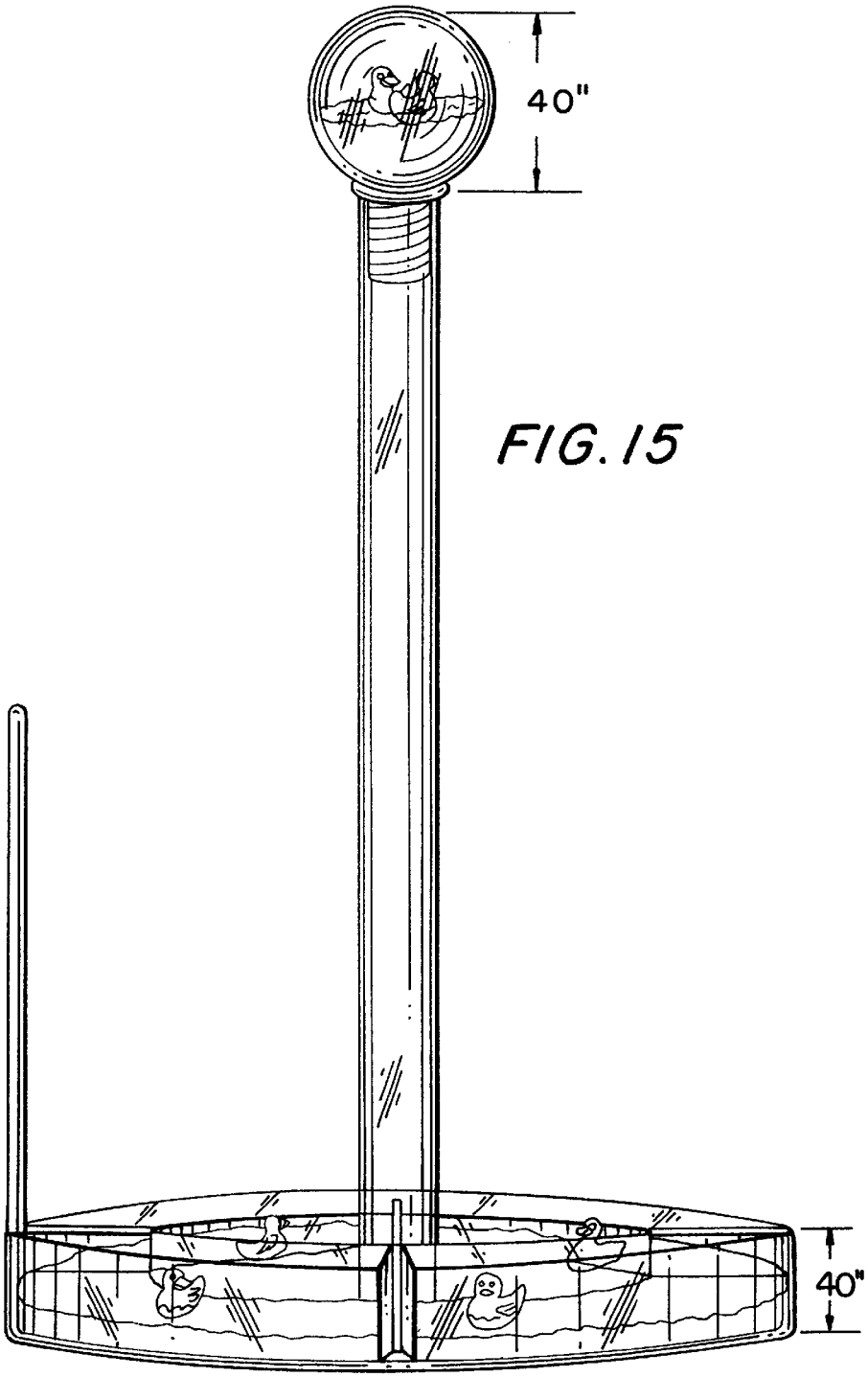
FIG. 15 shows a paper tower stand in accordance with the present invention.
Figure 16:
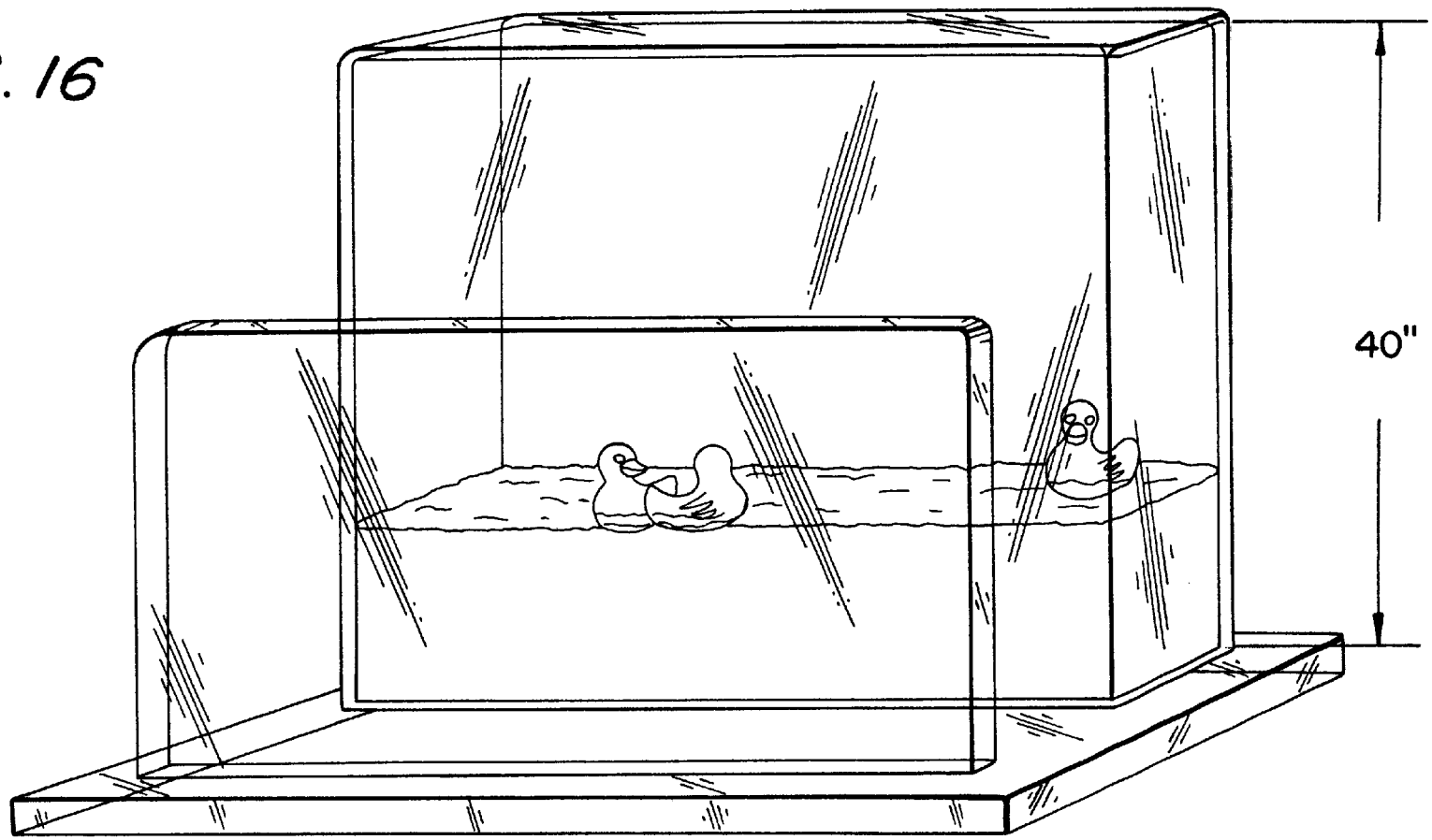
FIG. 16 shows a tissue paper holder in accordance with the present invention.
Figure 17:
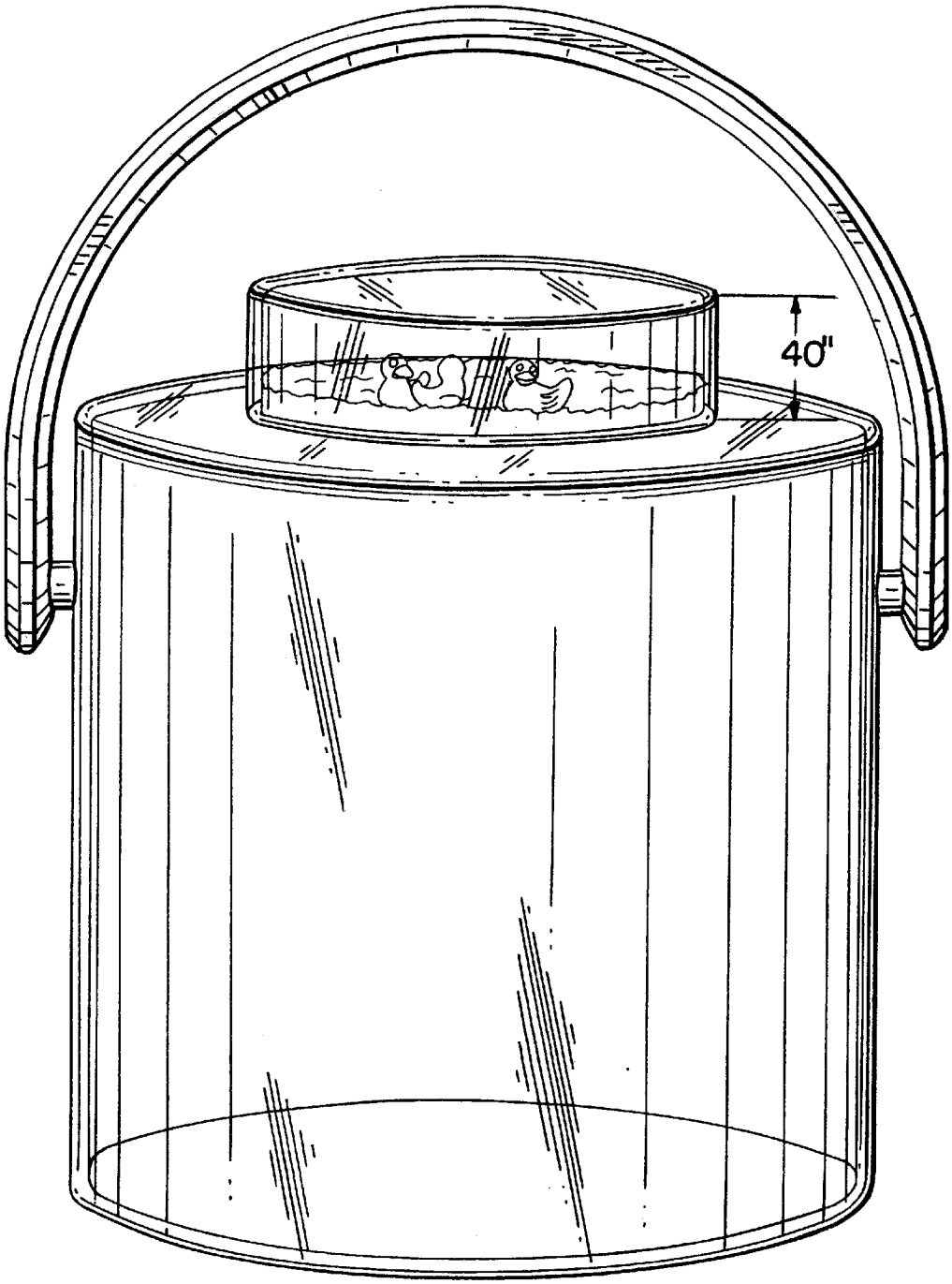
FIG. 17 shows an ice bucket in accordance with the present invention.
Figure 18:
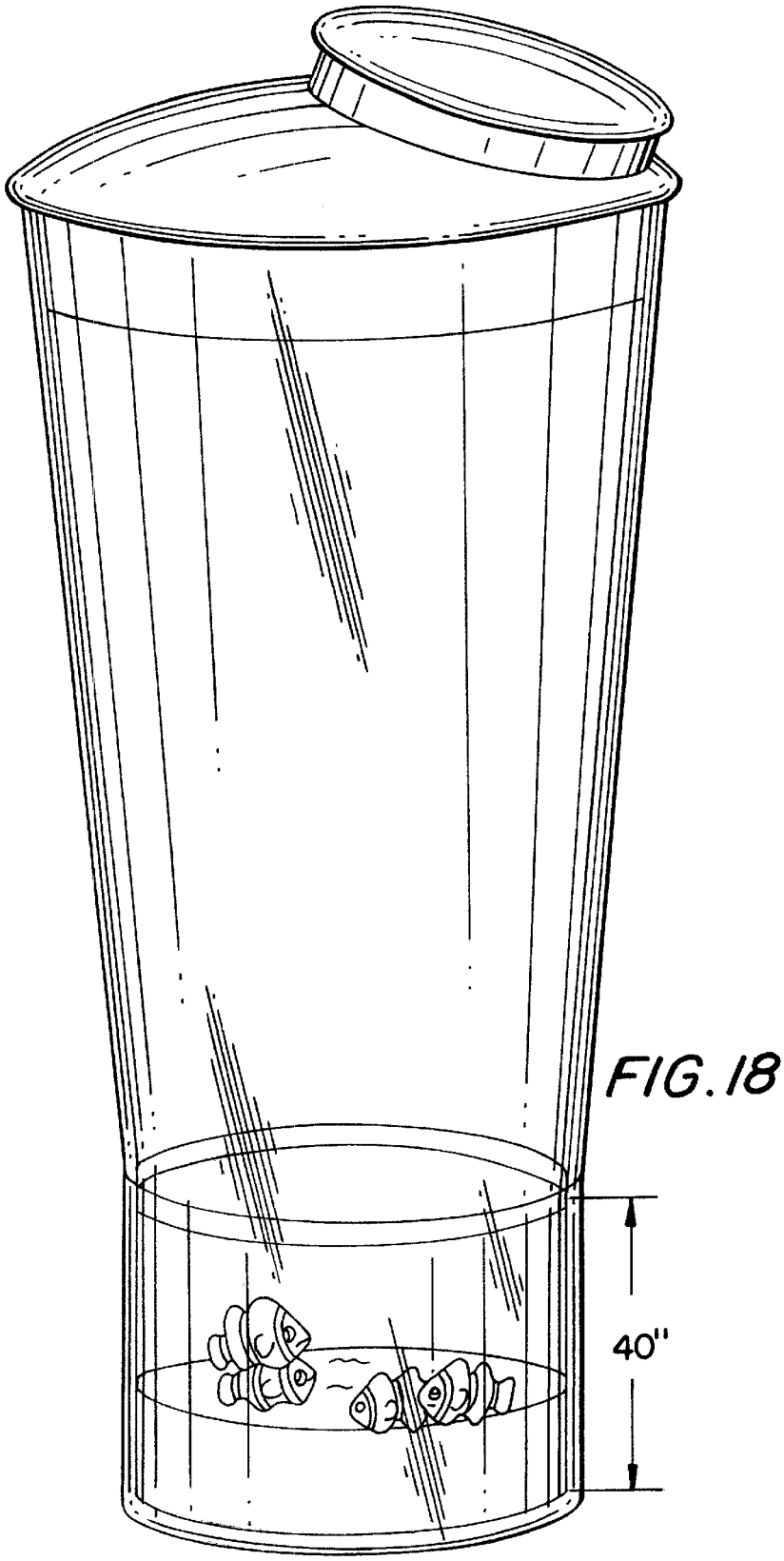
FIG. 18 shows a cocktail shaker in accordance with the present invention.
Figure 19:
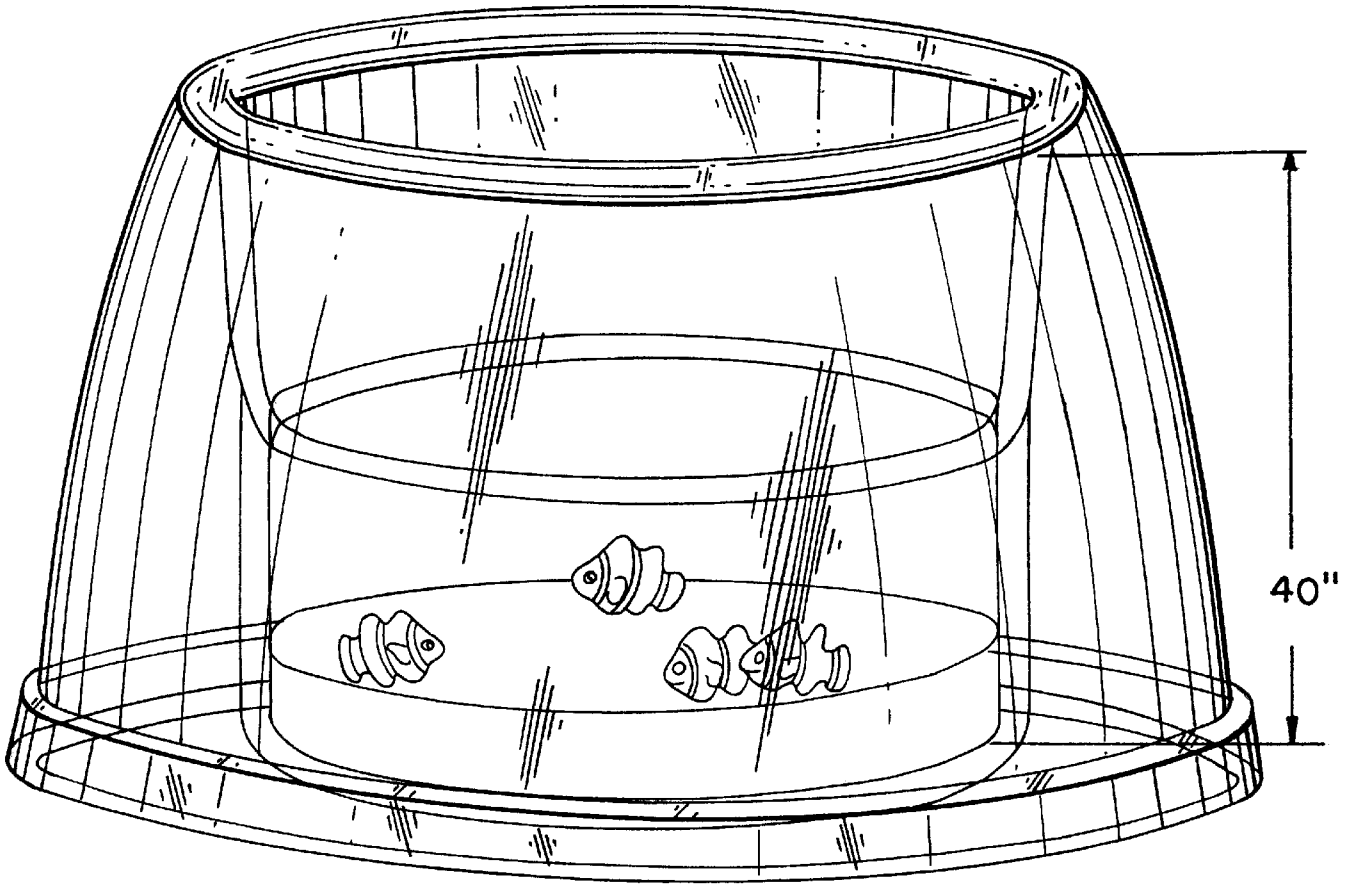
FIG. 19 shows a pet bowl in accordance with the present invention.
Figure 20:
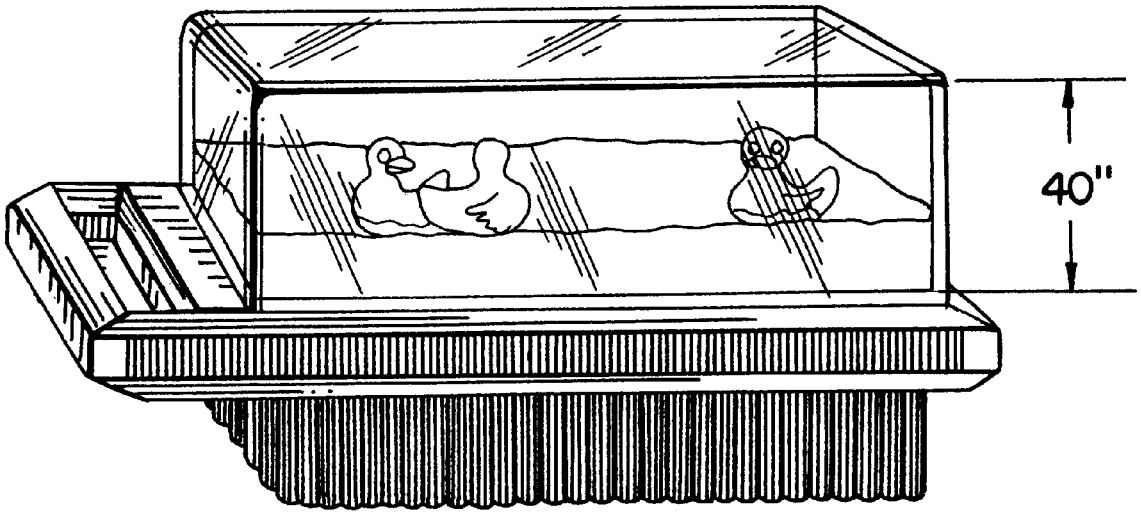
FIG. 20 shows a nailbrush in accordance with the present invention.
Figure 21A:
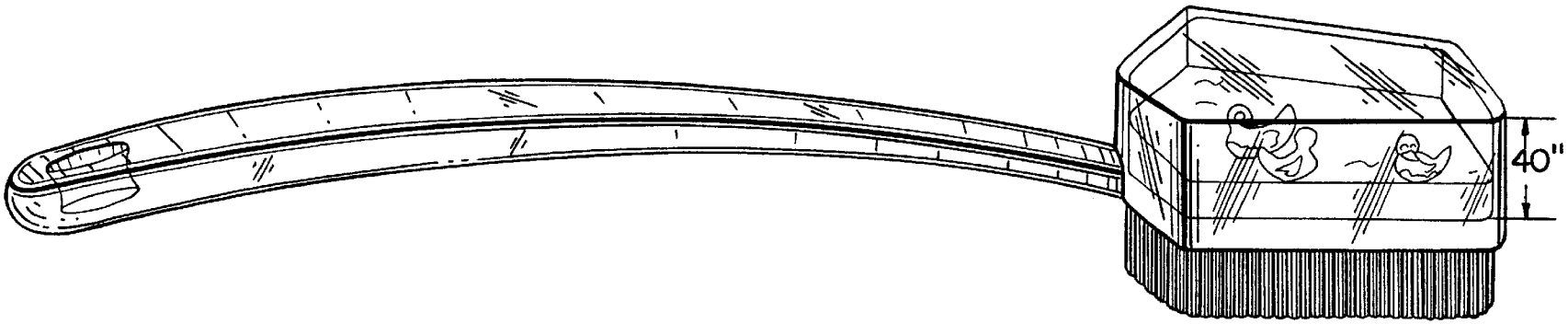
FIGS. 21A and 21B show a series of variations of back scrubbers in accordance with the present invention.
Figure 21B:
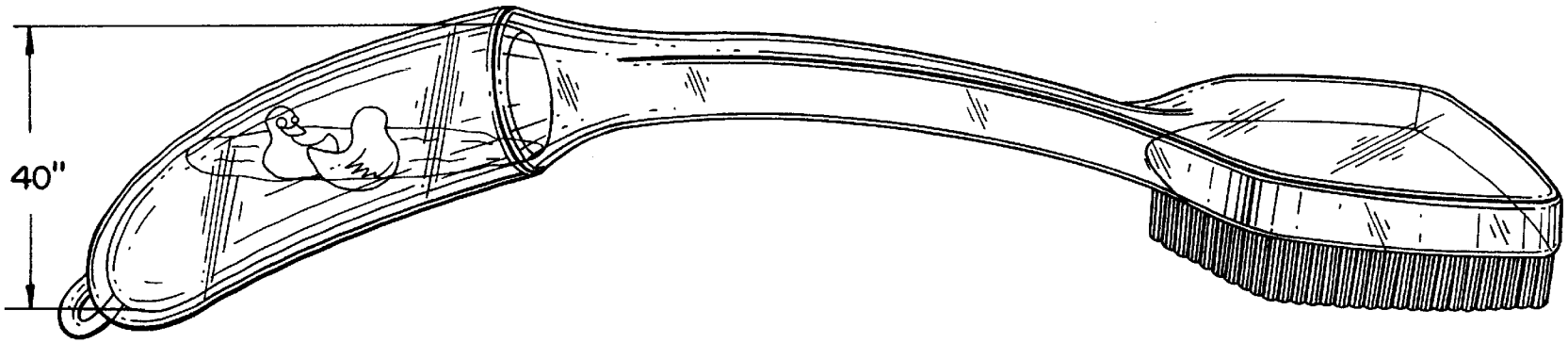
Figure 22A:
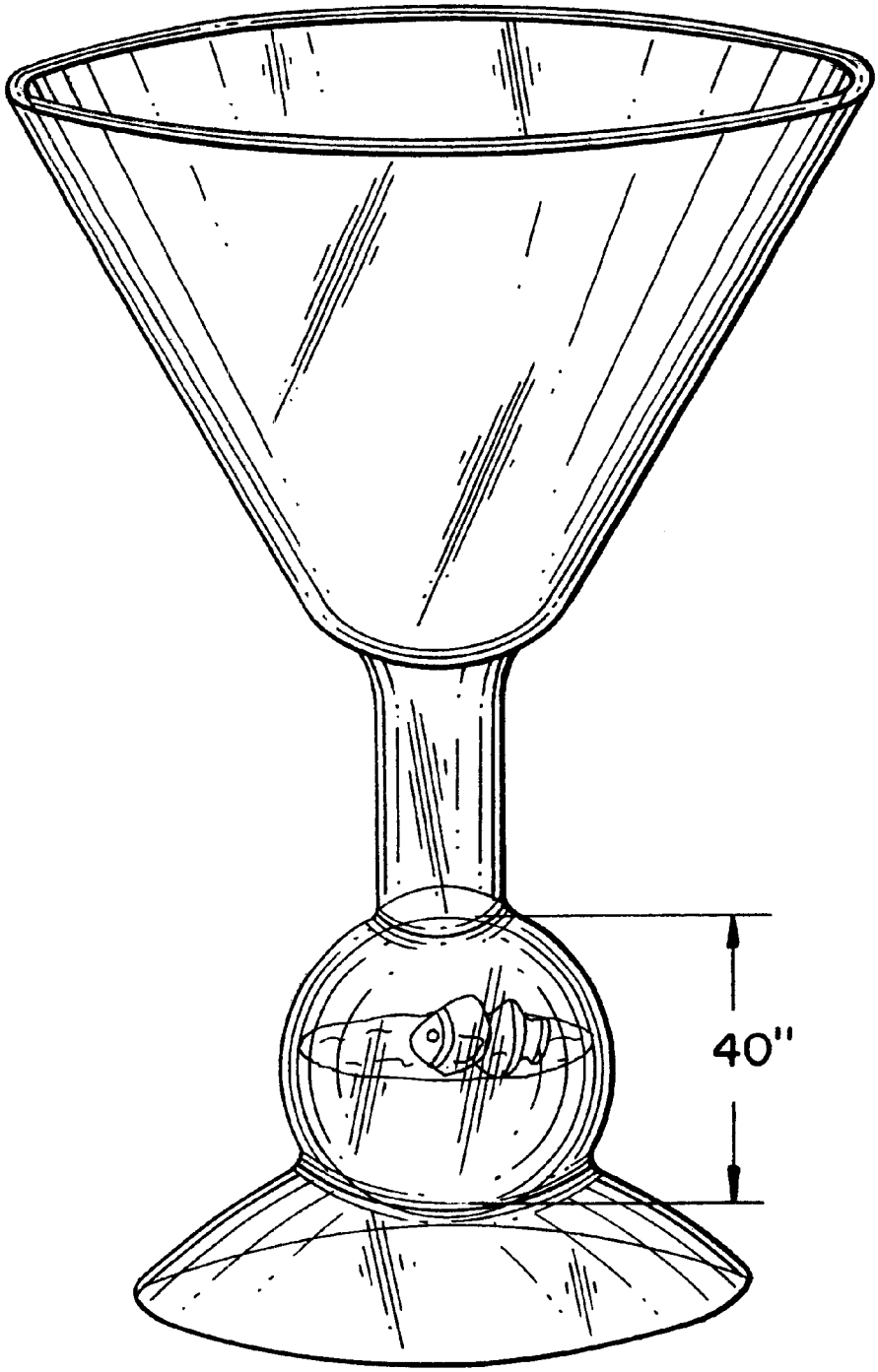
FIGS. 22A and 22B shows cocktail barware in accordance with the present invention.
Figure 22B:
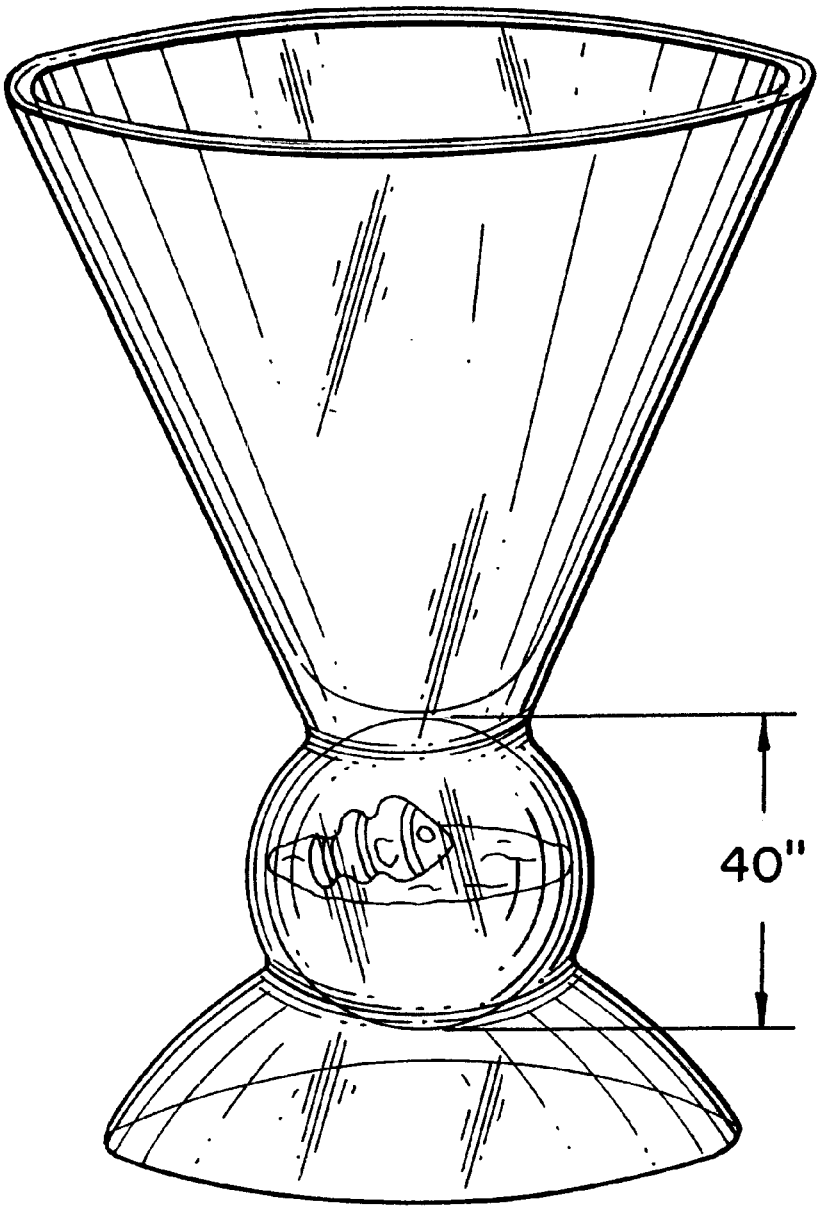
Figure 23:
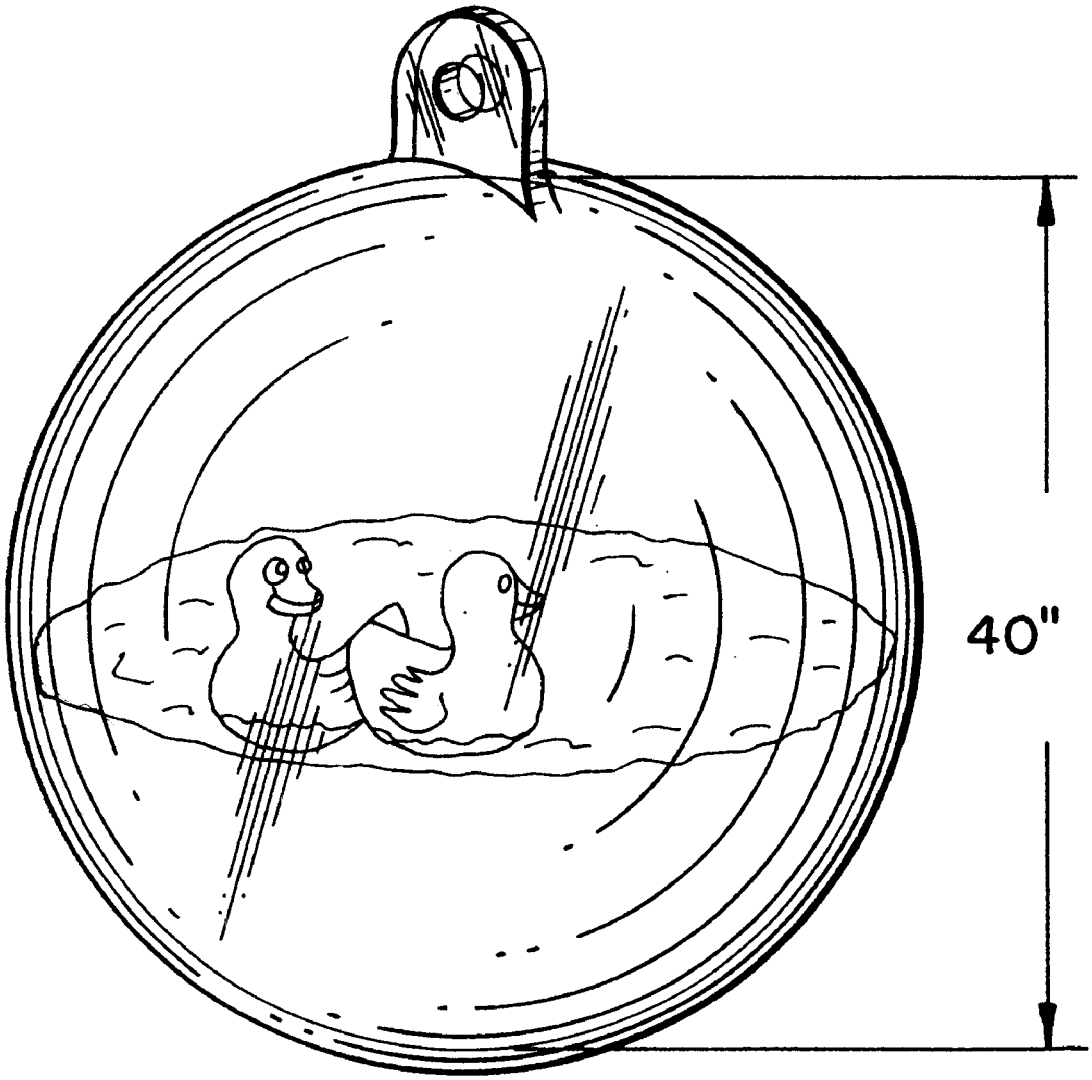
FIG. 23 shows a Christmas ornament in accordance with the present invention.
Figure 24A:
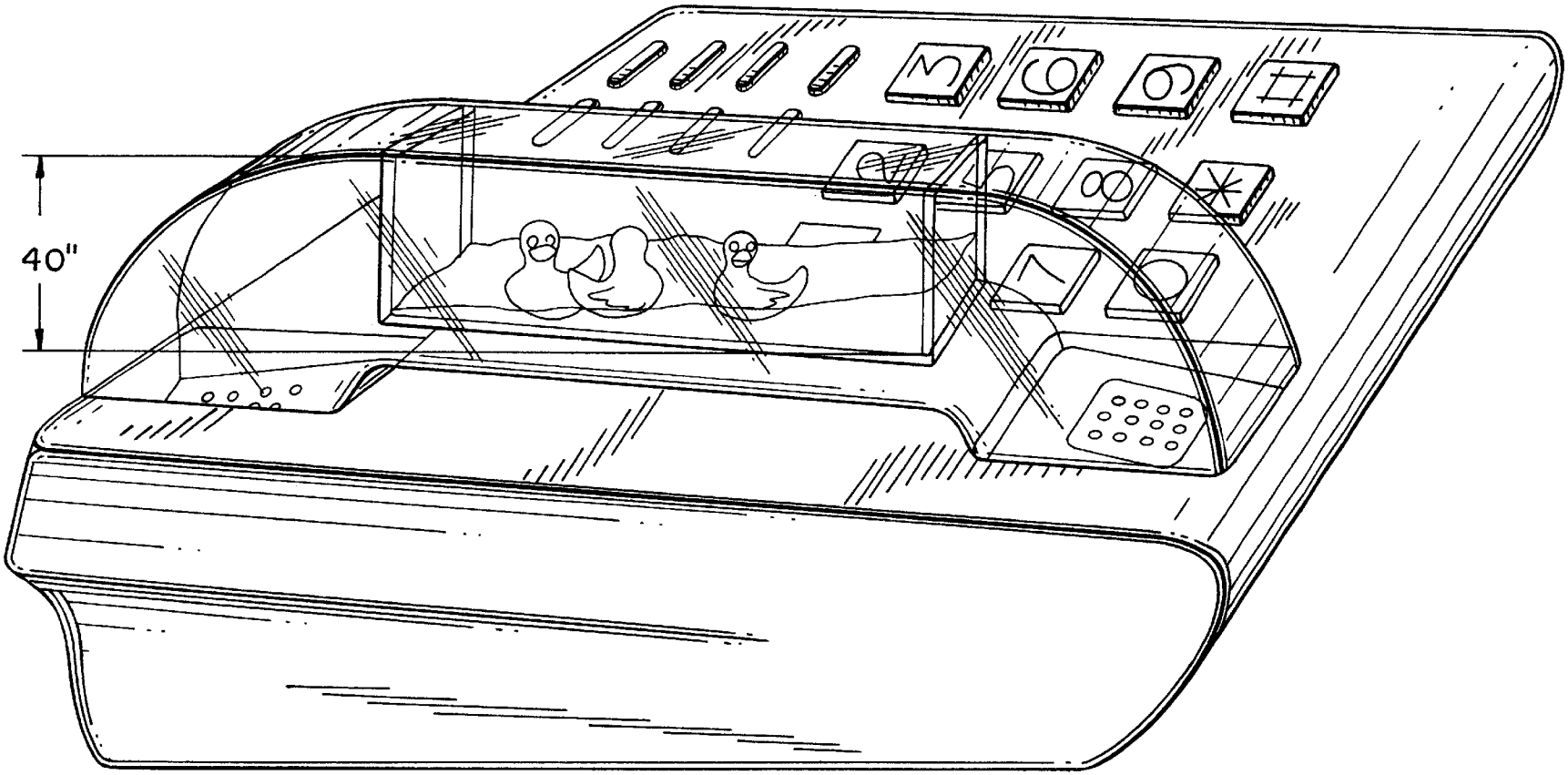
FIGS. 24A to 24D show a series of variations of a telephone set in accordance with the present invention wherein the decorative vessel can be at the center of the telephone receiver as shown, or at the ear piece or the mouth piece or both ear and mouth pieces, or can be at the base of the telephone set in accordance with the present invention.
Figure 24B:
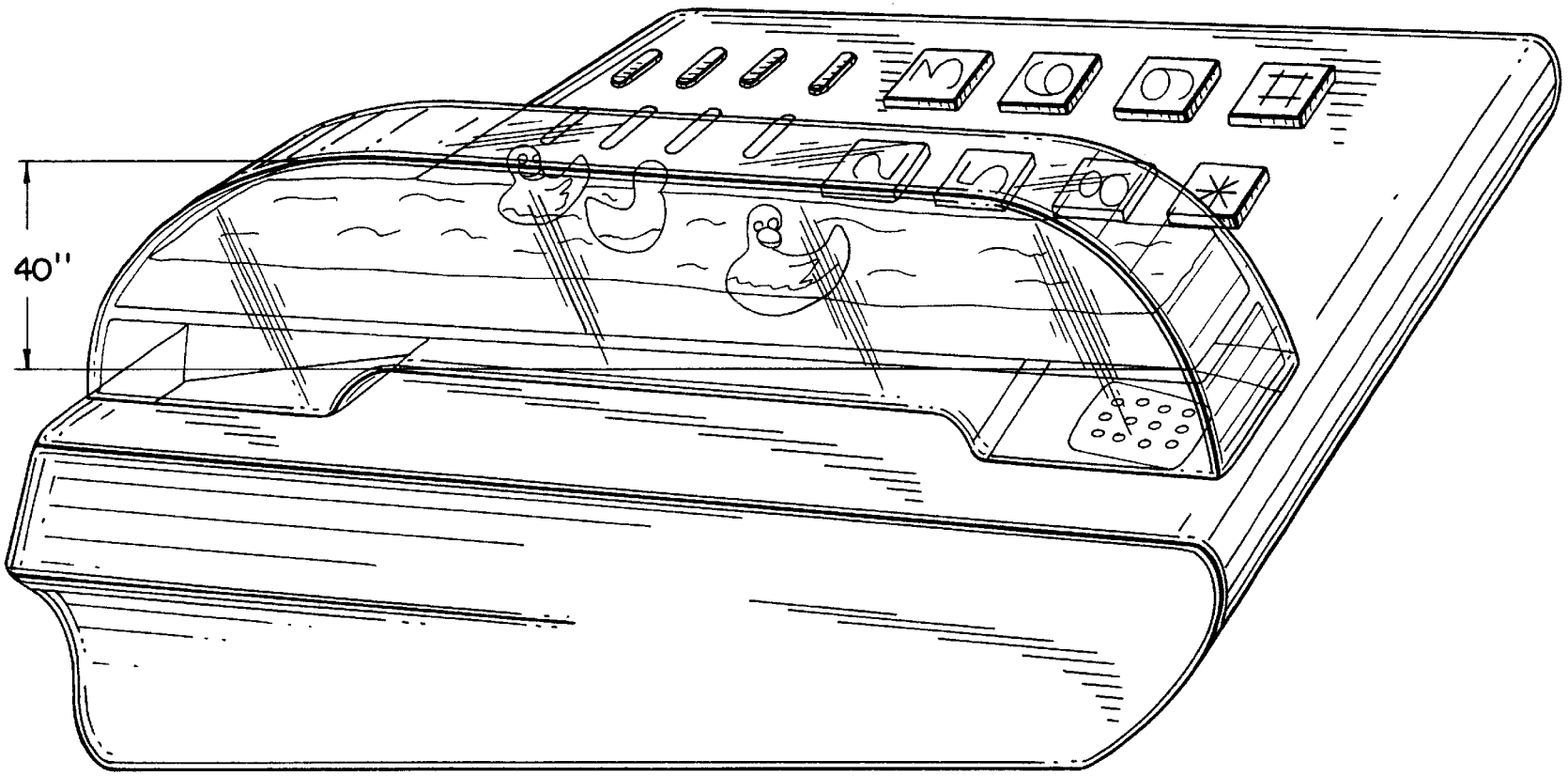
Figure 24C:
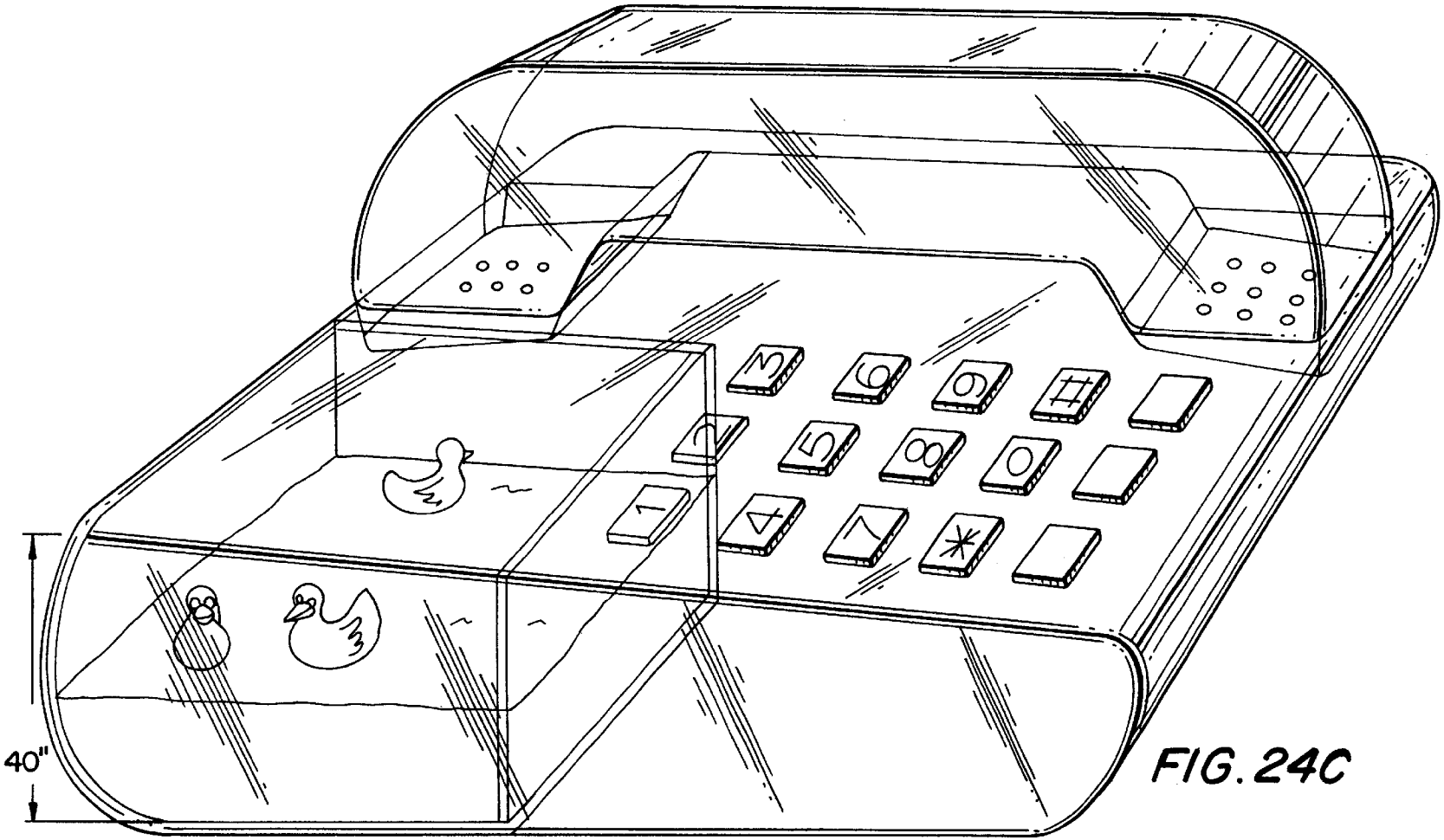
Figure 24D:
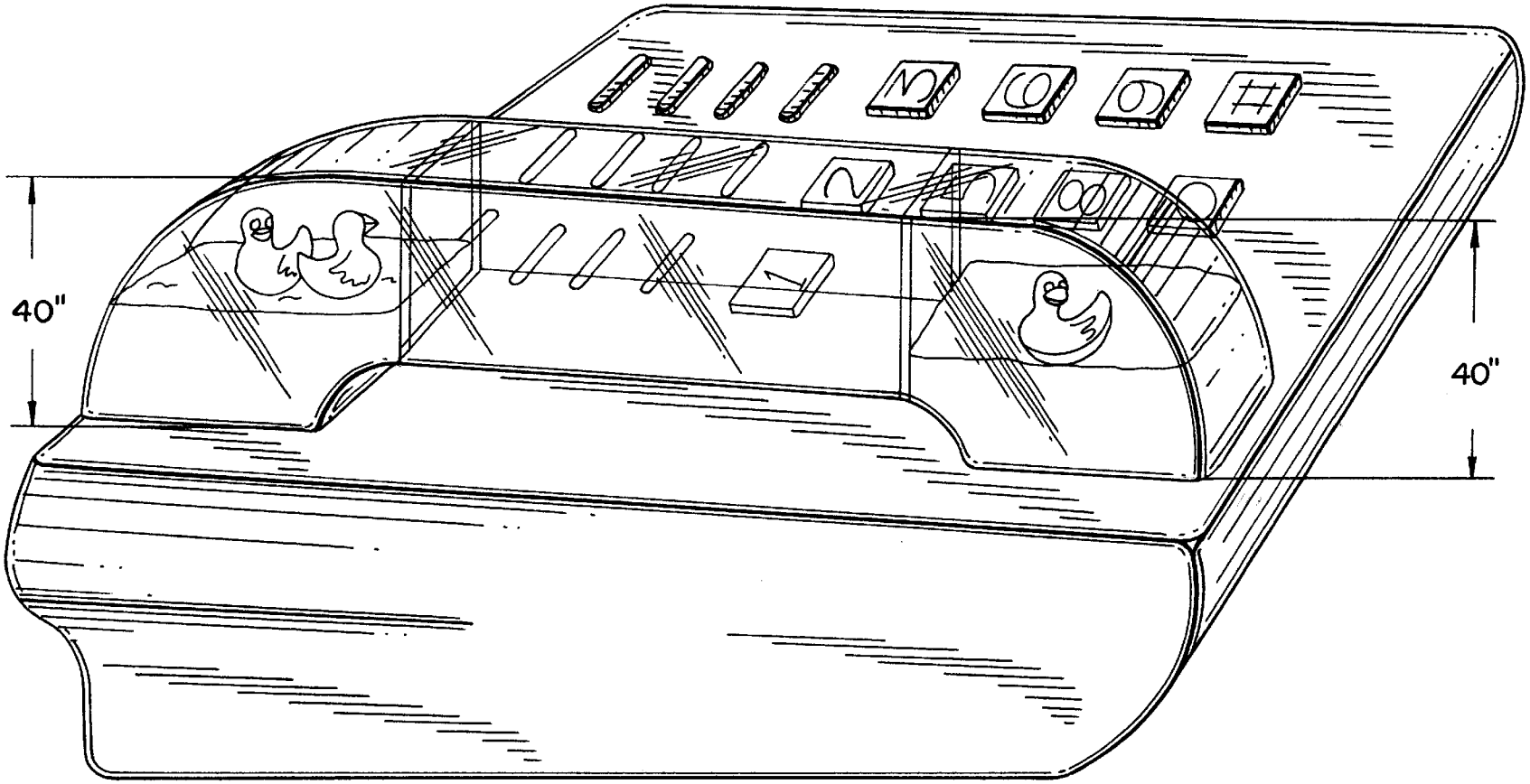
Figure 25A:
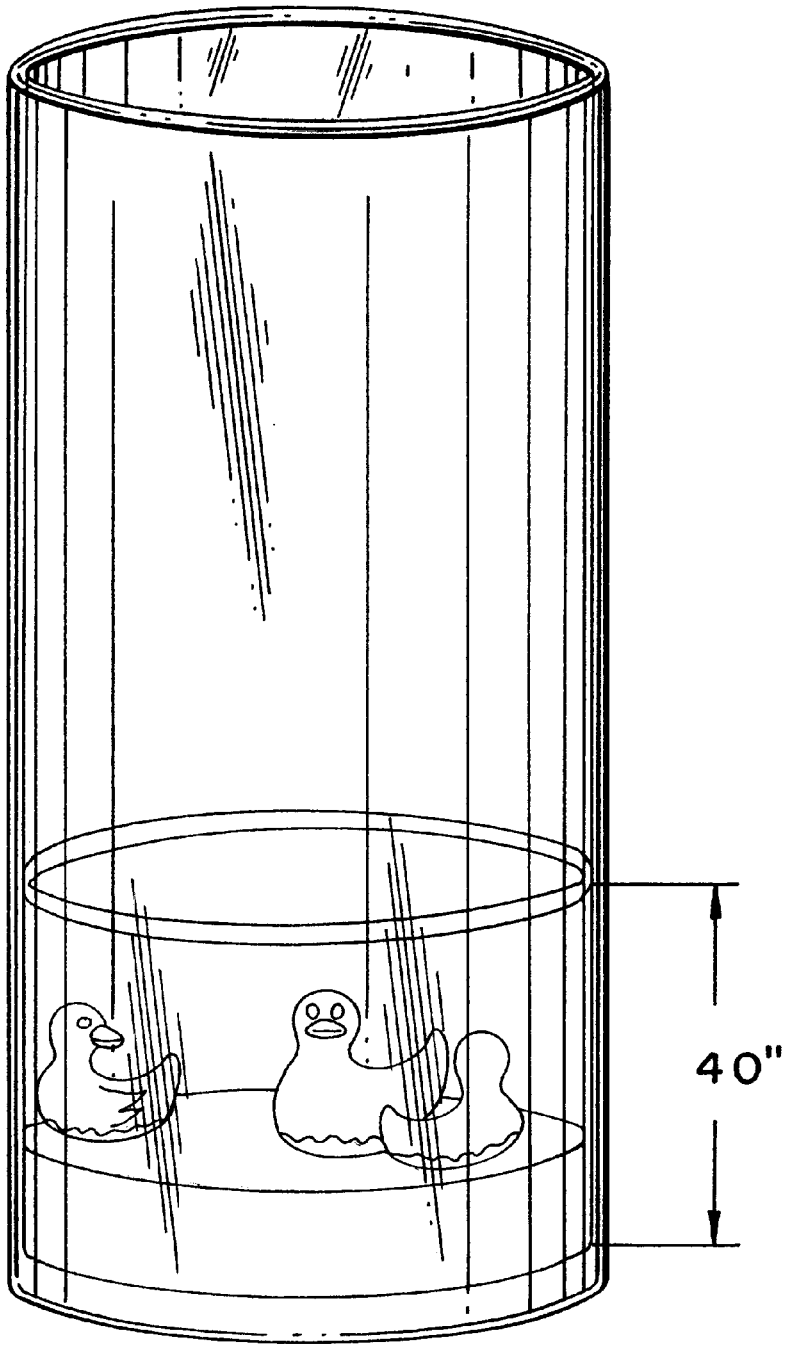
FIGS. 25A to 25C shows barware of different sizes in accordance with the present invention.
Figure 25B:
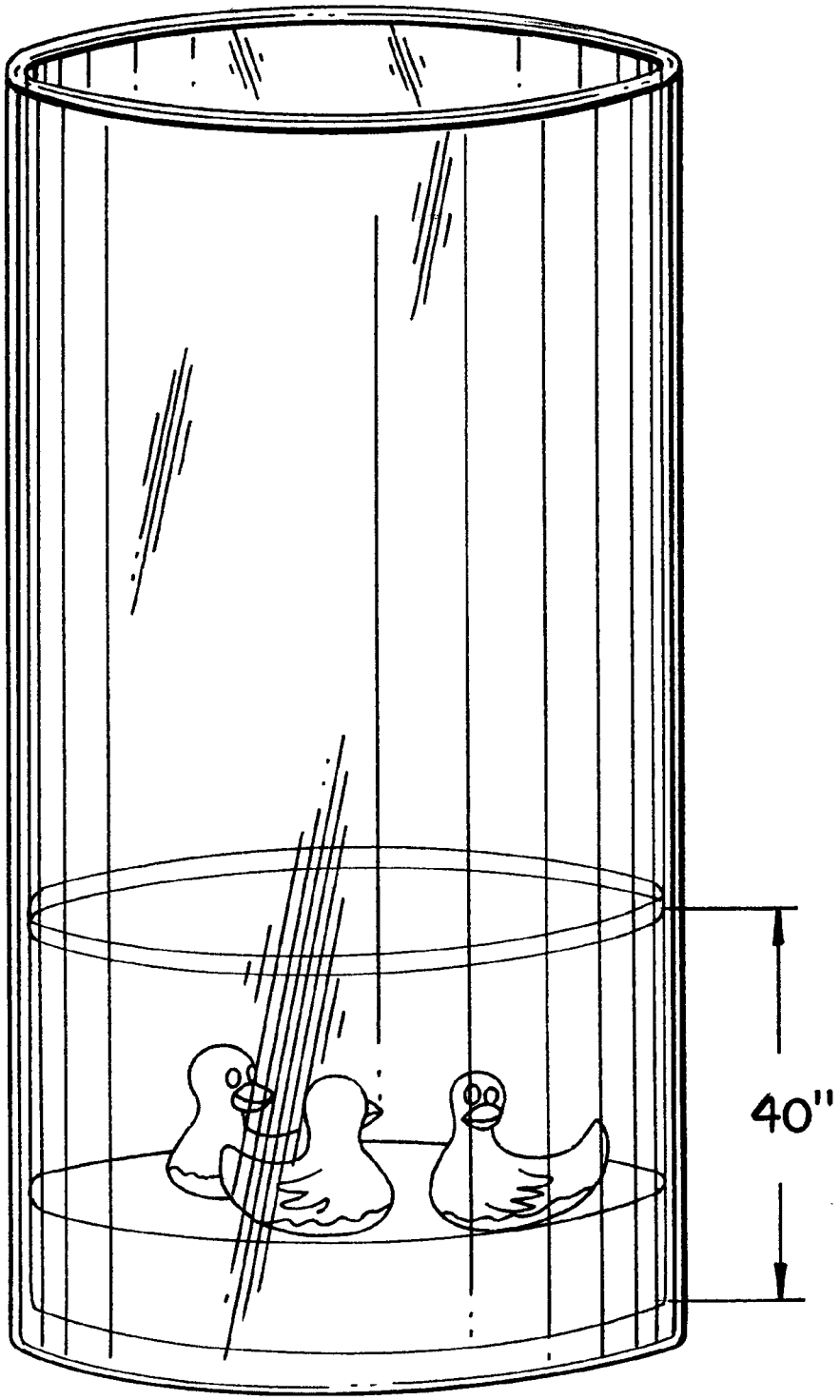
Figure 25C:
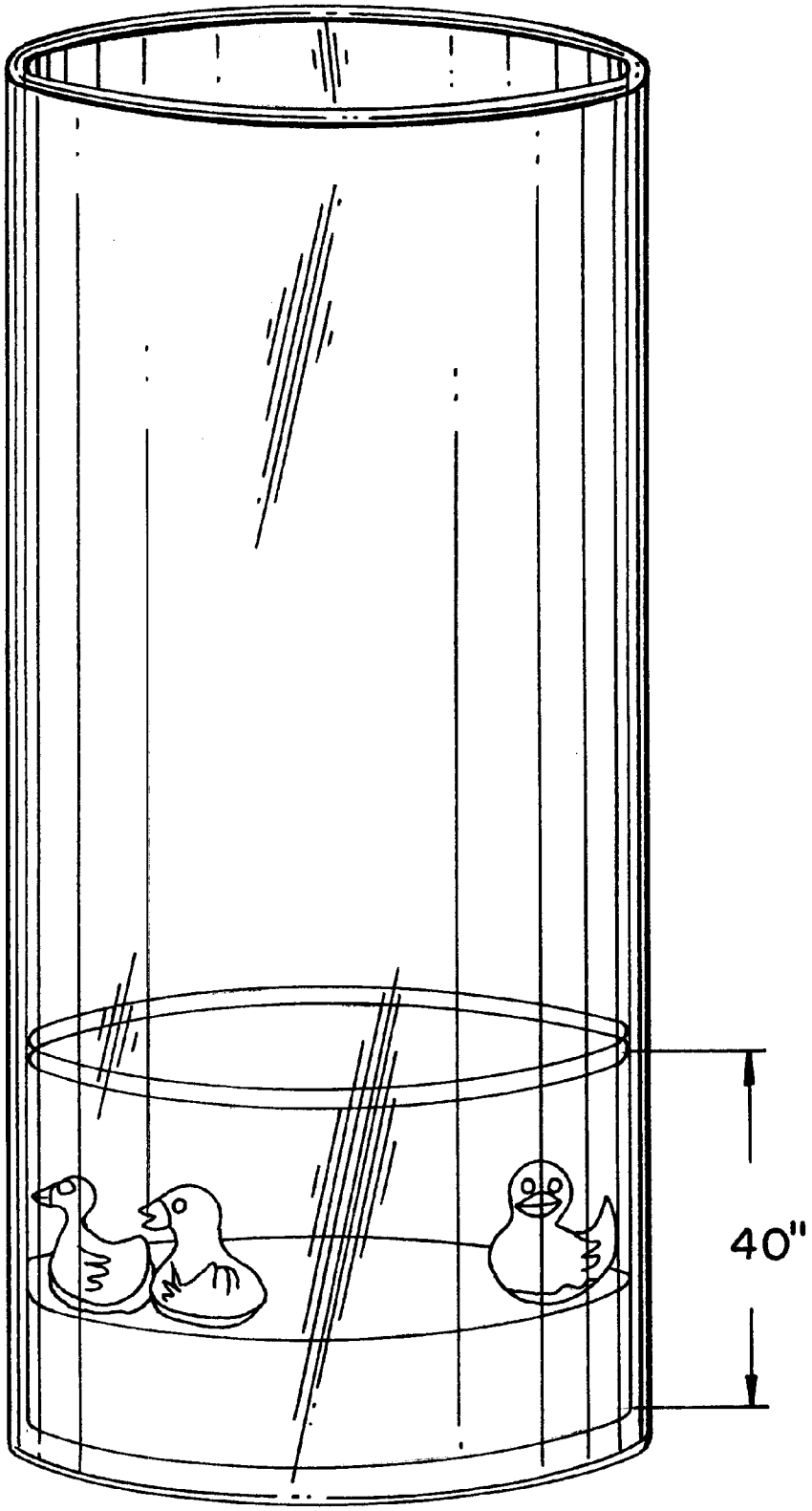
Figure 26:
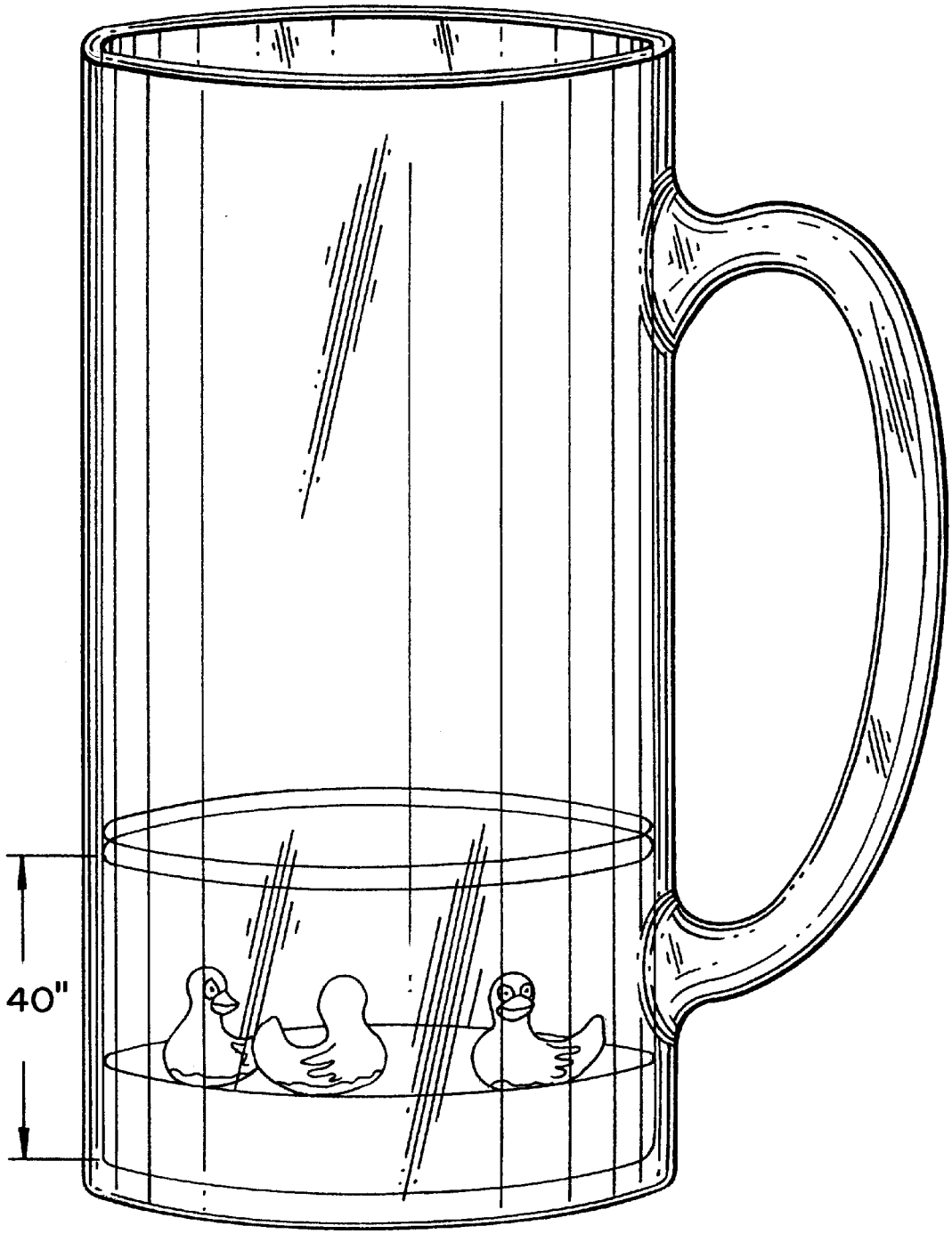
FIG. 26 shows a beer mug in accordance with the present invention.
Figure 27:
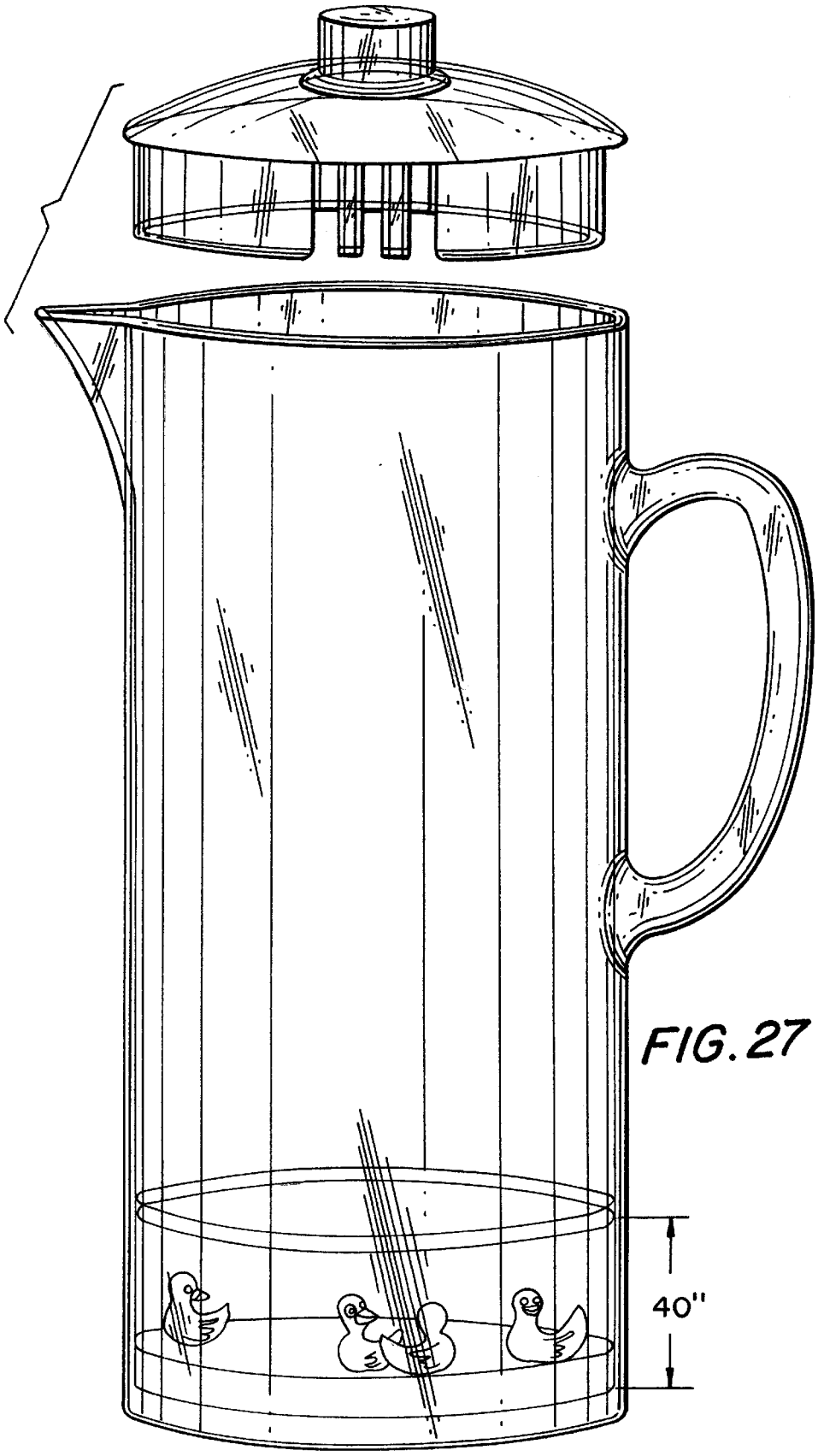
FIG. 27 shows a pitcher in accordance with the present invention.
Figure 28:
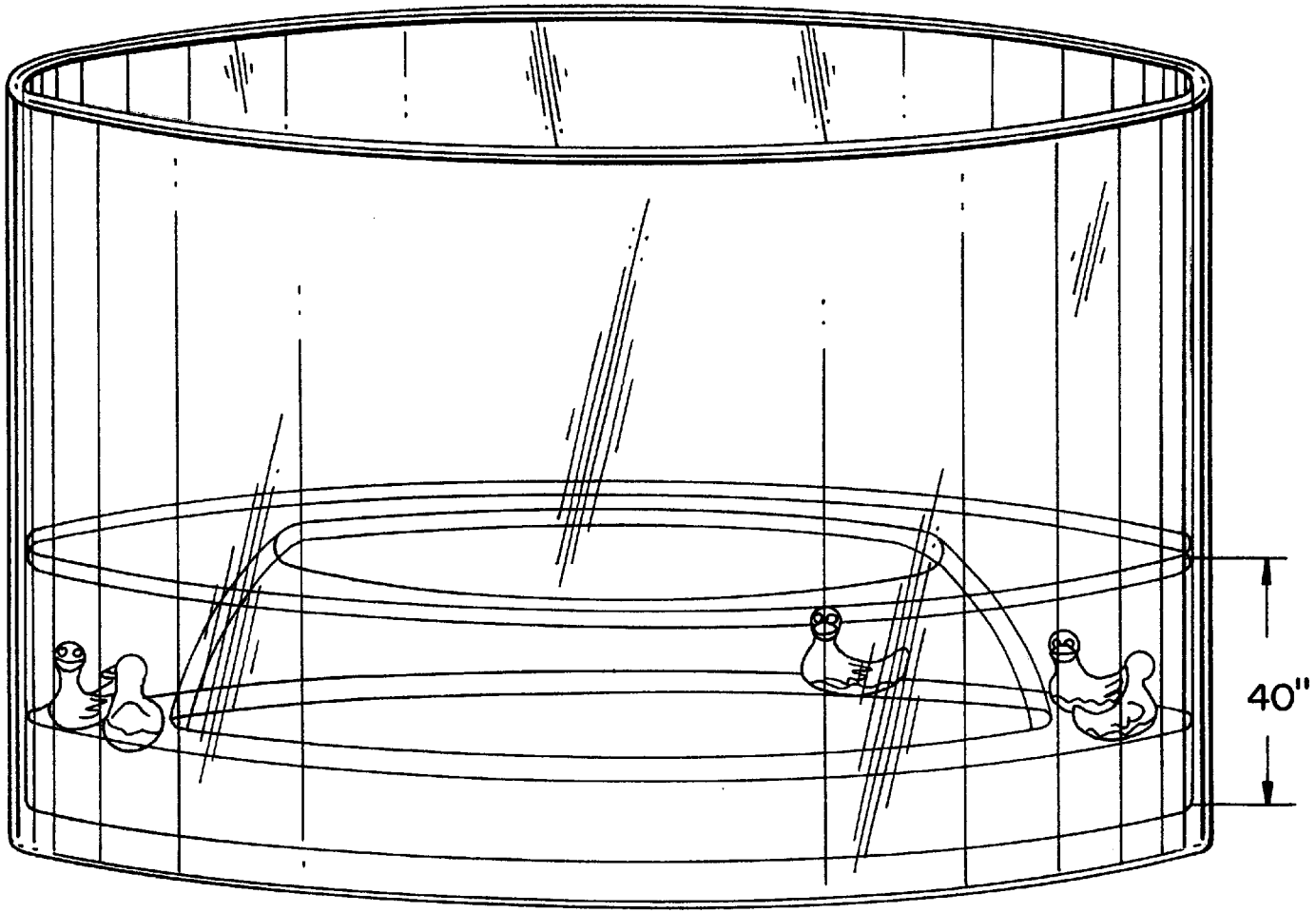
FIG. 28 shows a salad bowl in accordance with the present invention.
Figure 29:
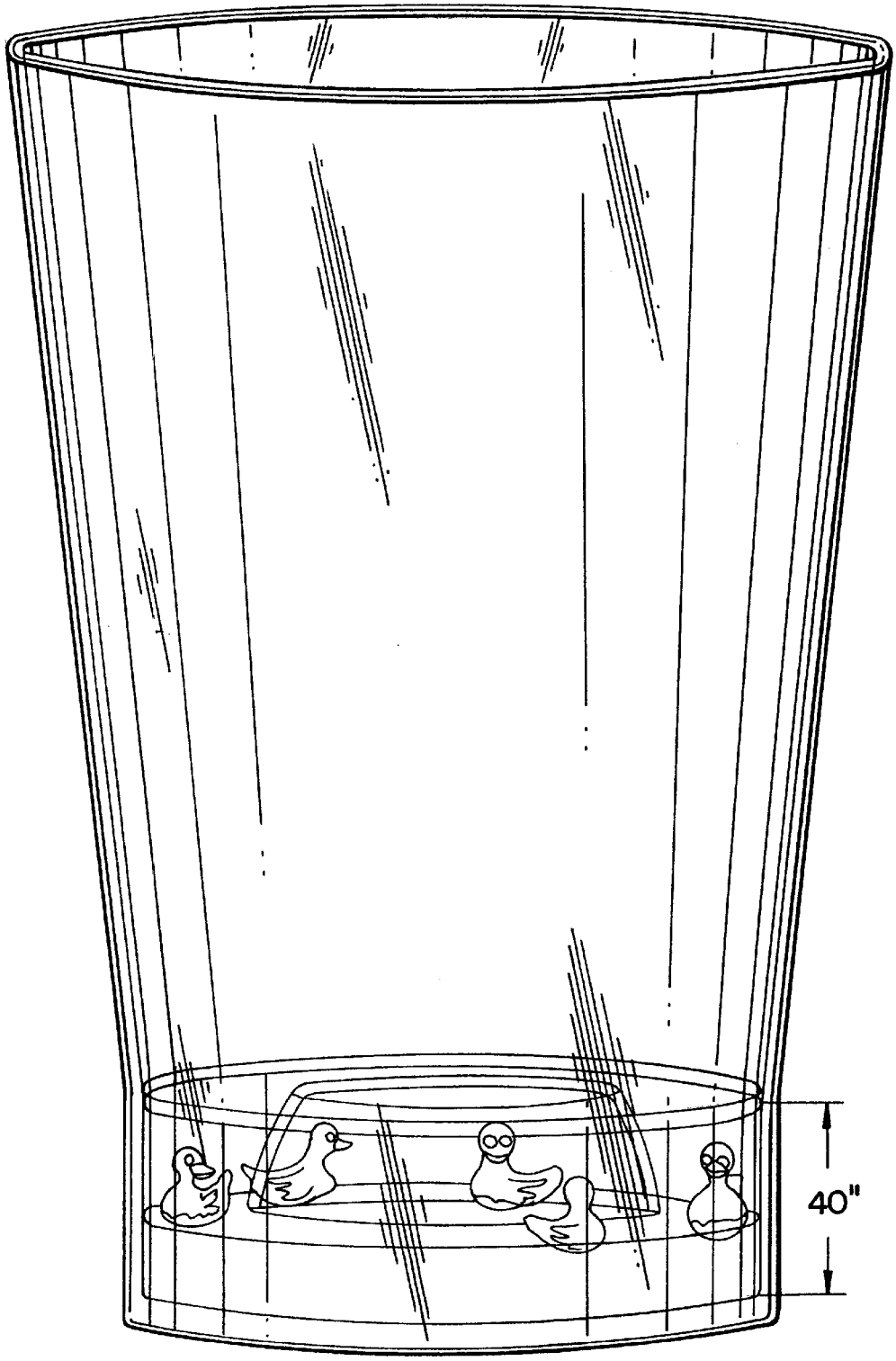
FIG. 29 shows a wastebasket in accordance with the present invention.
Figure 30:
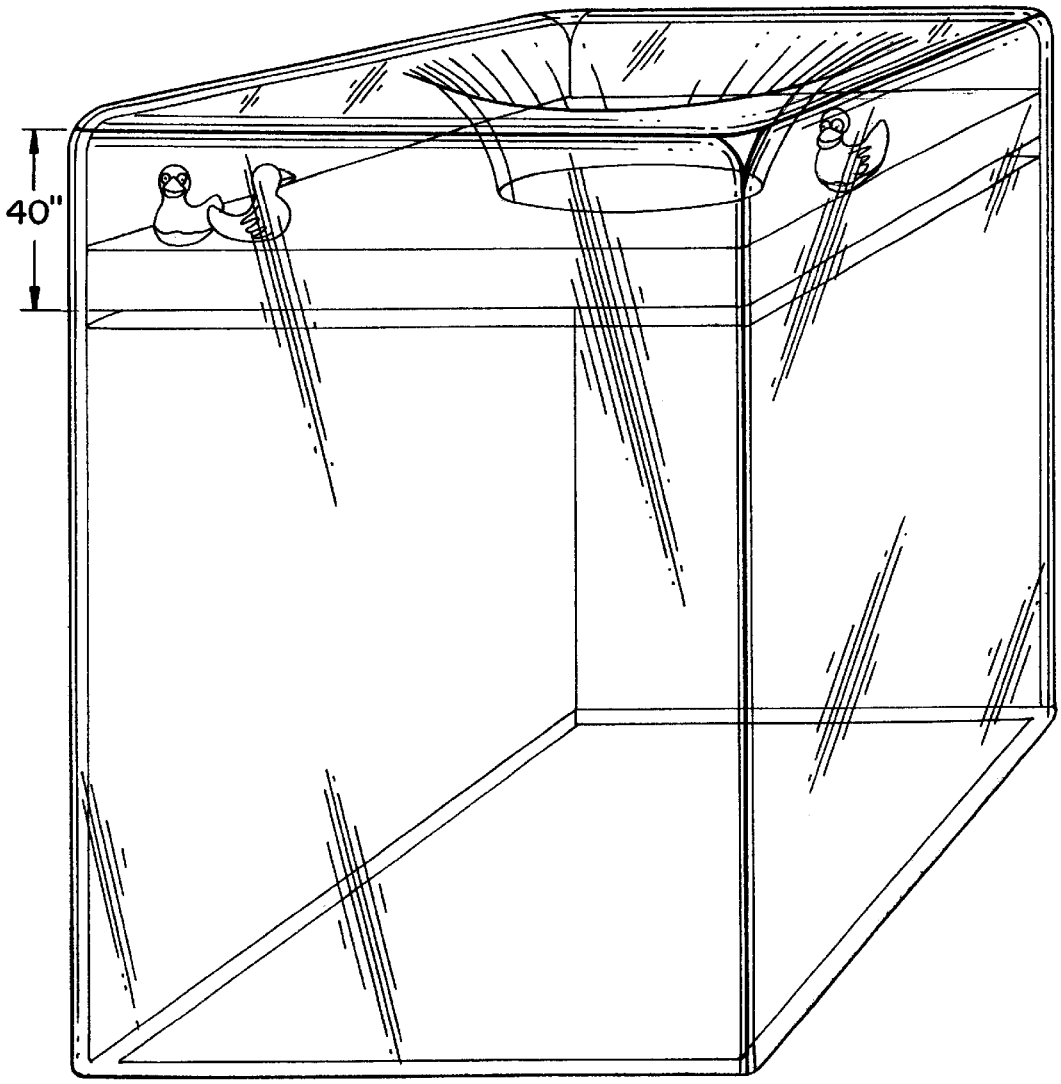
FIG. 30 shows a tissue cover in accordance with the present invention.
Figure 31A:
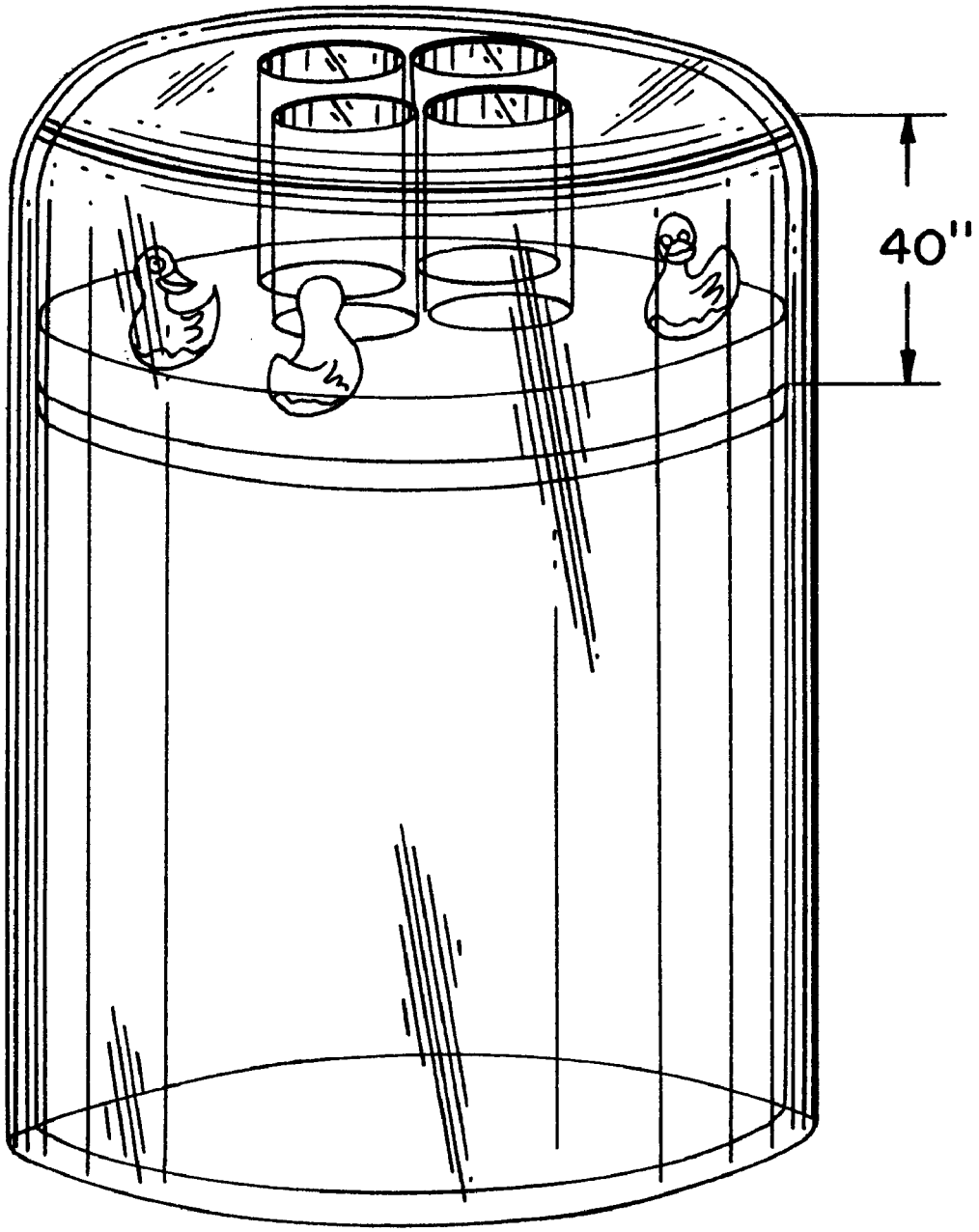
FIGS. 31A to 31F shows variations of toothbrush holders in accordance with the present invention.
Figure 31B:
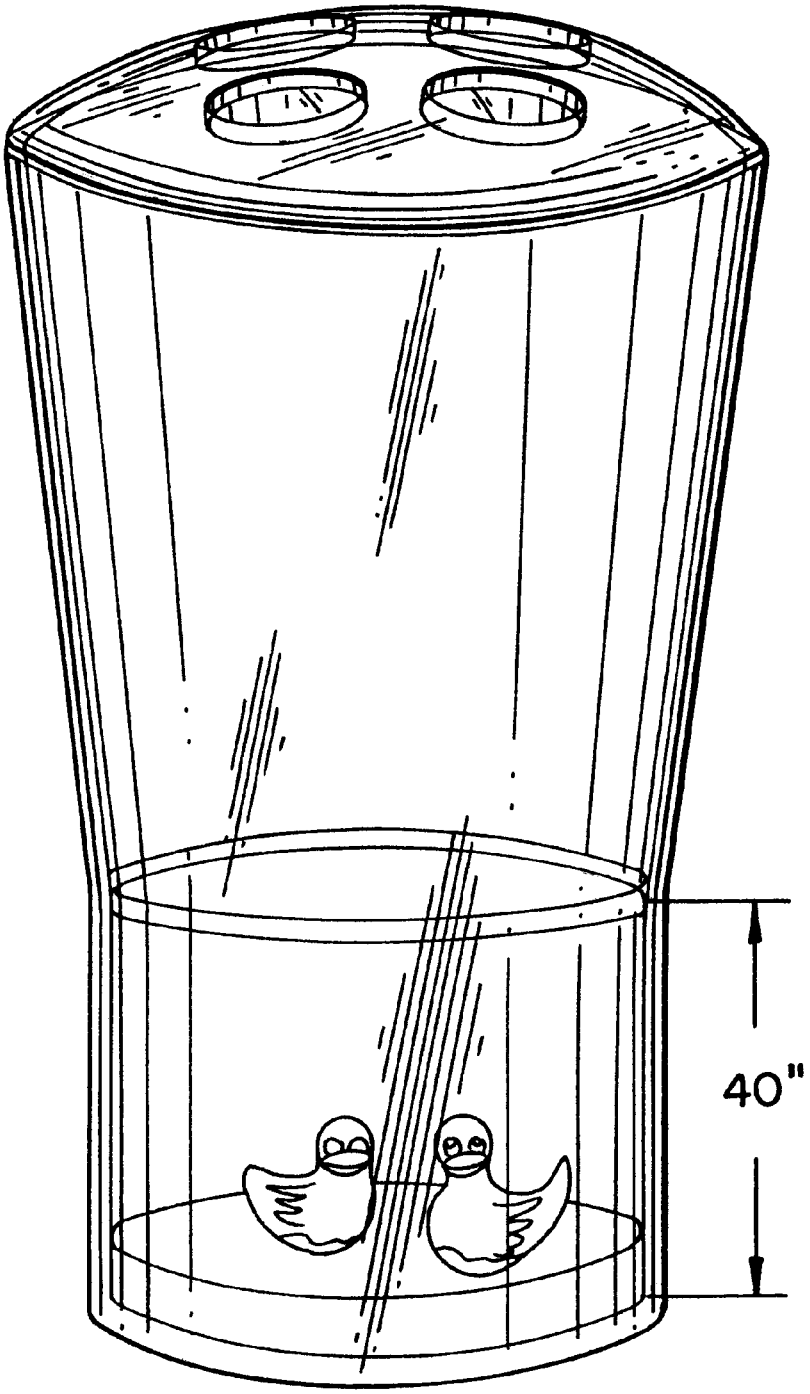
Figure 31C:
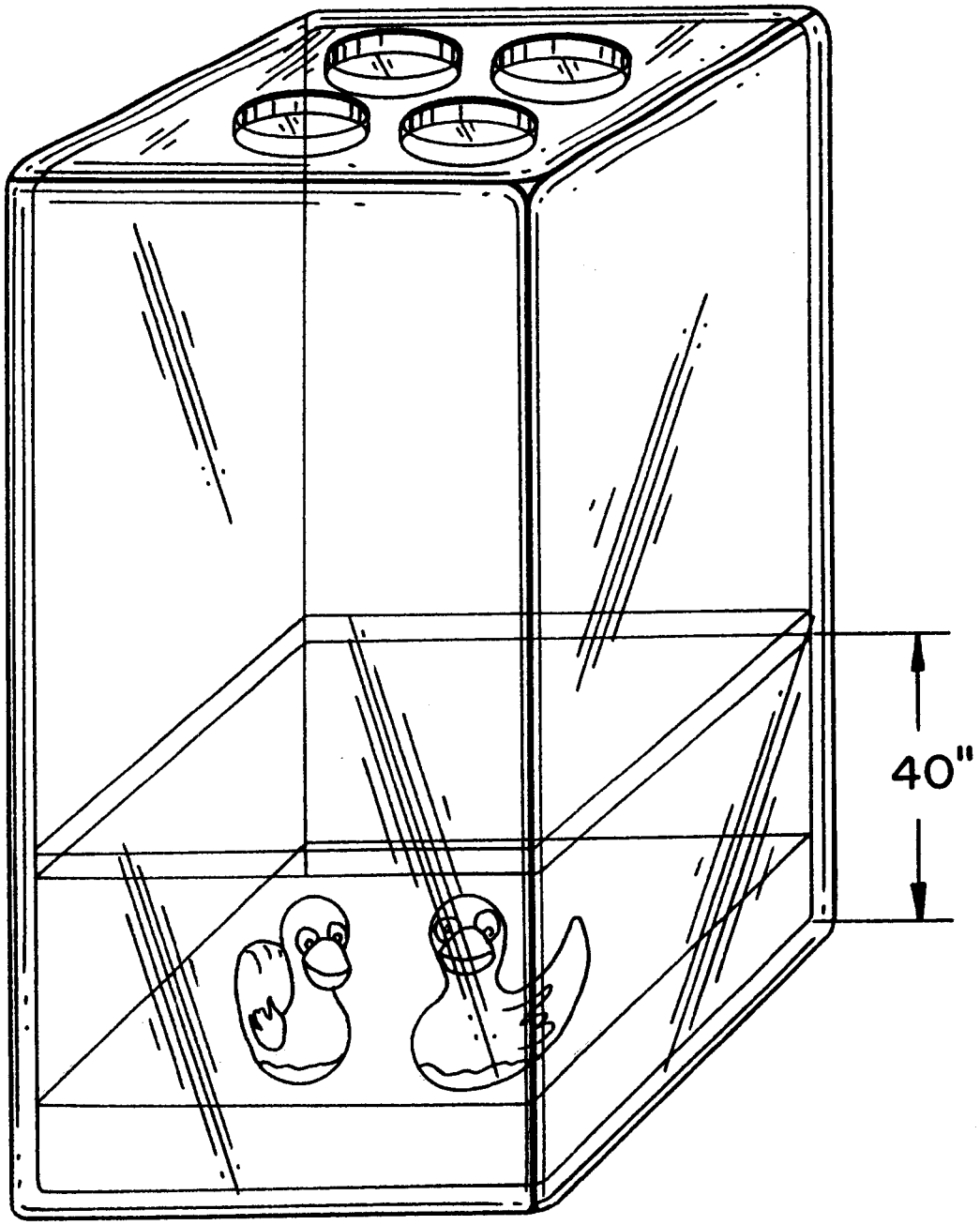
Figure 31D:
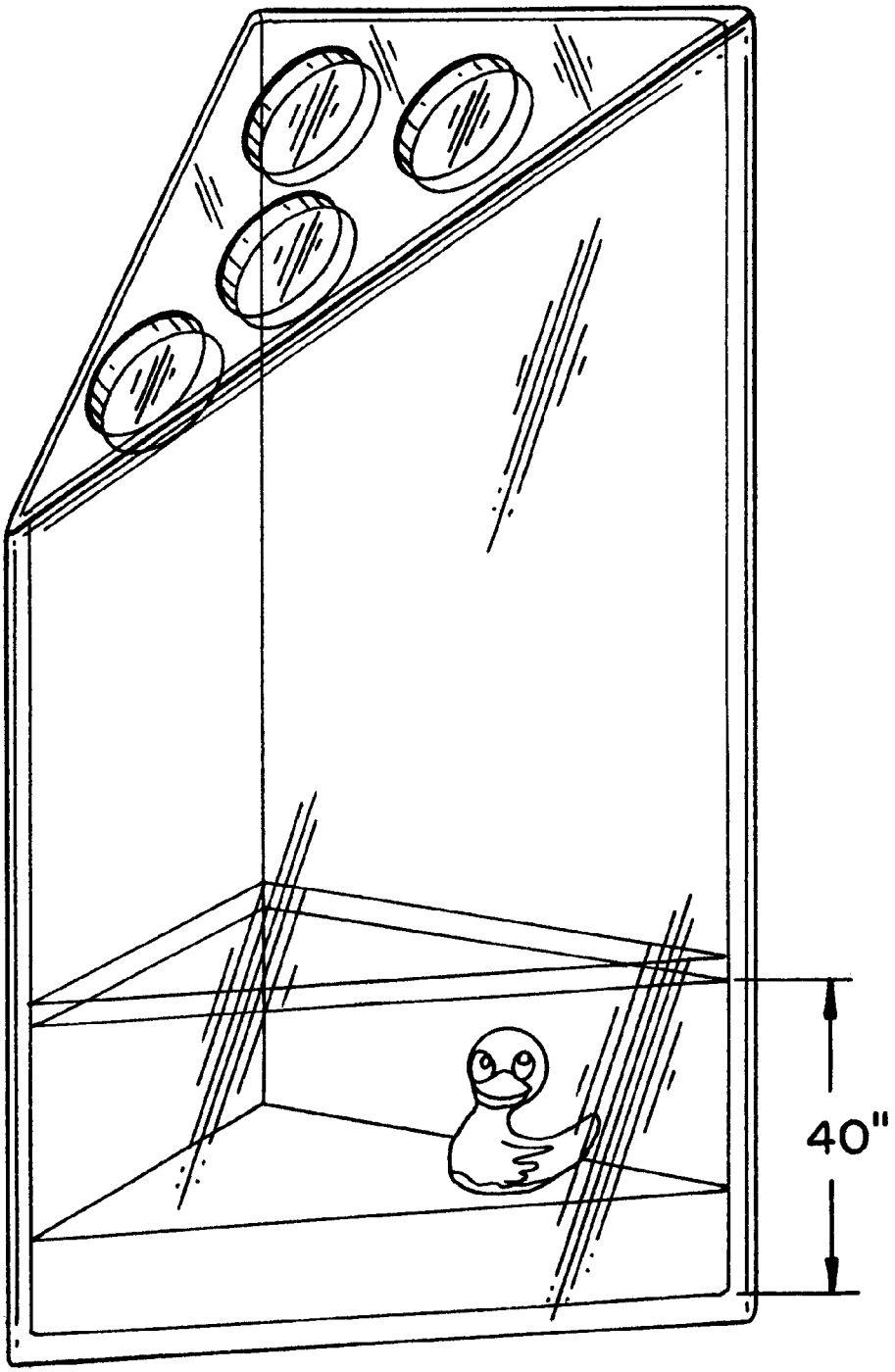
Figure 31E:
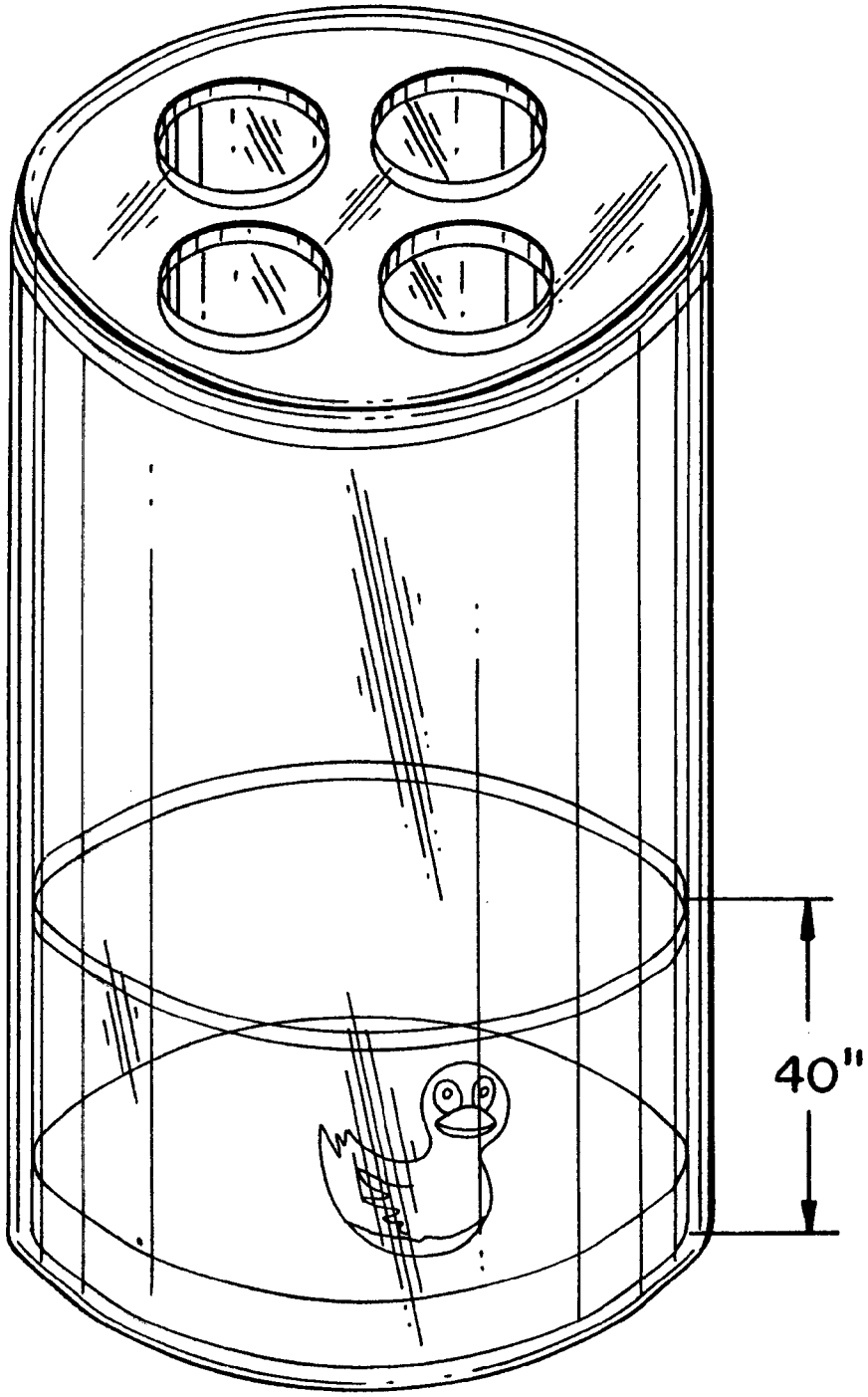
Figure 31F:
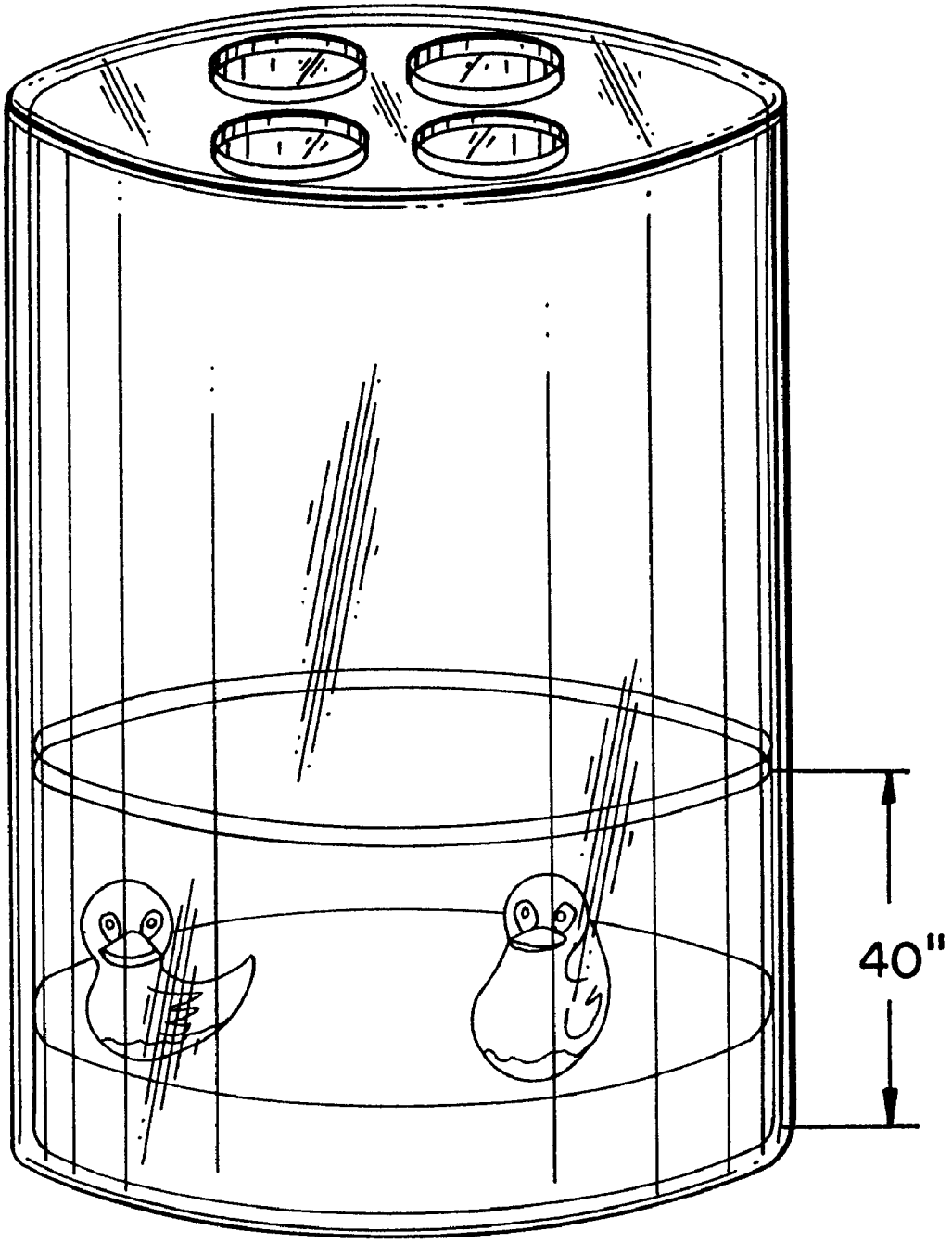
Figure 32:
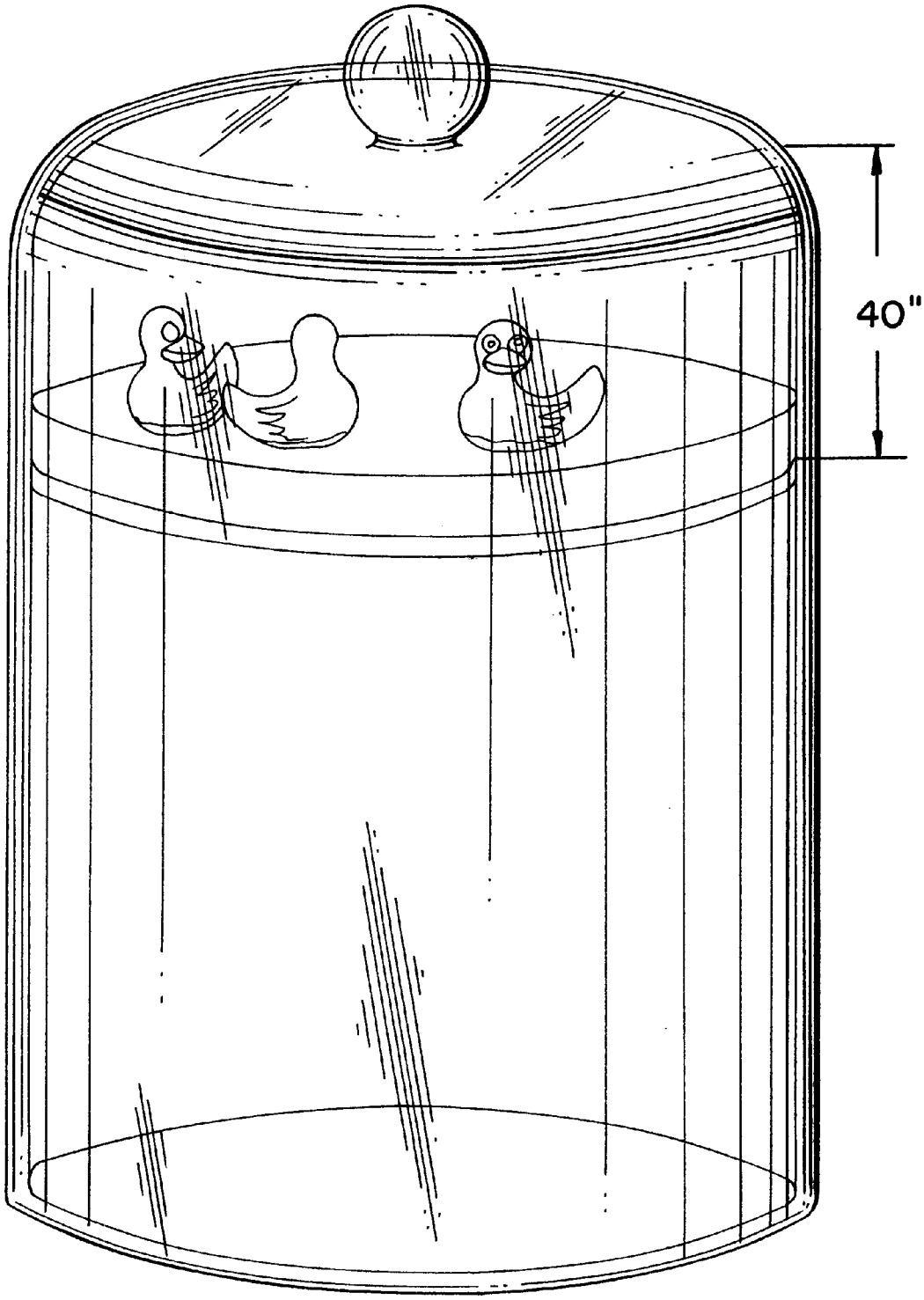
FIG. 32 shows a cotton ball jar in accordance with the present invention.
Figure 33A:
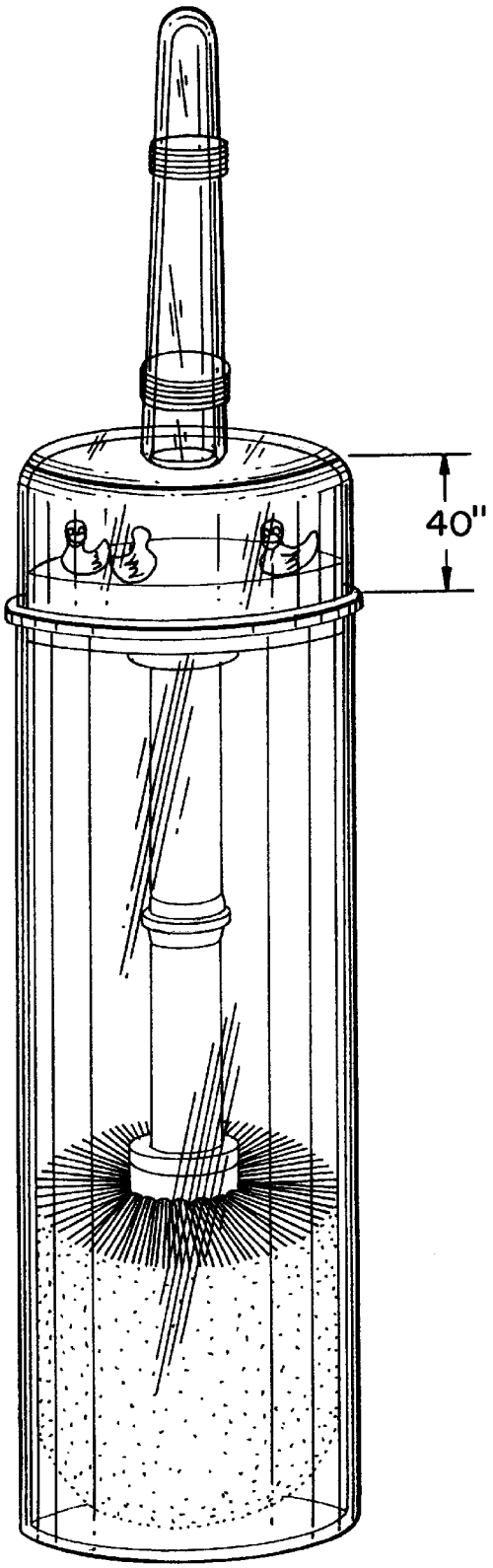
FIGS. 33A to 33G show a series of variations of a toilet brush and holder in accordance with the present invention.
Figure 33B:
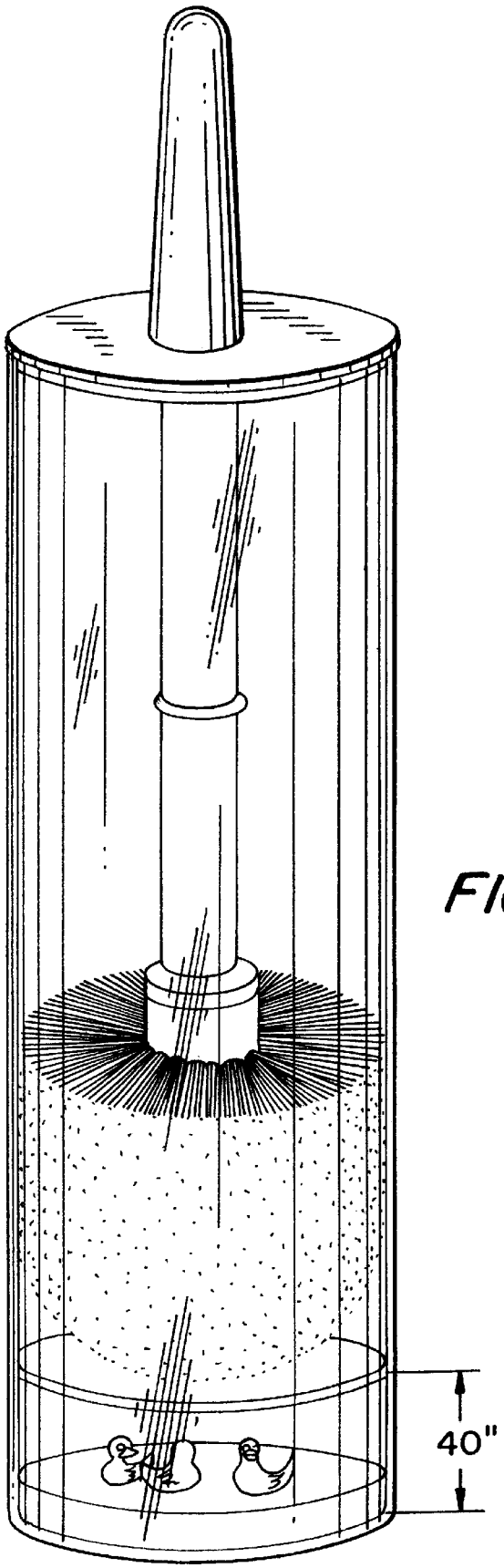
Figure 33C:
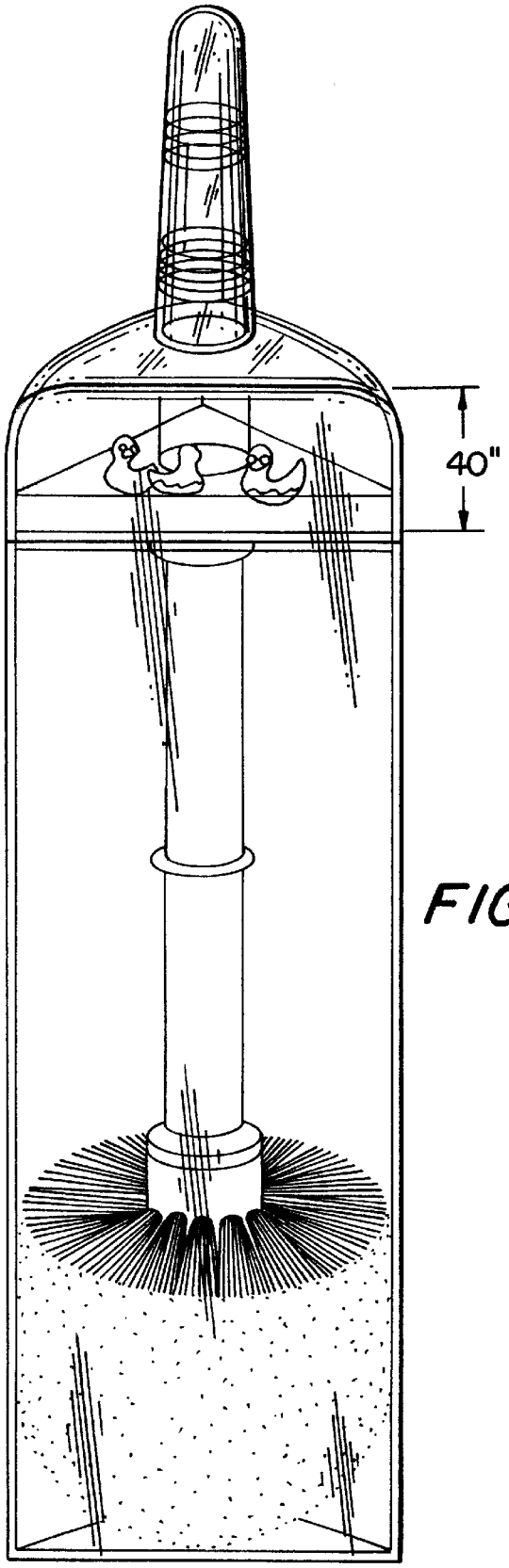
Figure 33D:
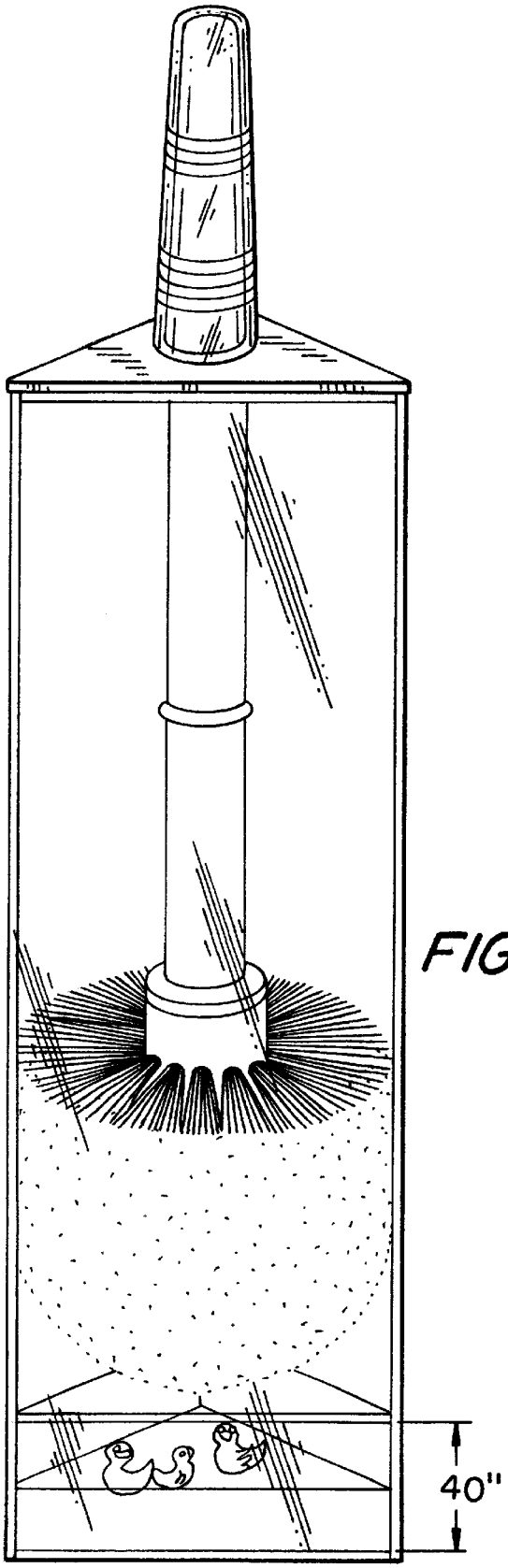
Figure 33E:
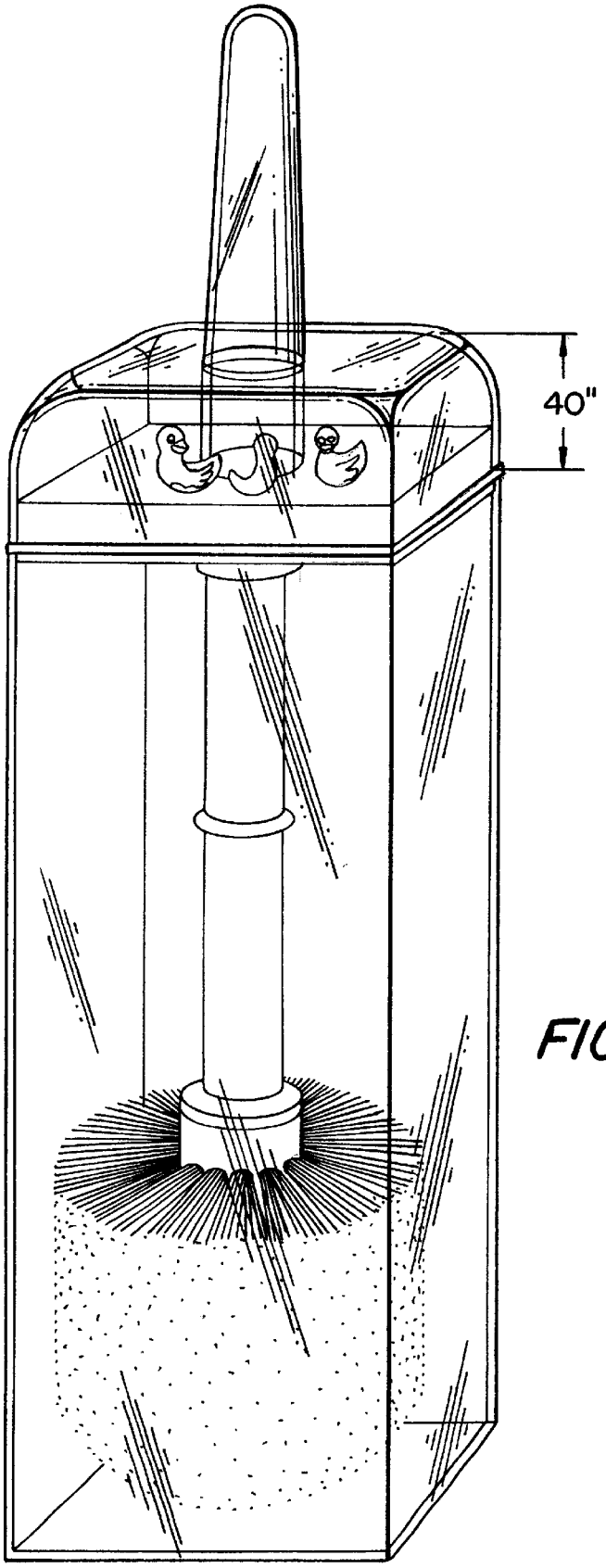
Figure 33F:
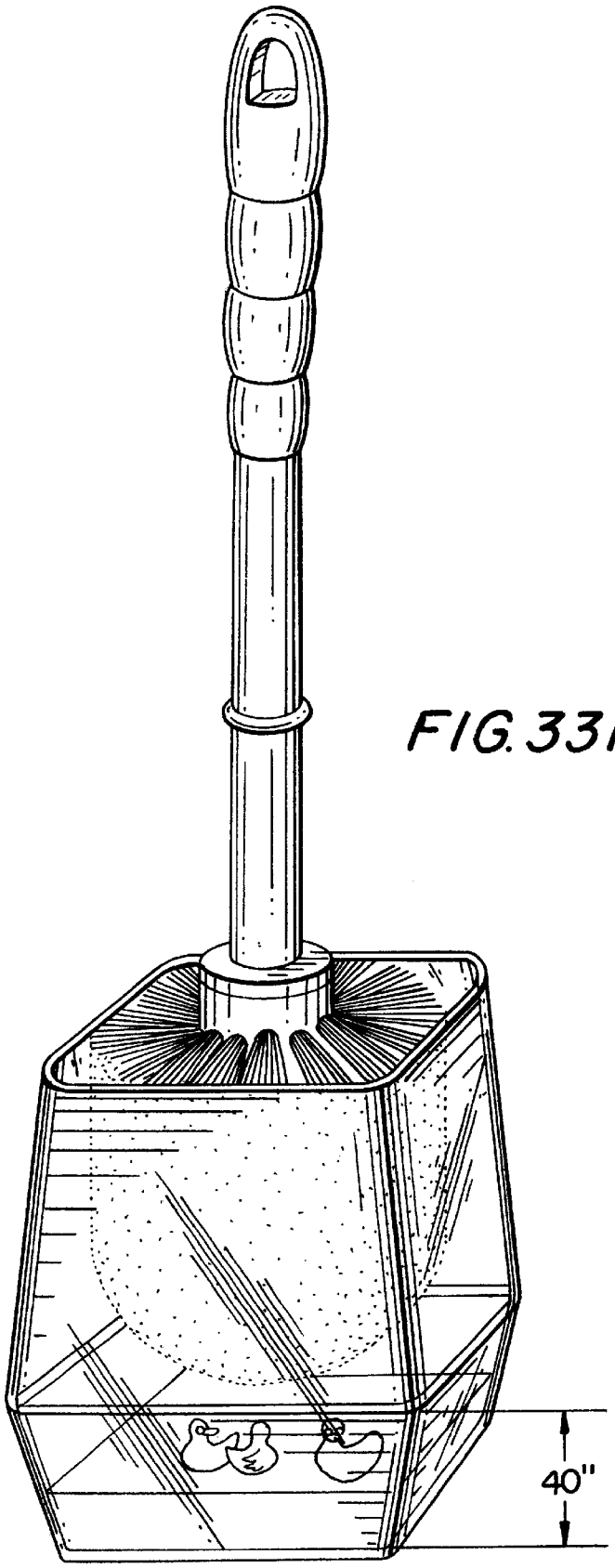
Figure 33G:
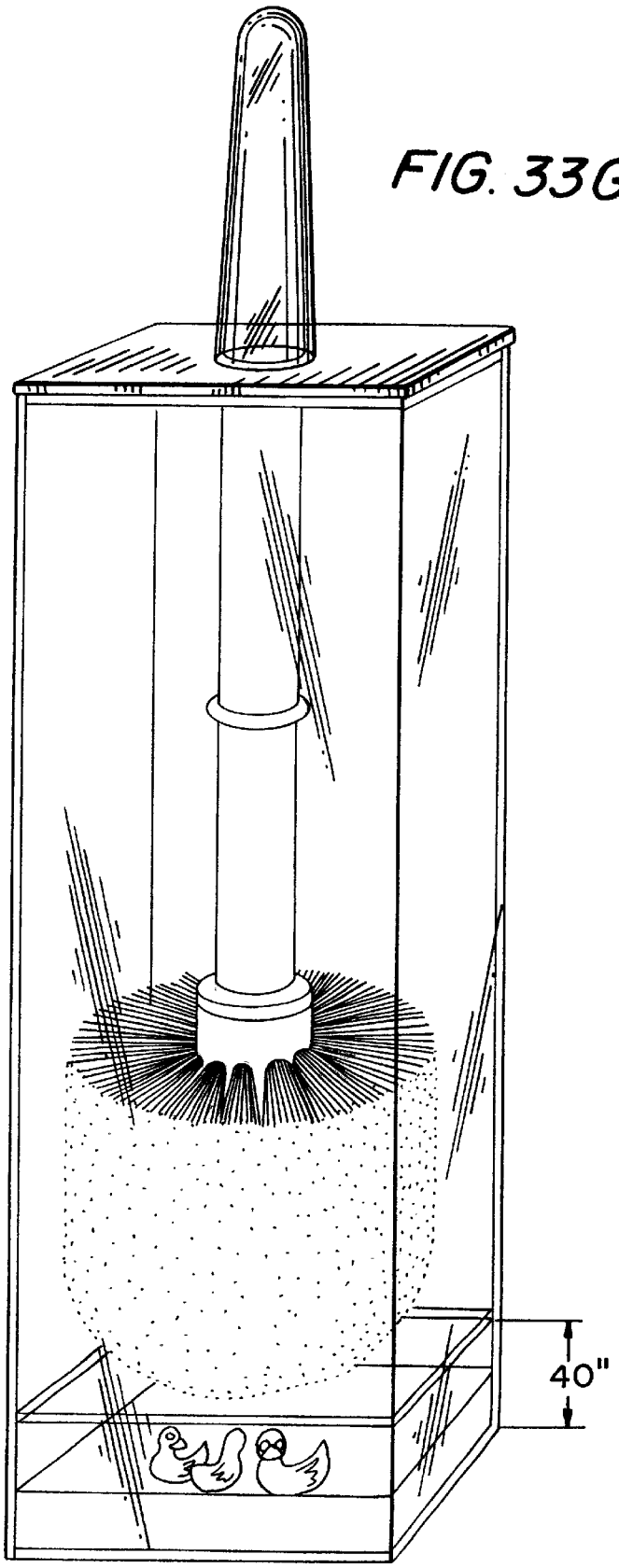
Figure 34:
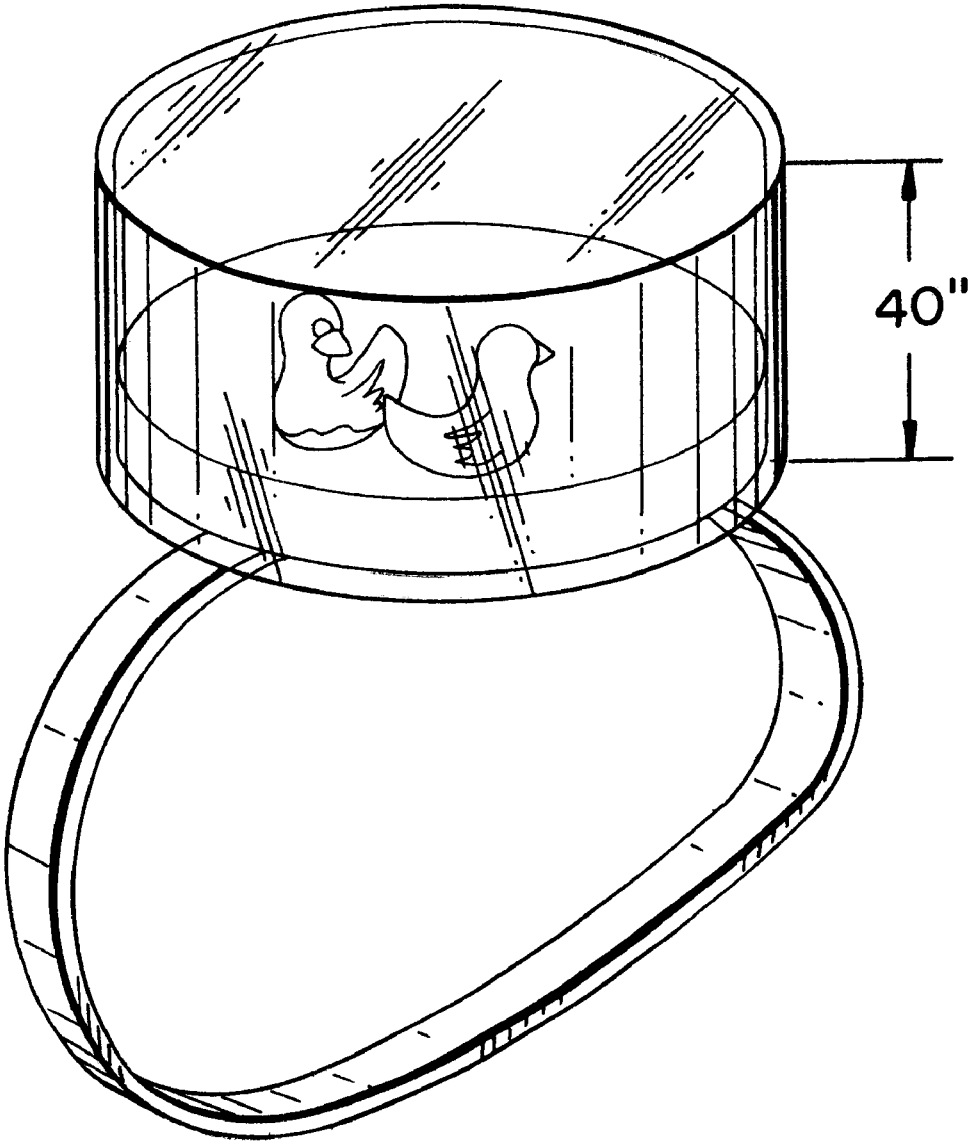
FIG. 34 shows a napkin ring in accordance with the present invention.
Figure 35:
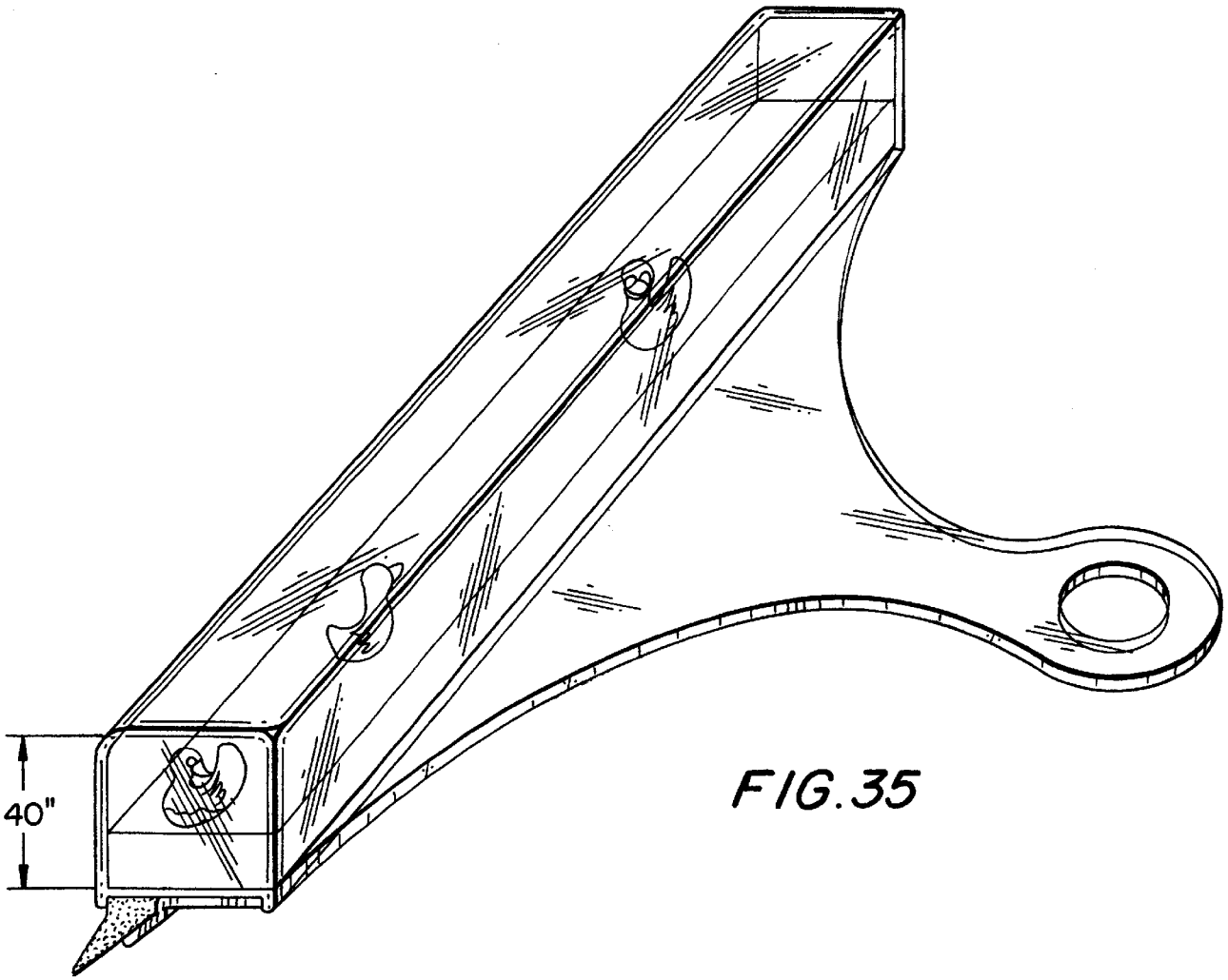
FIG. 35 shows a squeegee in accordance with the present invention.
Figure 36:
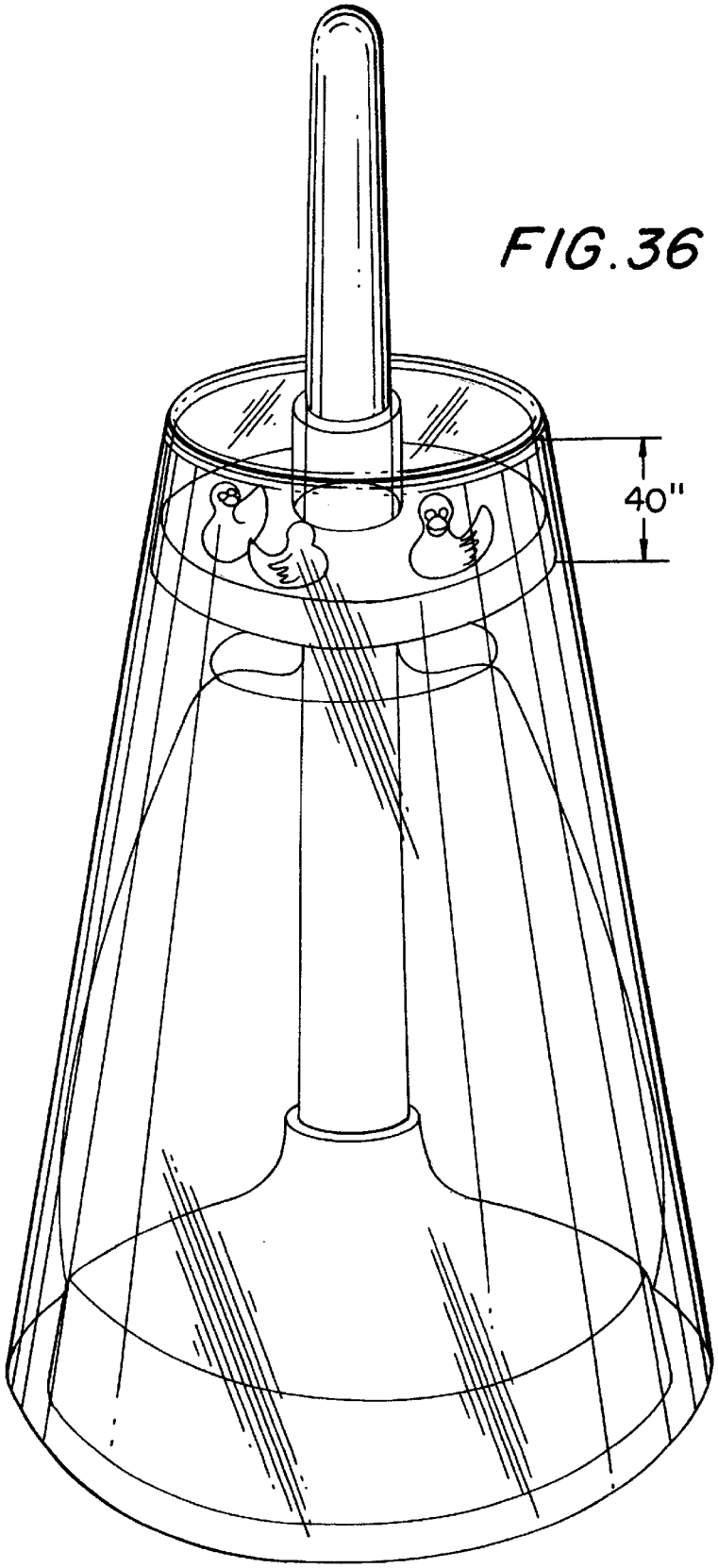
FIG. 36 shows a plunger and a stand in accordance with the present invention.
Figure 37A:
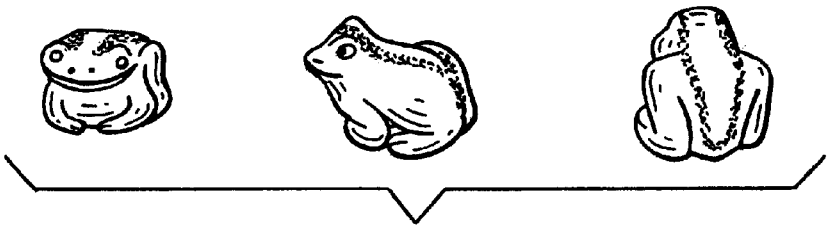
FIGS. 37A to FIG. 37G shows various buoy as a three-dimensional decorative structure in accordance with the present invention.
Figure 37B:
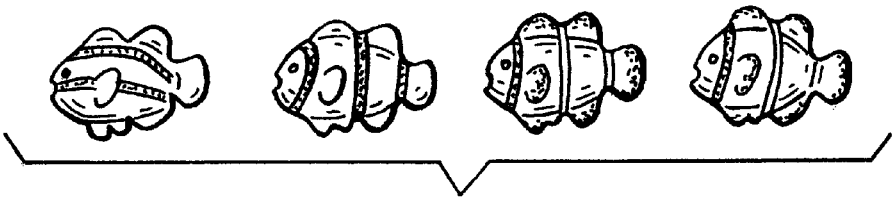
Figure 37C:
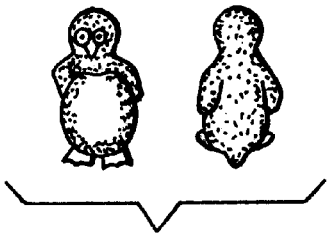
Figure 37E:
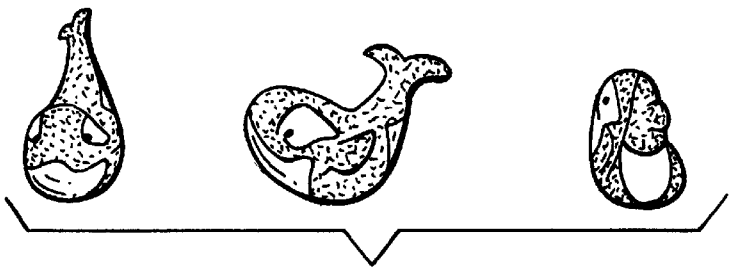
Figure 37G:
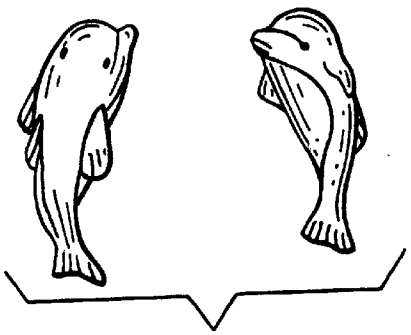
Figure 37D:
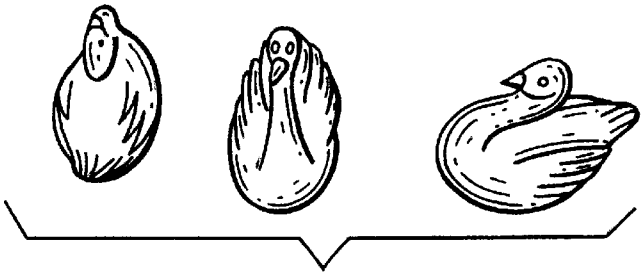
Figure 37F:
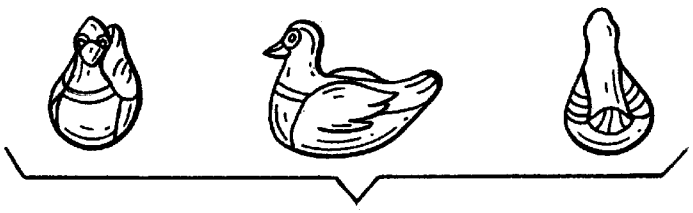
Figure 38A:
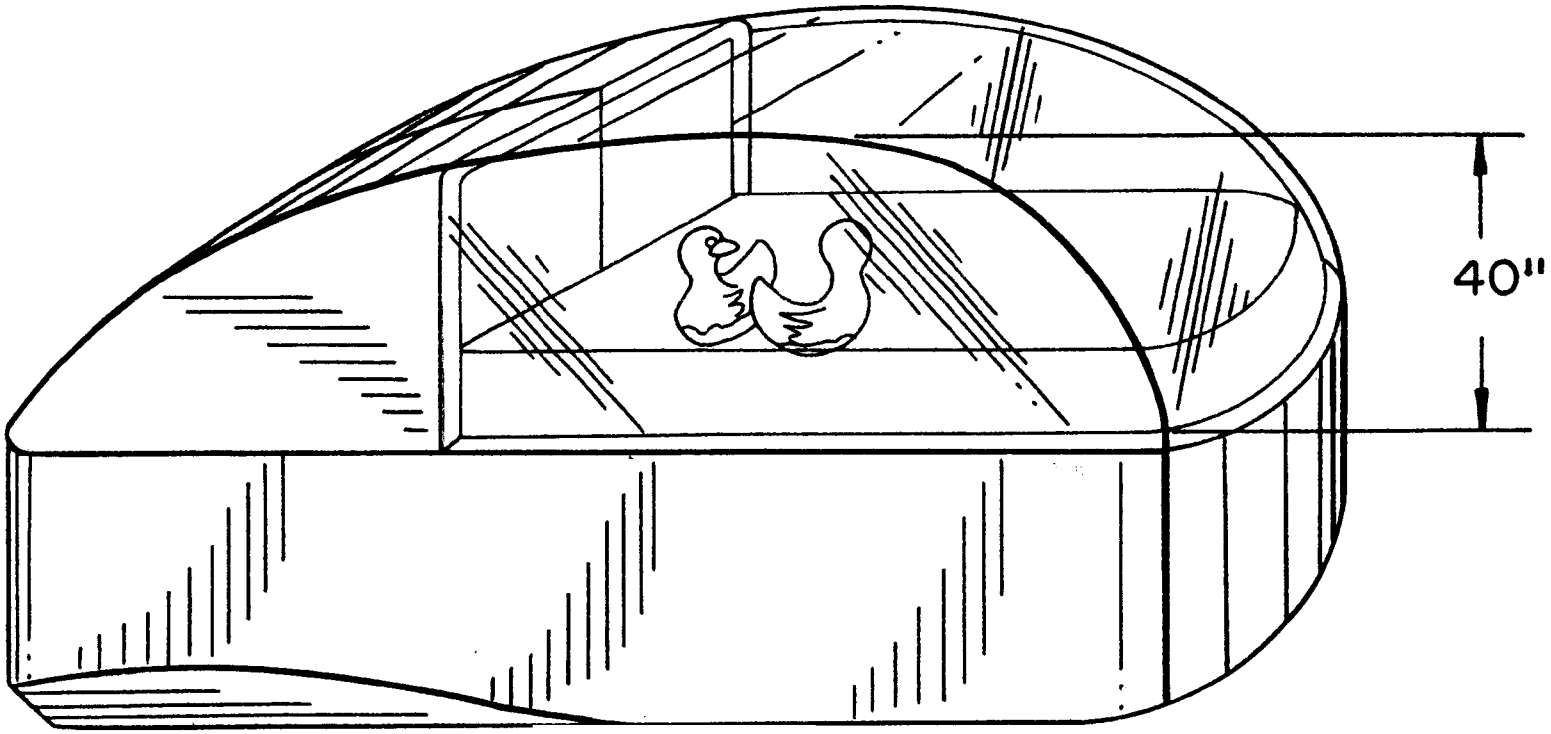
FIGS. 38A to 38F shows various embodiment of a computer mouse in accordance with the present invention wherein the decorative vessel can be placed anywhere in the computer mouse.
Figure 38B:
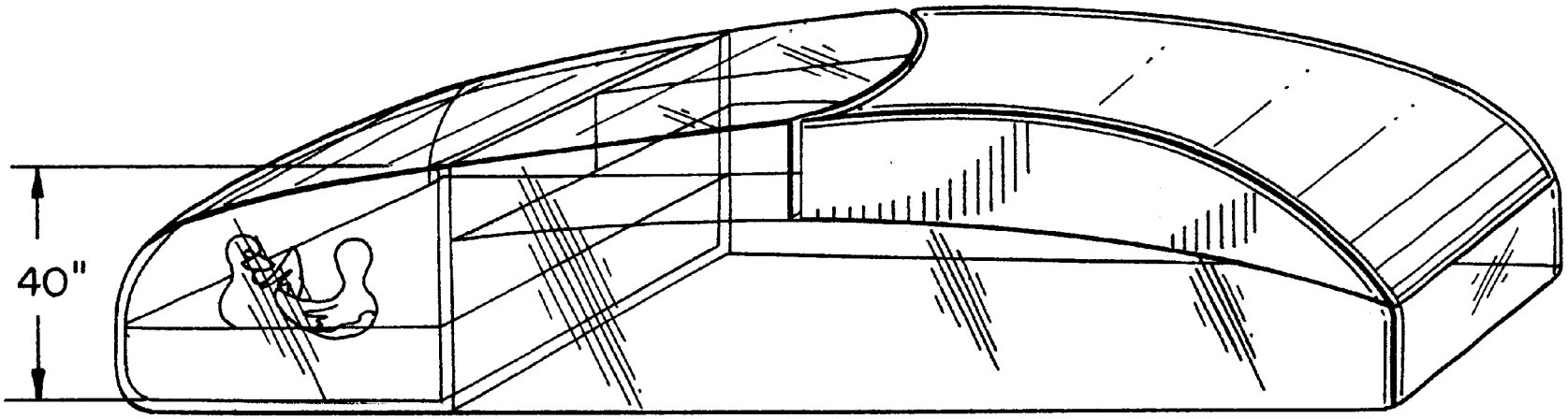
Figure 38C:
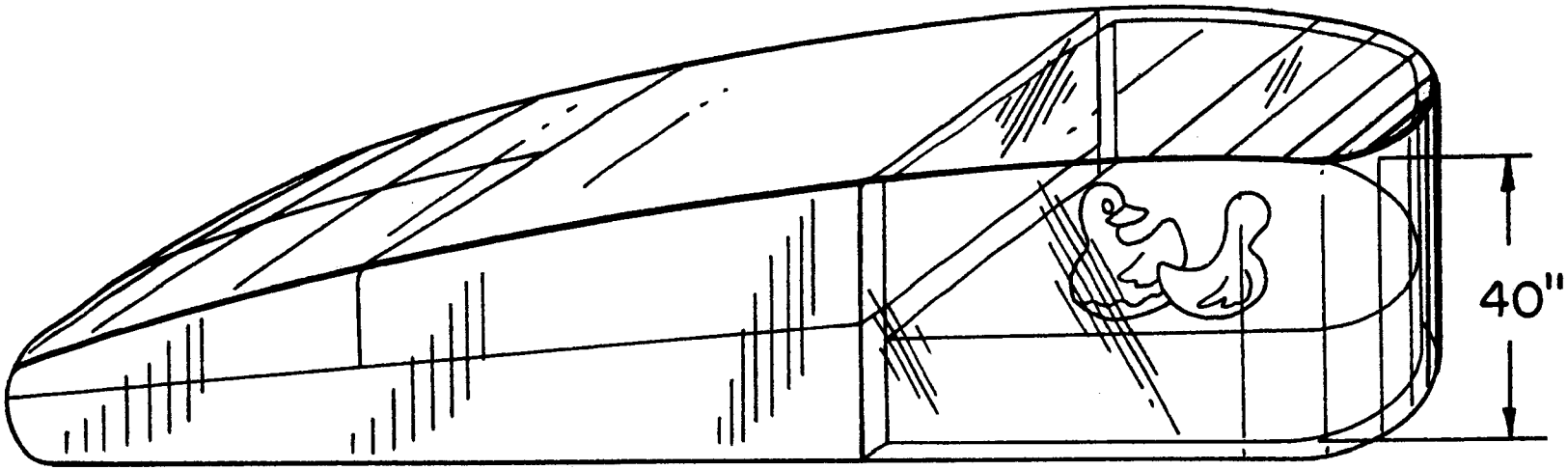
Figure 38D:
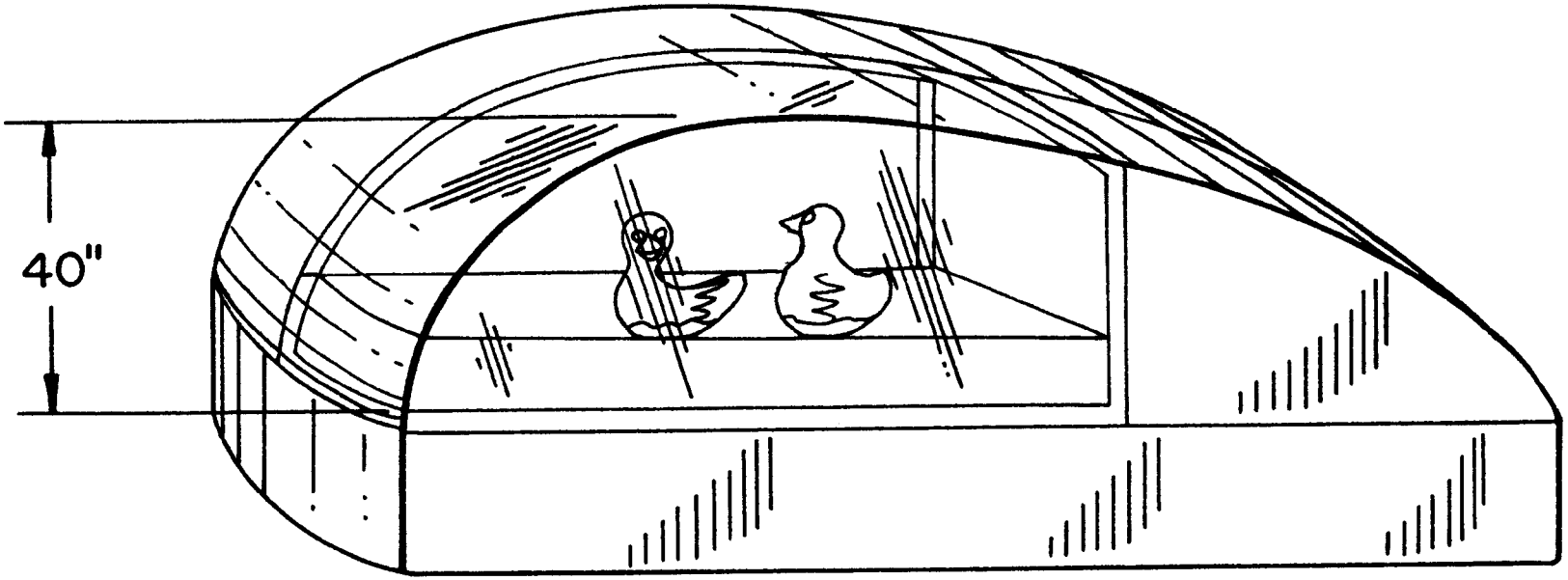
Figure 38E:
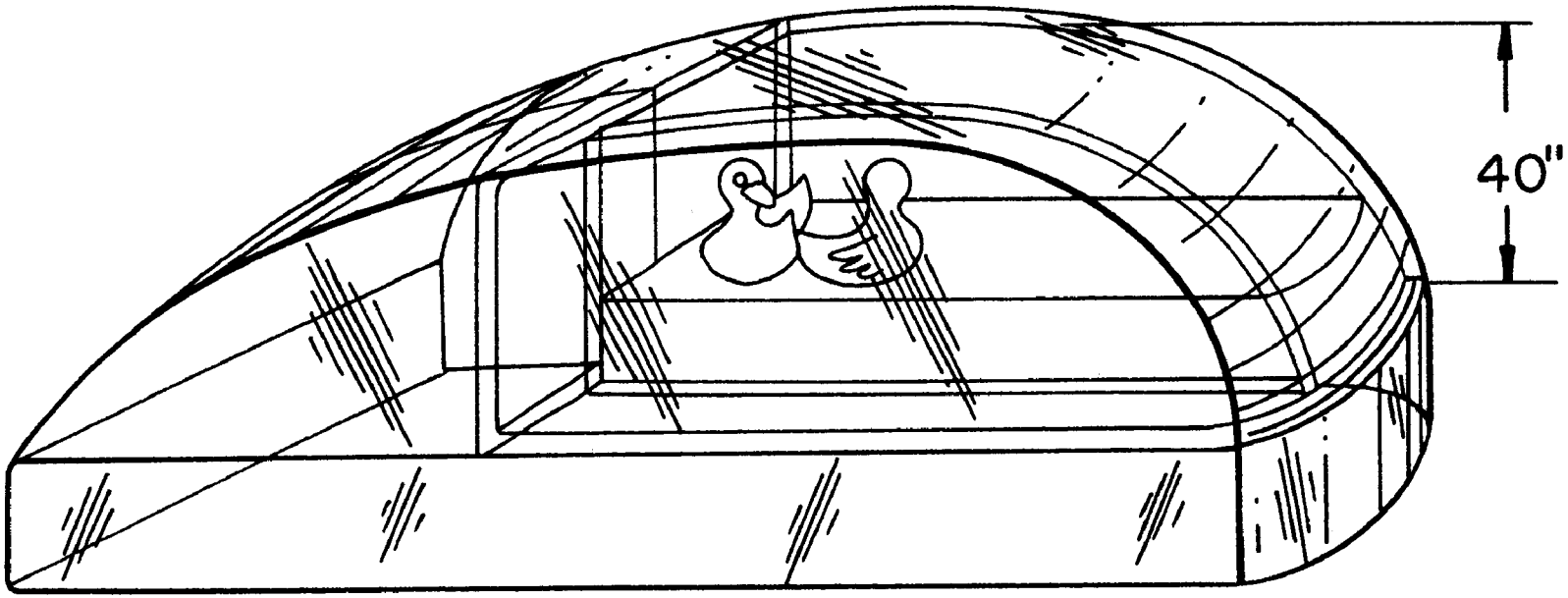
Figure 38F:
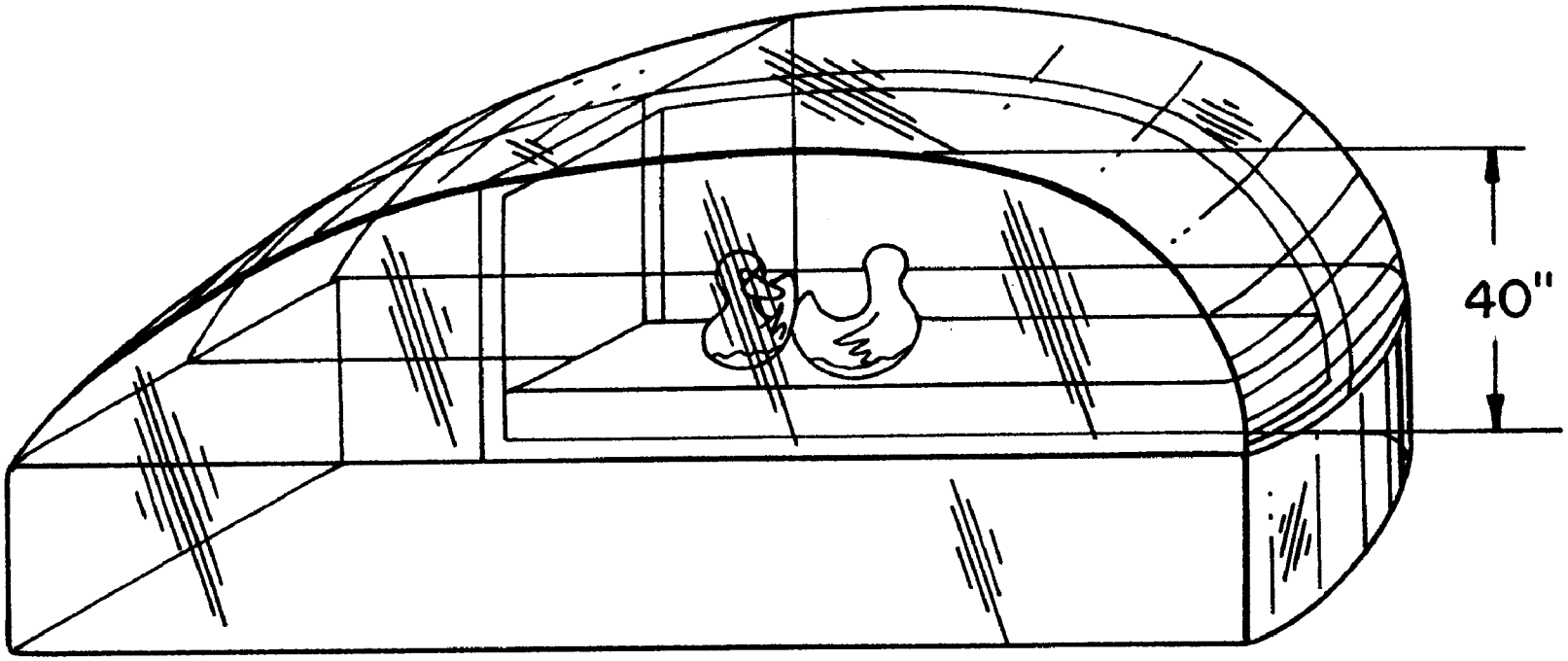
Figure 39A:
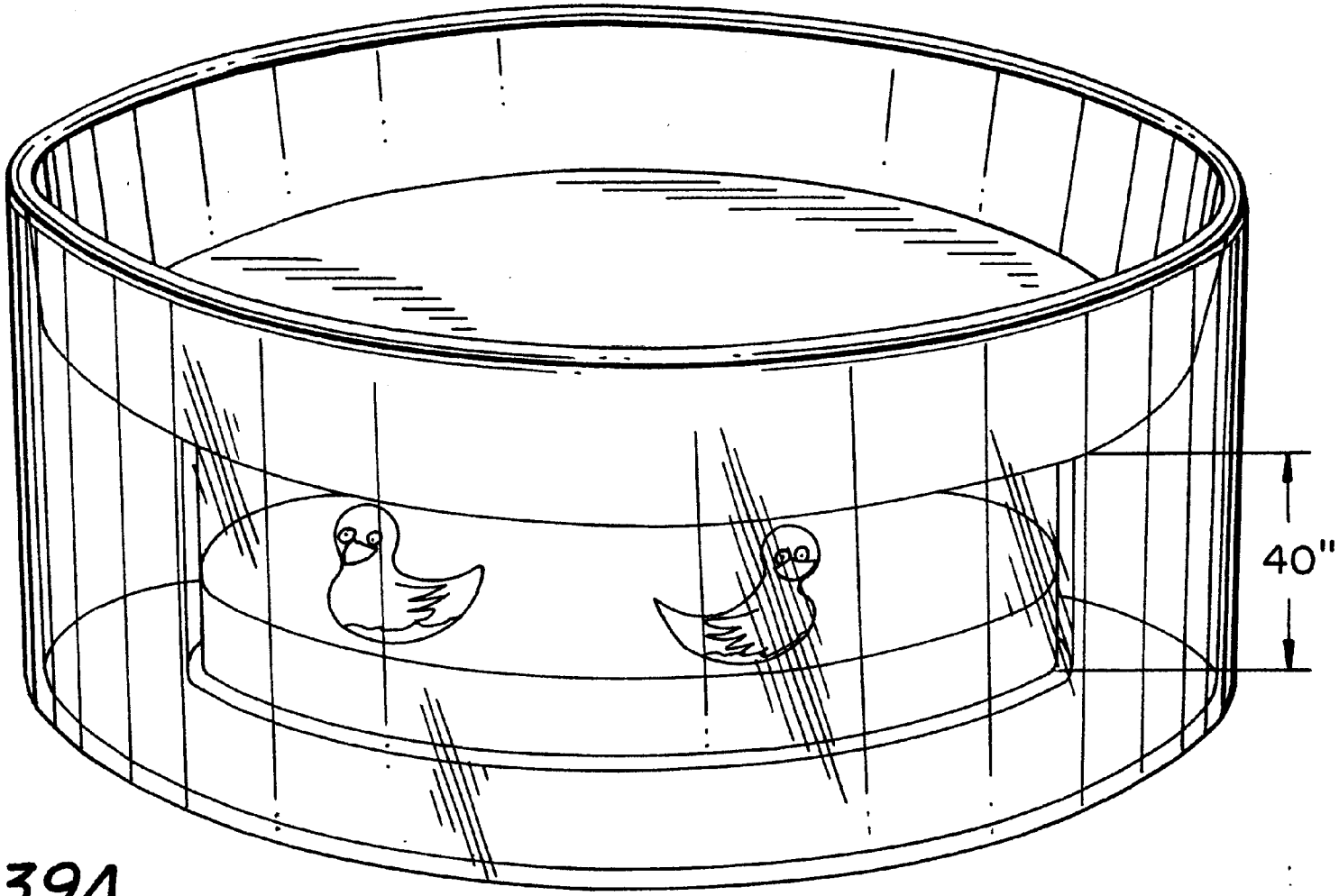
FIGS. 39A to 39H shows a series of variations of soap dishes in accordance with the present invention.
Figure 39B:
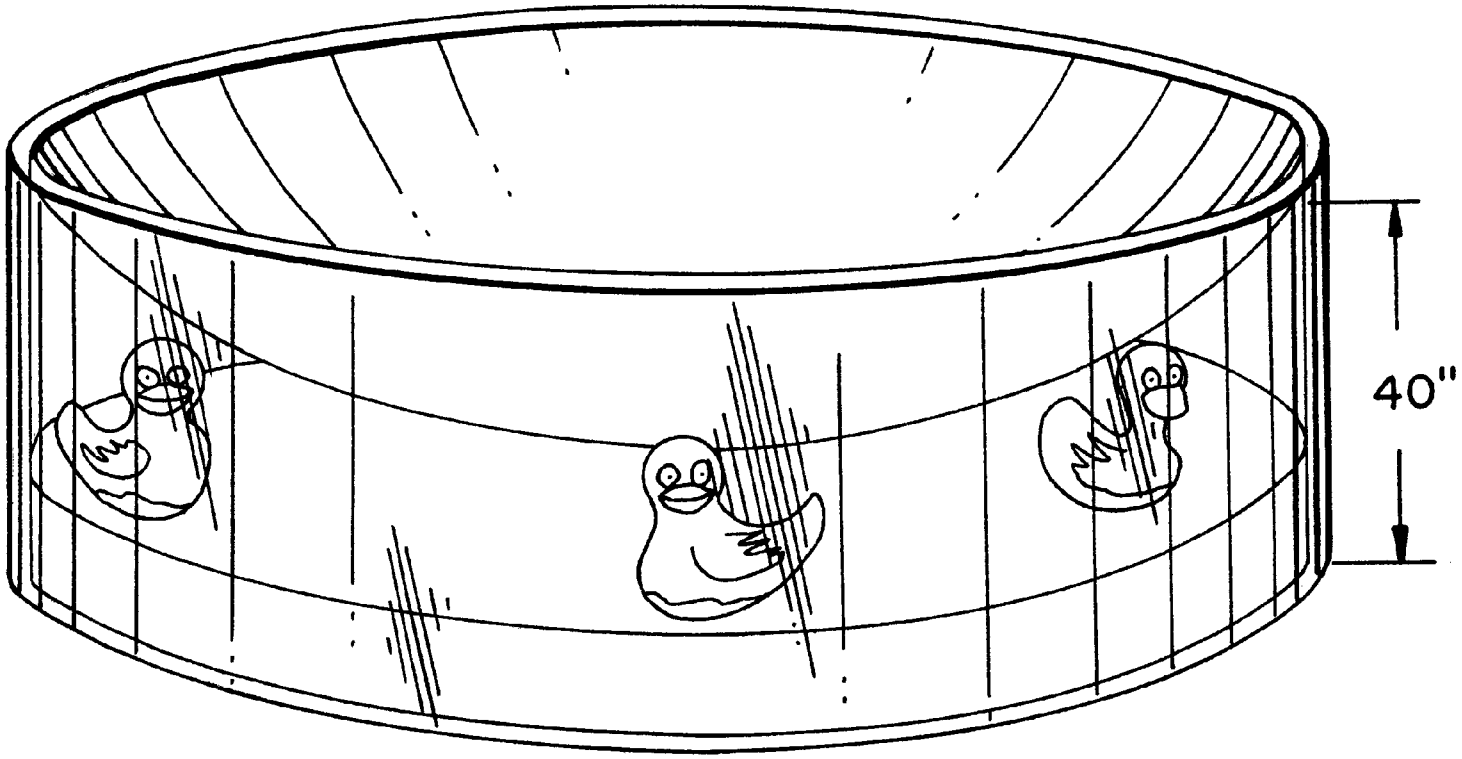
Figure 39C:
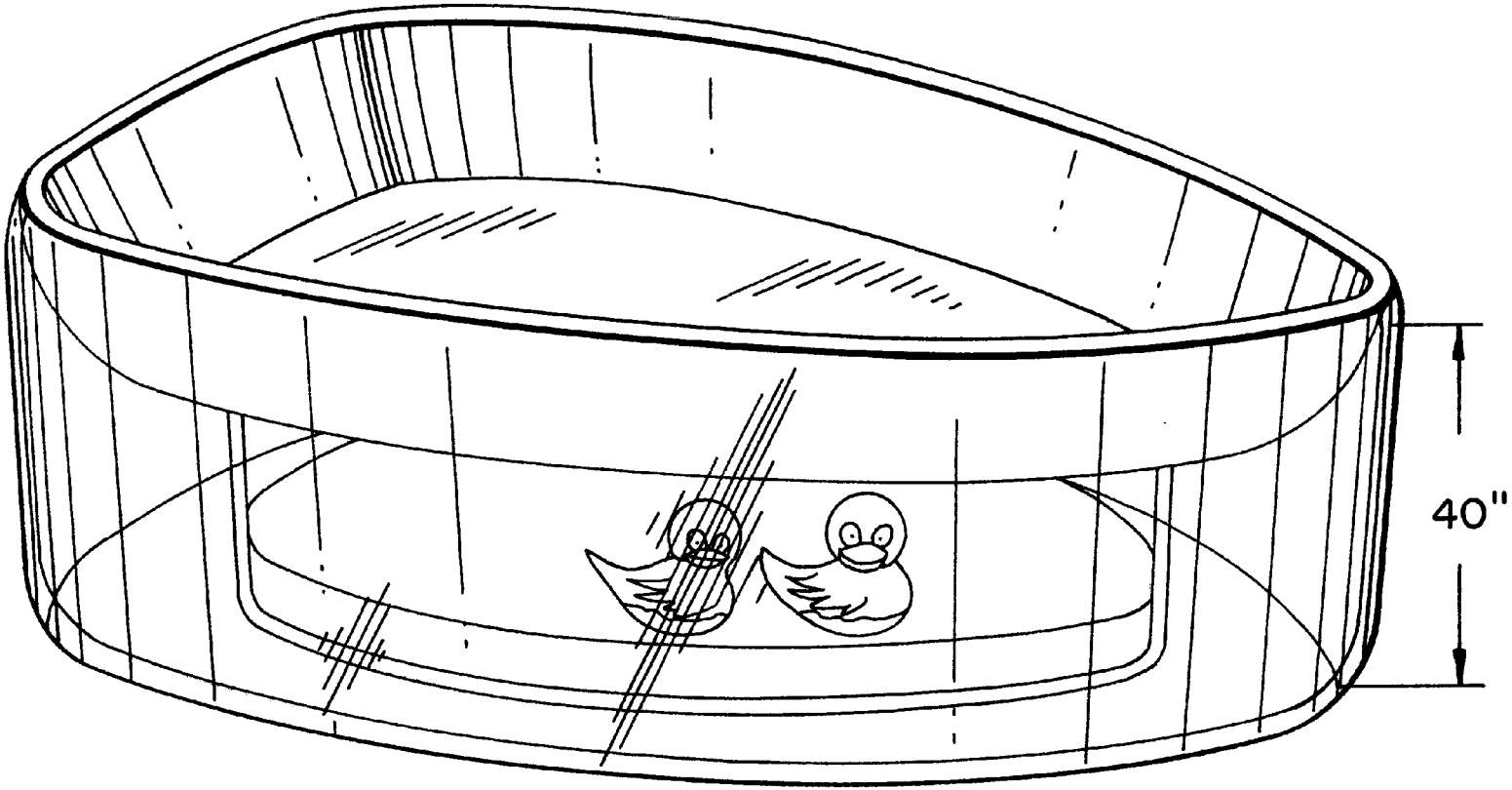
Figure 39D:
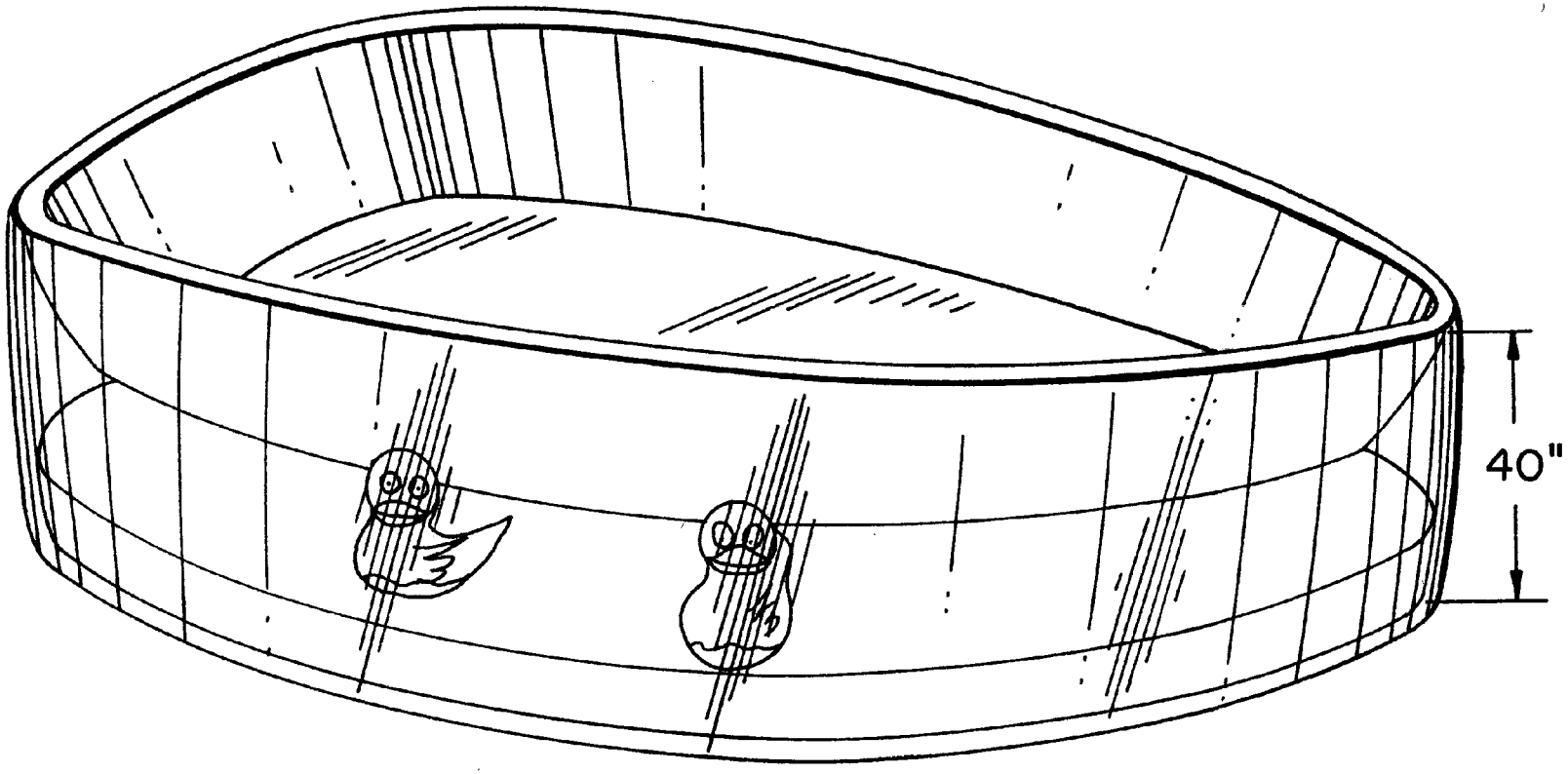
Figure 39E:
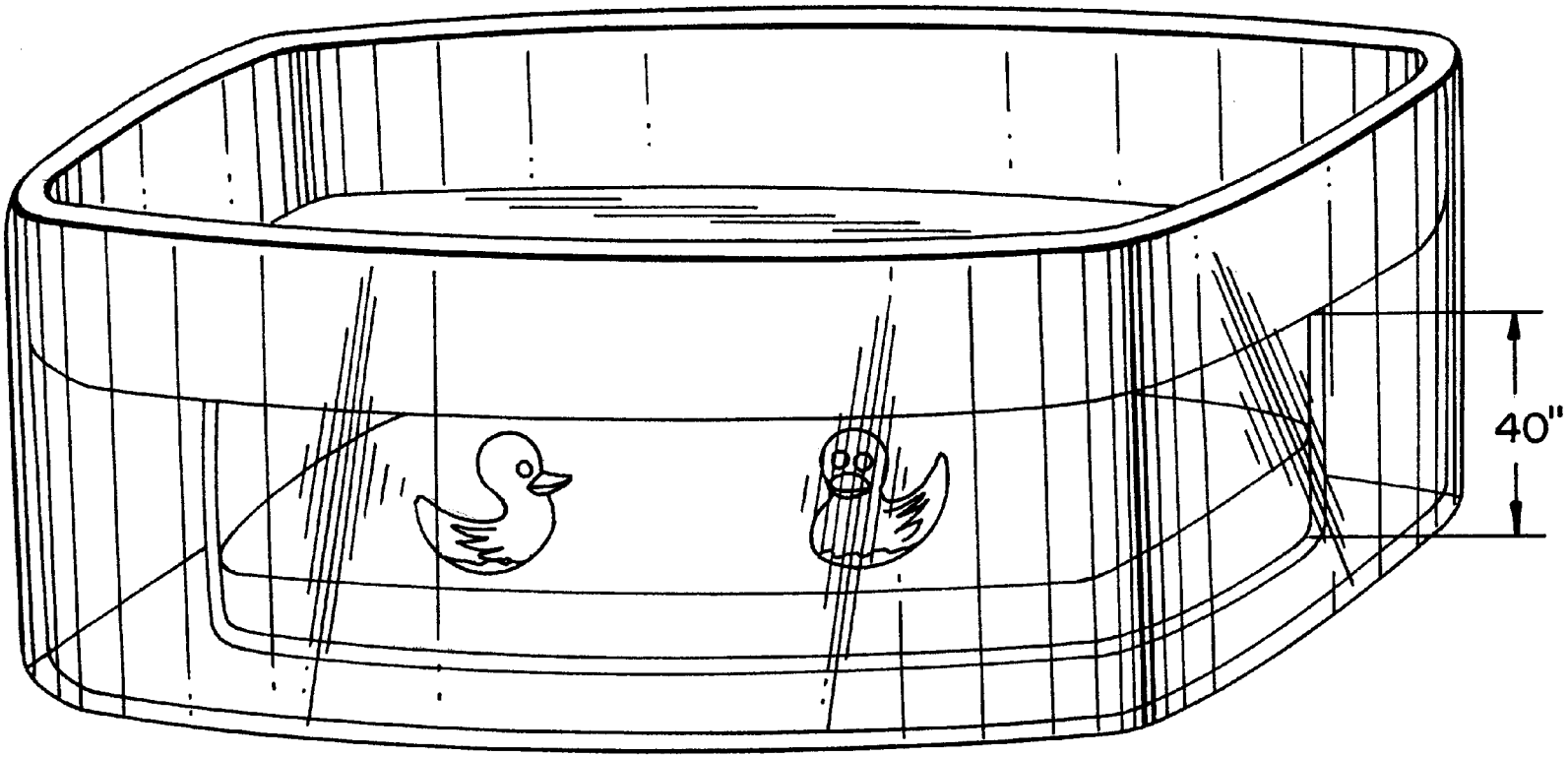
Figure 39F:
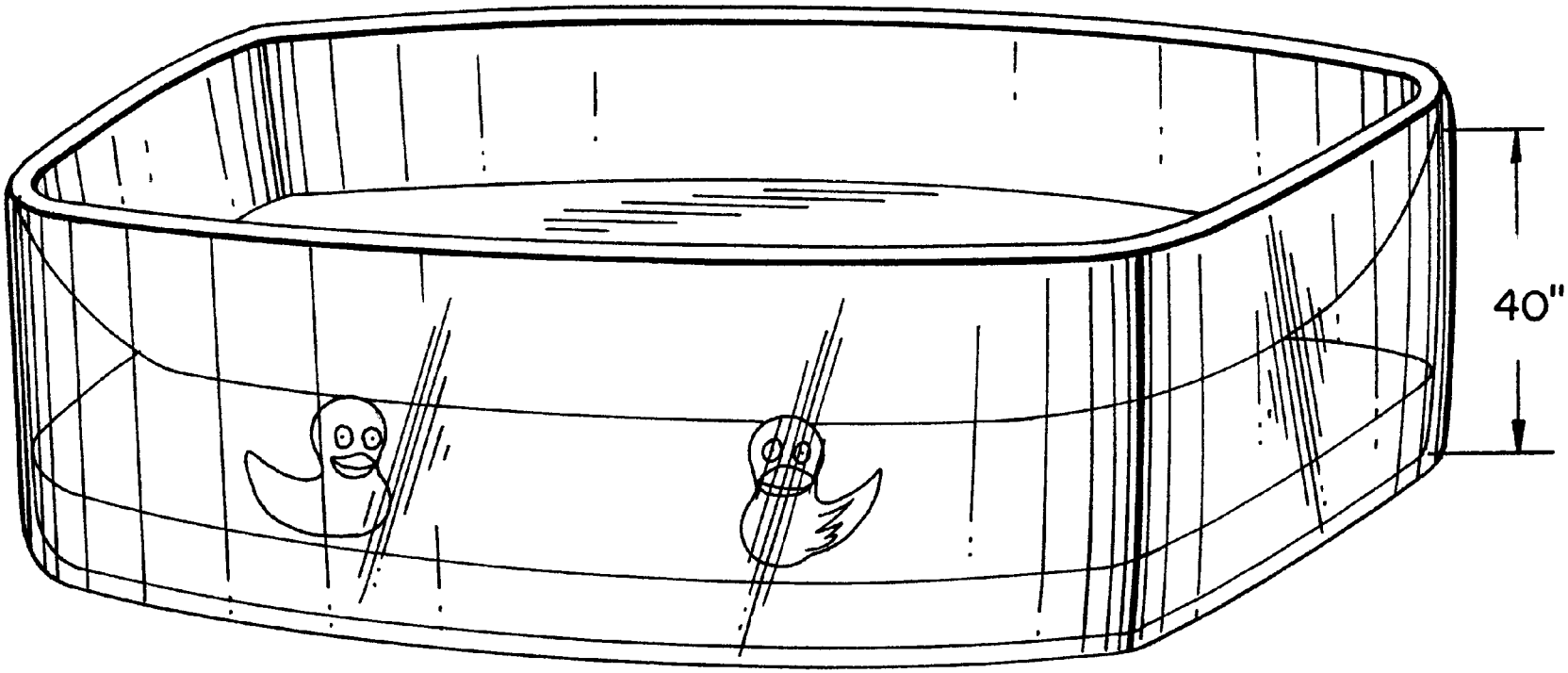
Figure 39G:
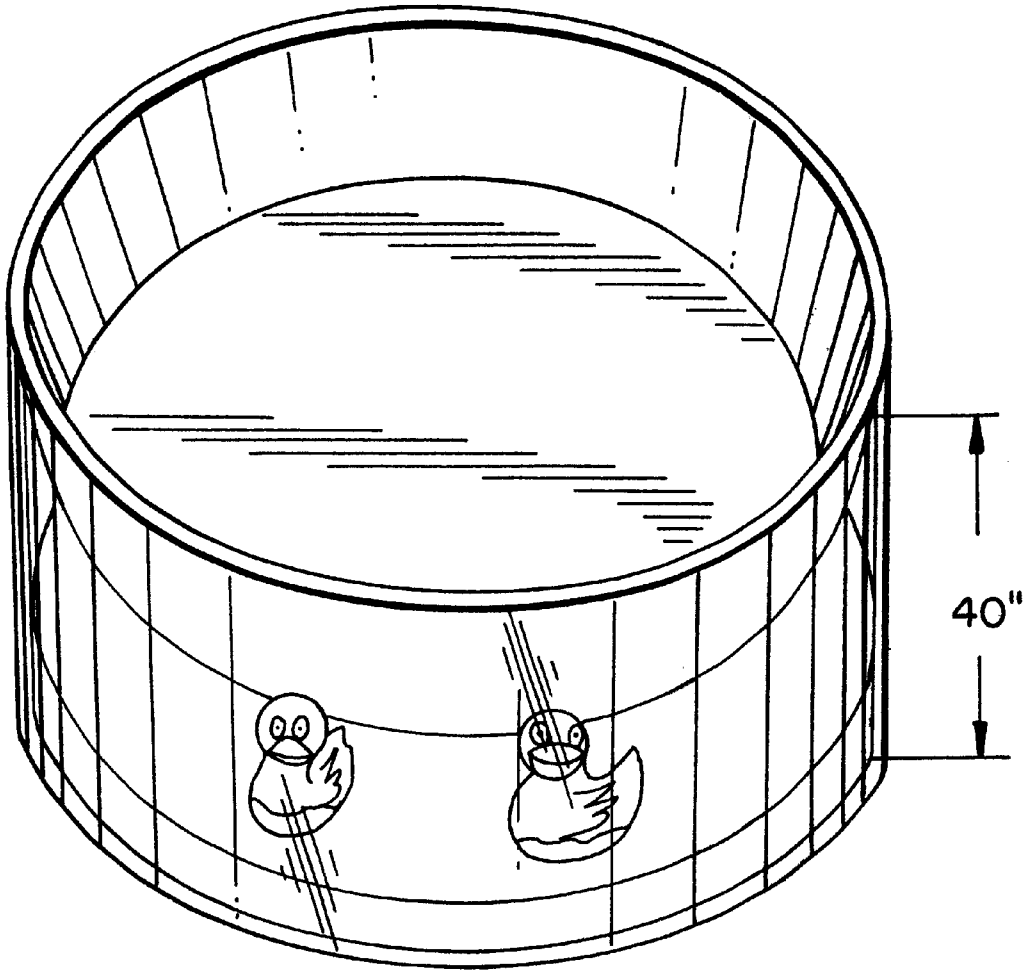
Figure 39H:
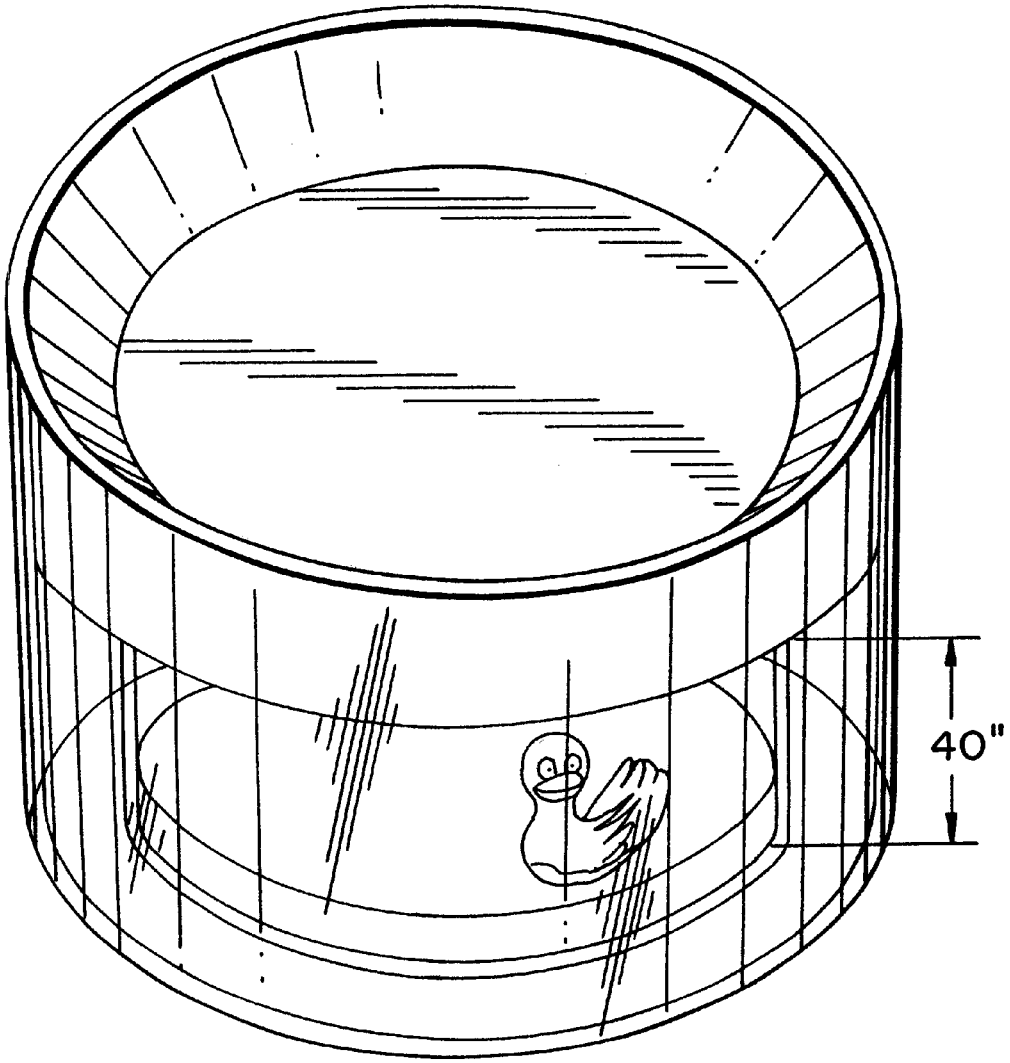
Figure 40A:
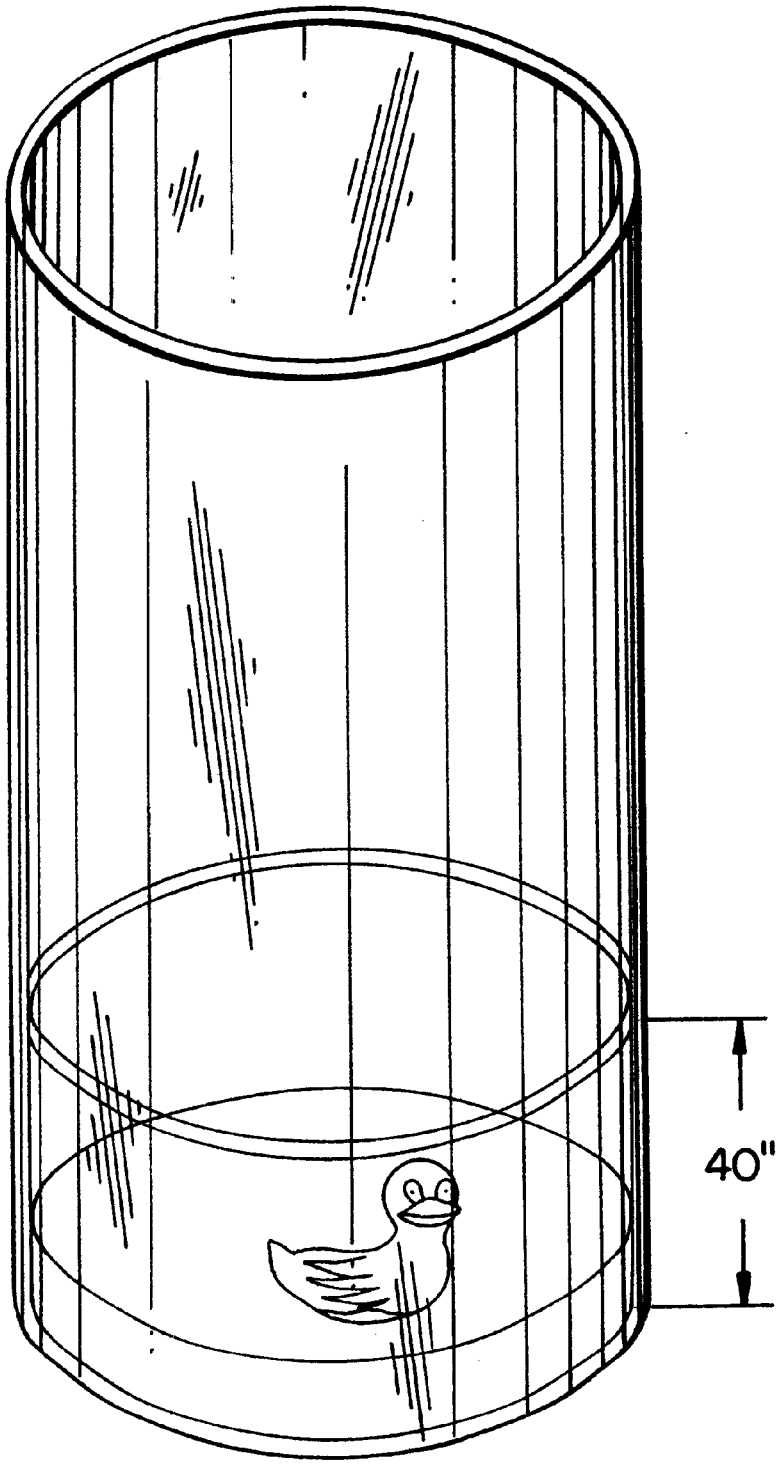
FIGS. 40A to 40C show a series of variations of tumblers in accordance with the present invention.
Figure 40B:
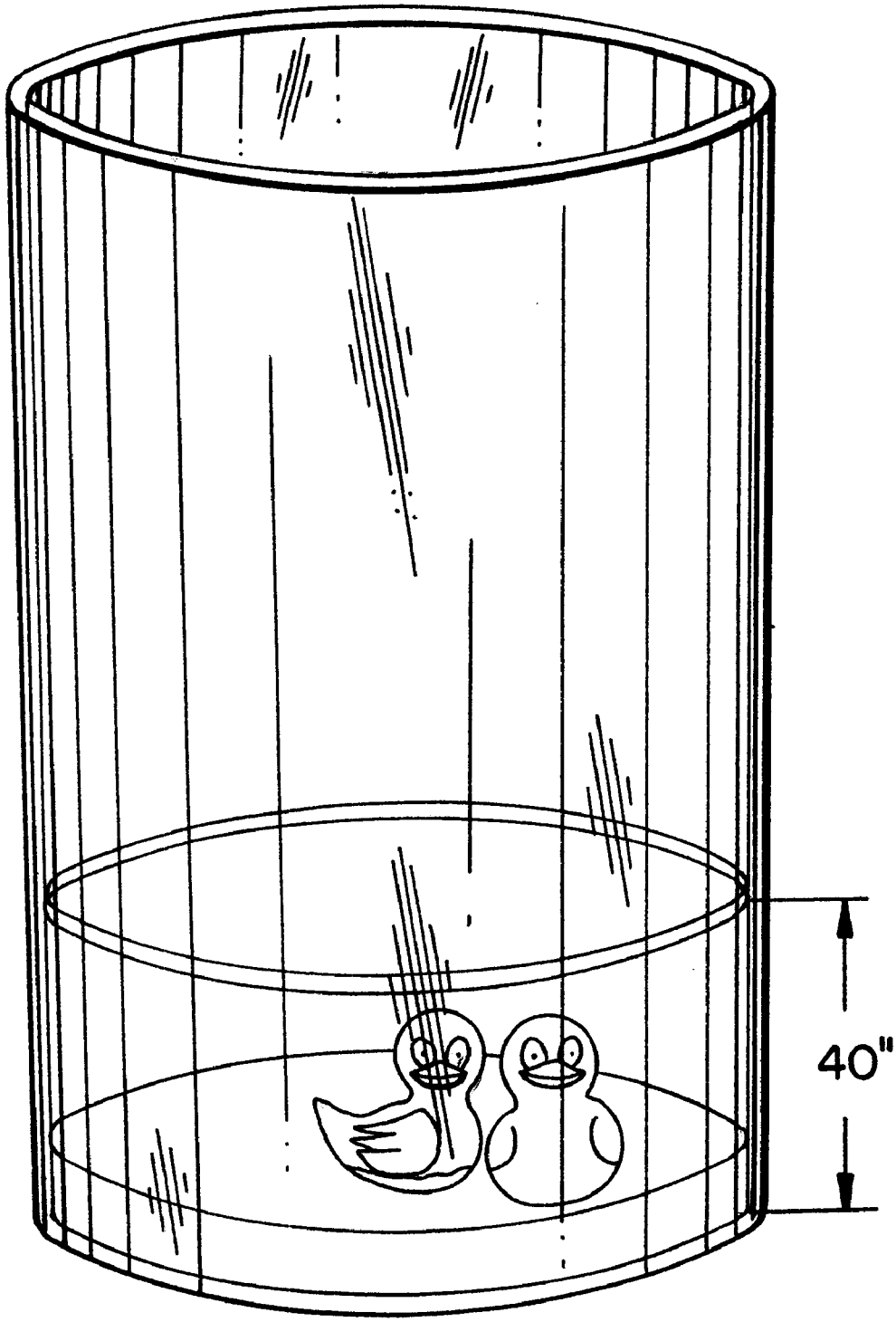
Figure 40C:
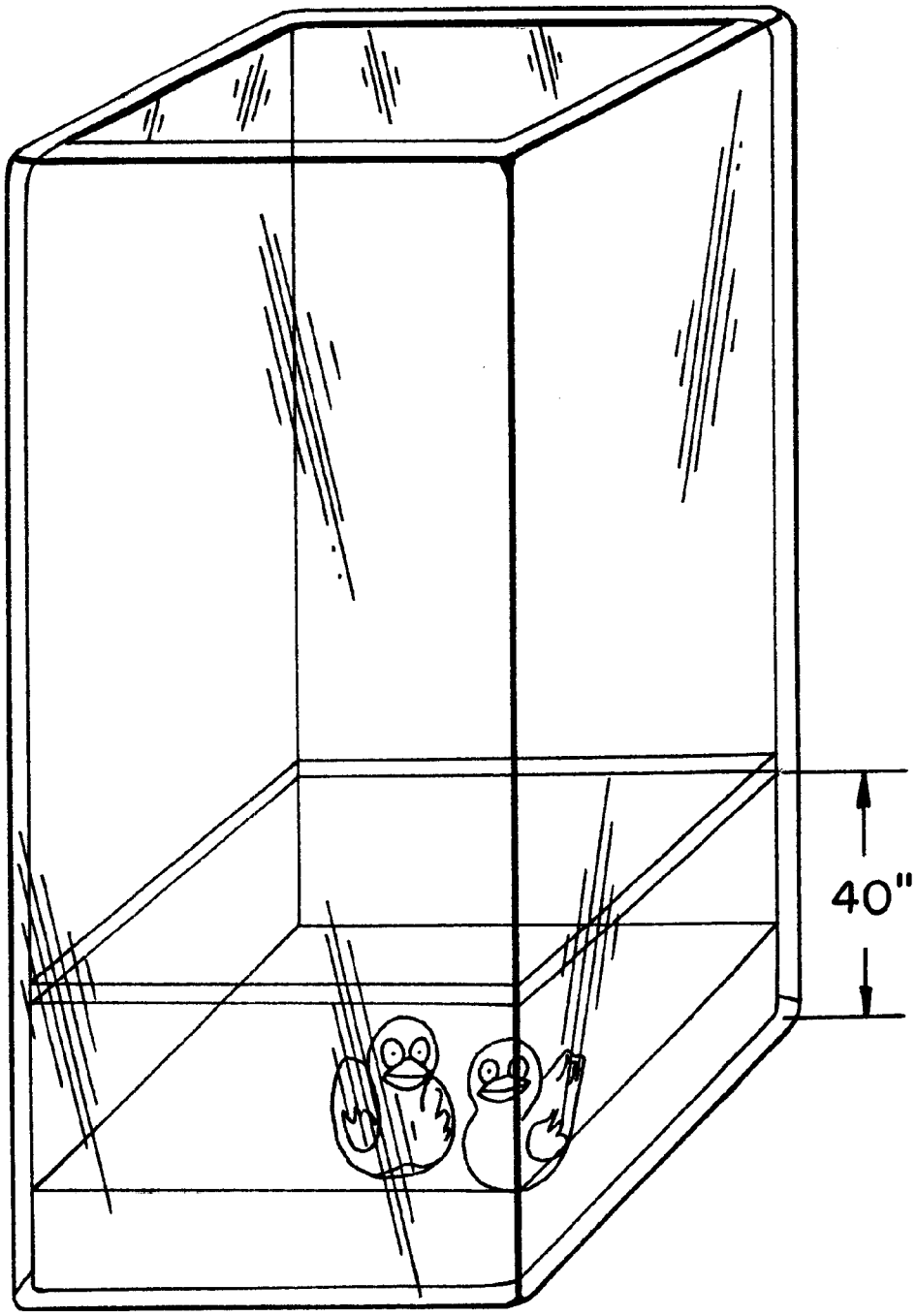
Figure 41A:
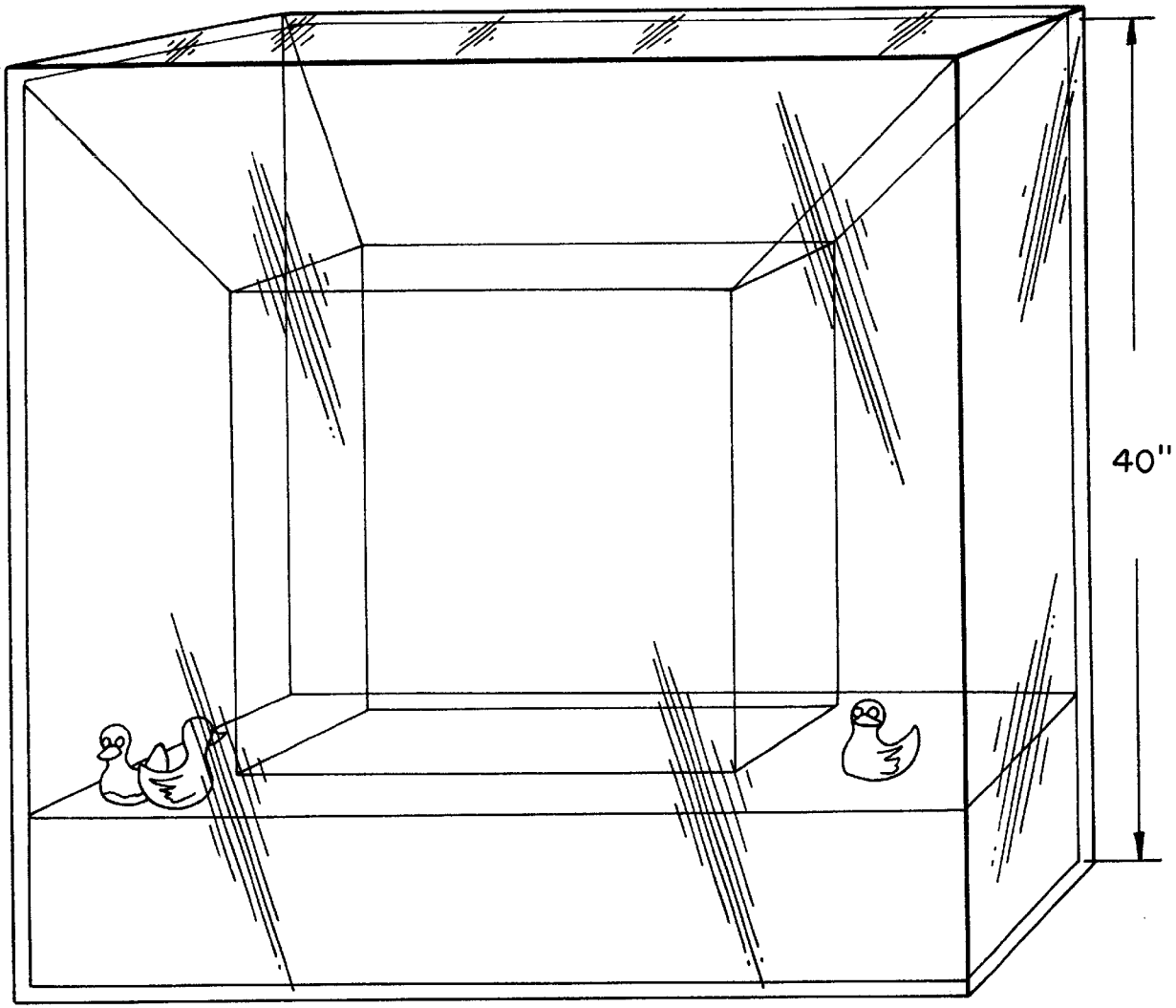
FIGS. 41A and 41B show two embodiments of a mirror in accordance with the present invention.
Figure 41B:
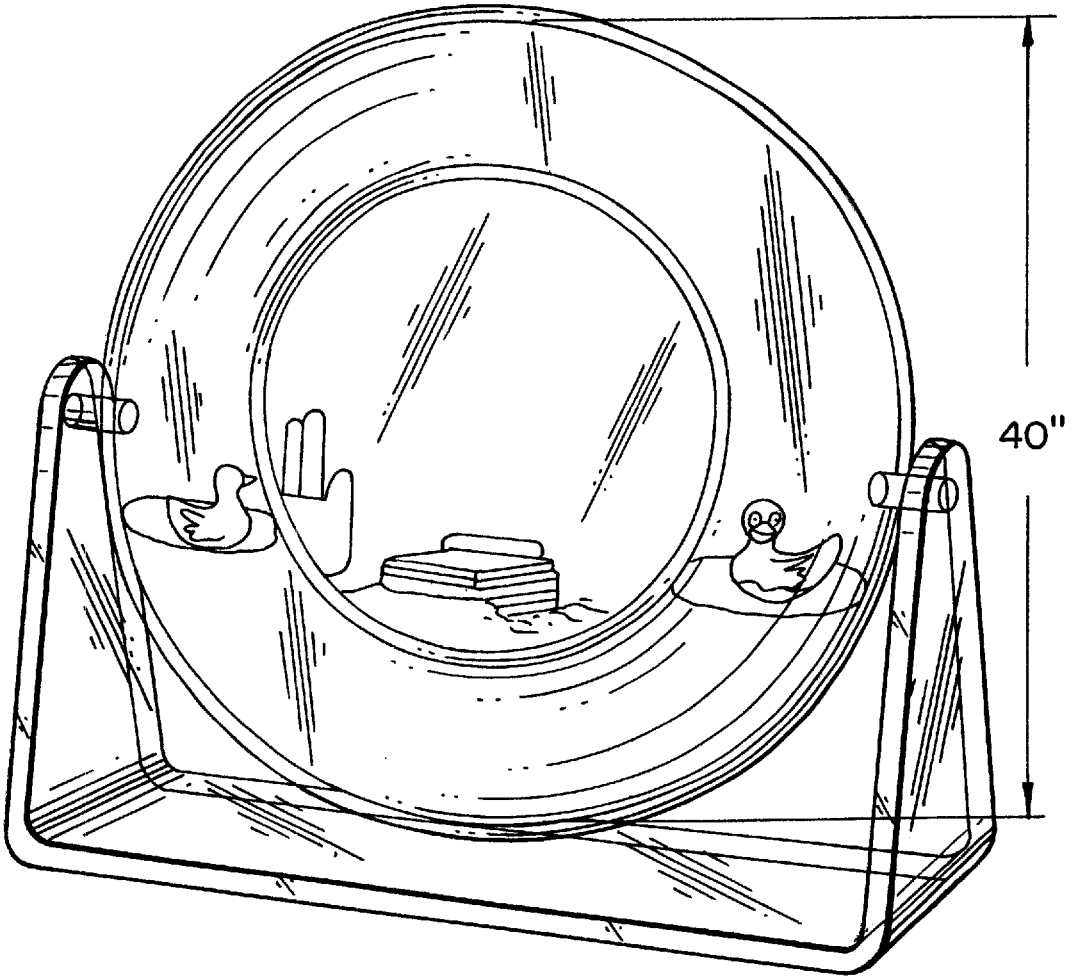
Figure 42A:
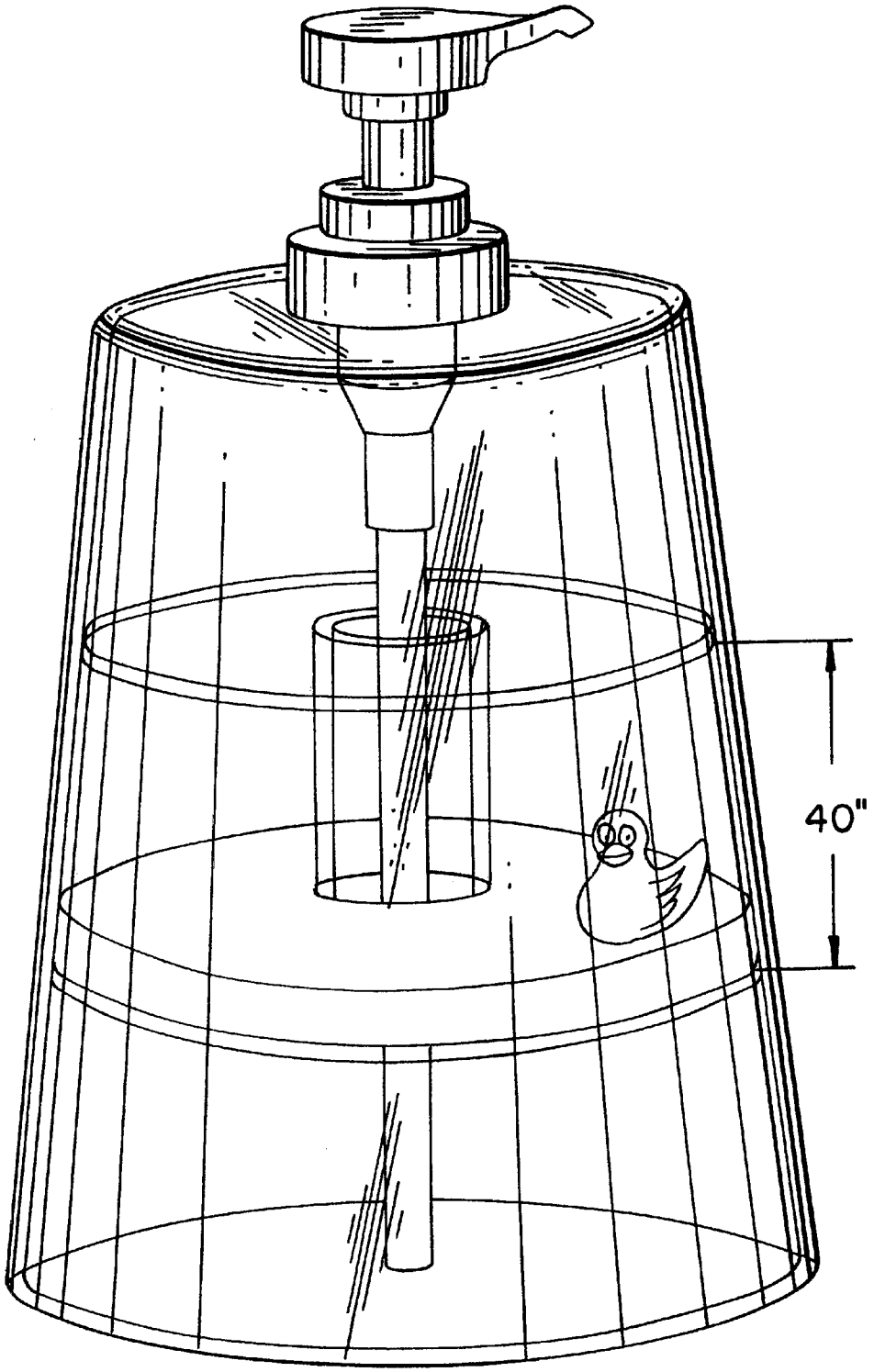
FIGS. 42A to 42L show a series of lotion bottles in accordance with the present invention
Figure 42B:
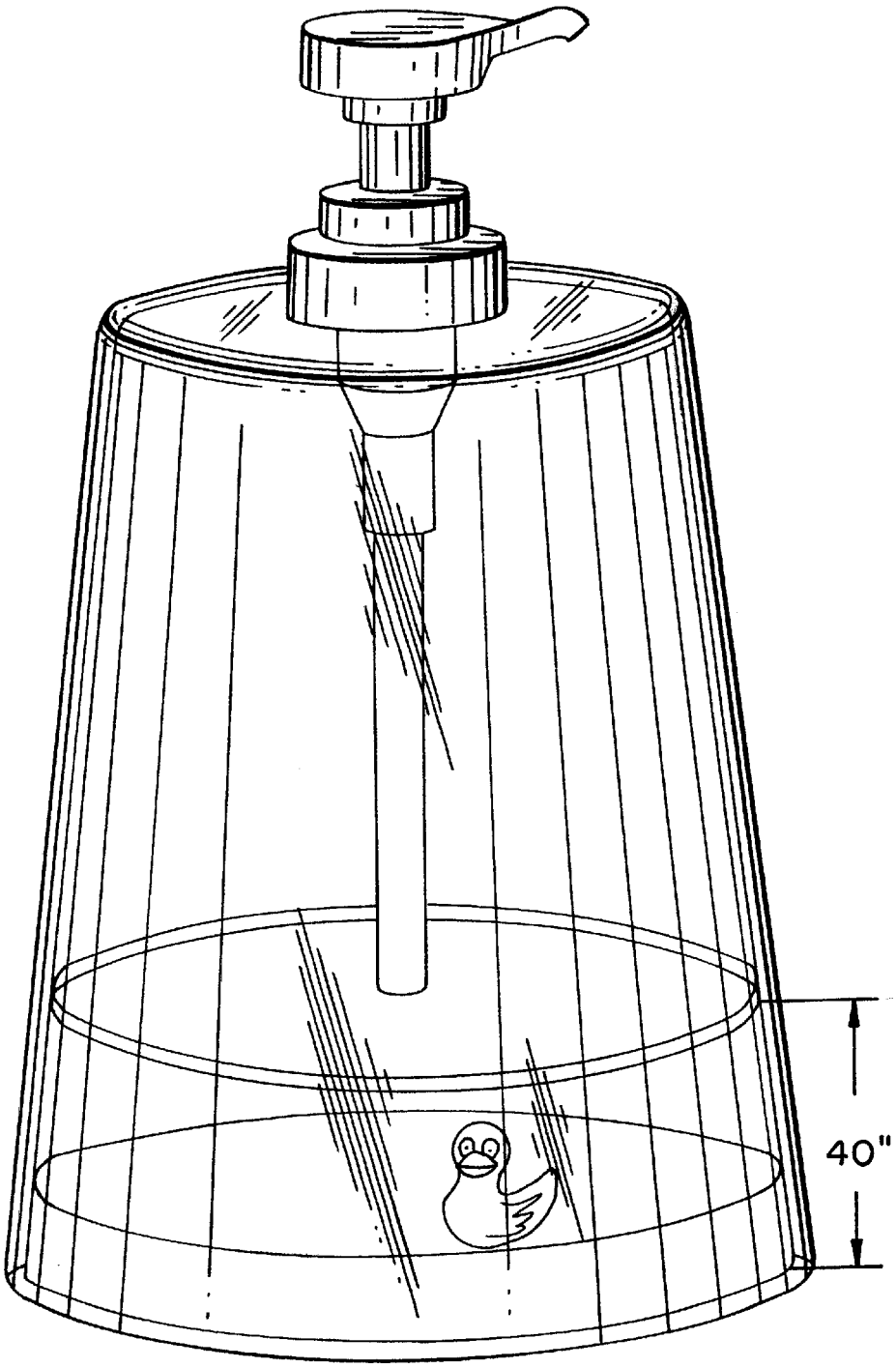
Figure 42C:
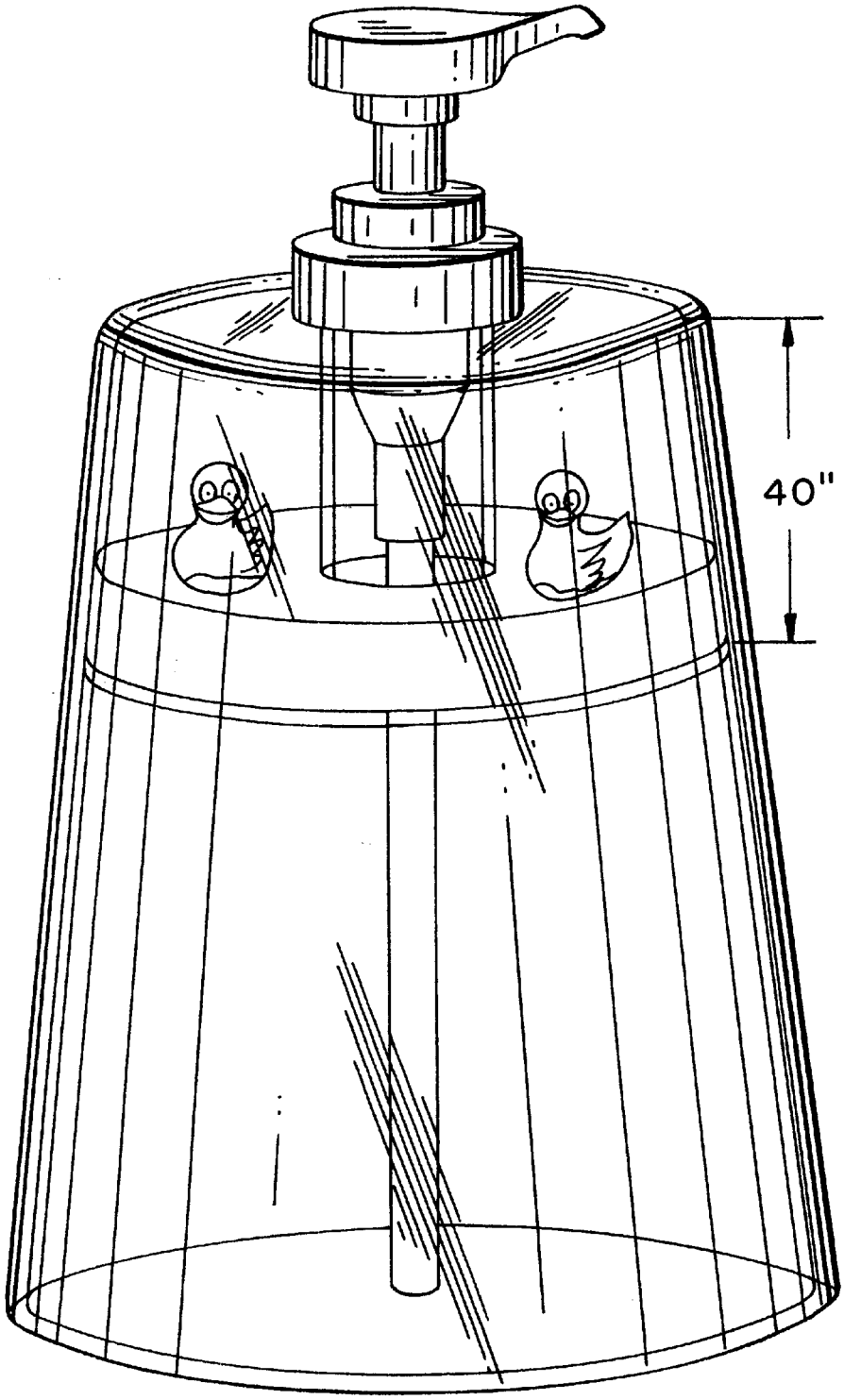
Figure 42D:
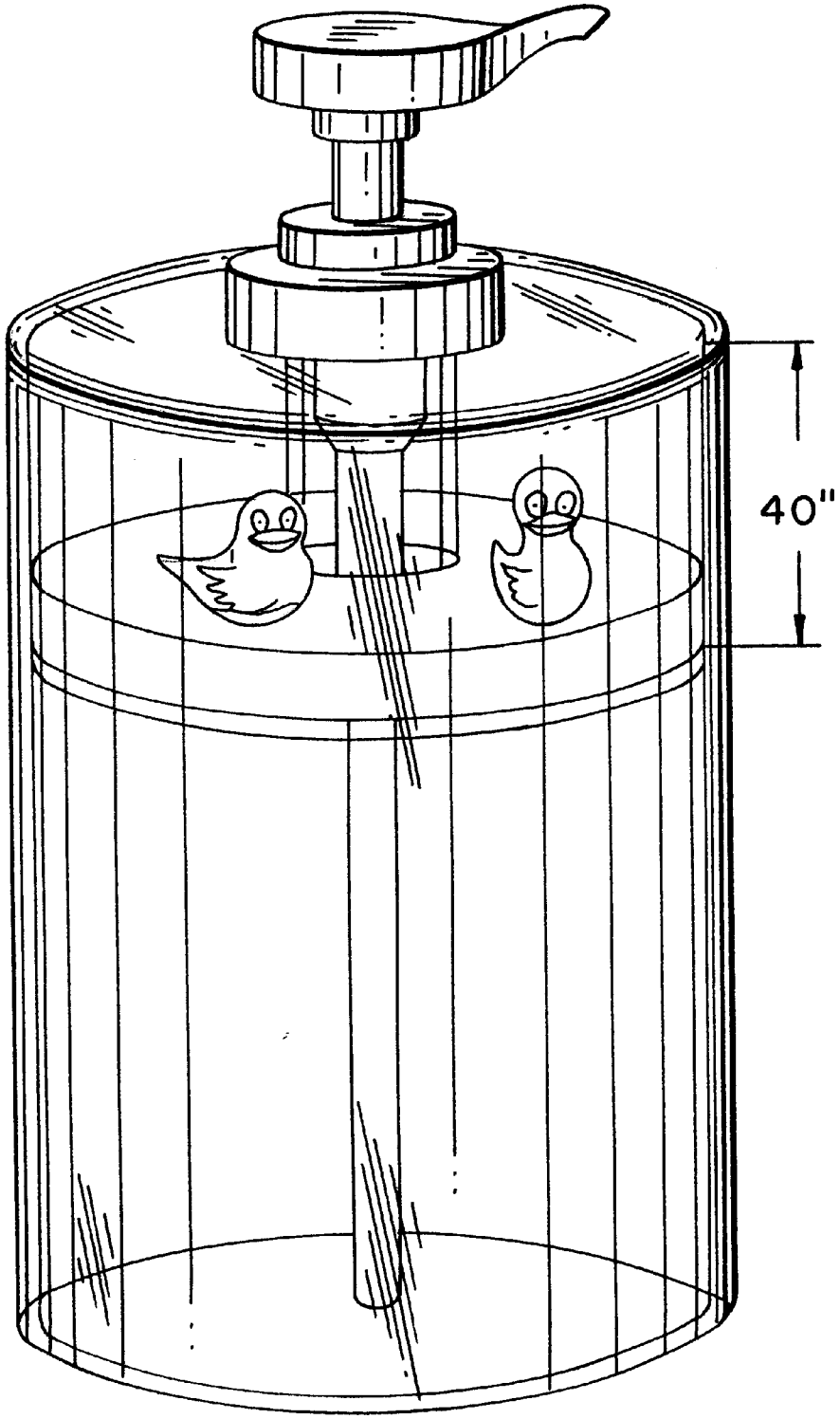
Figure 42E:
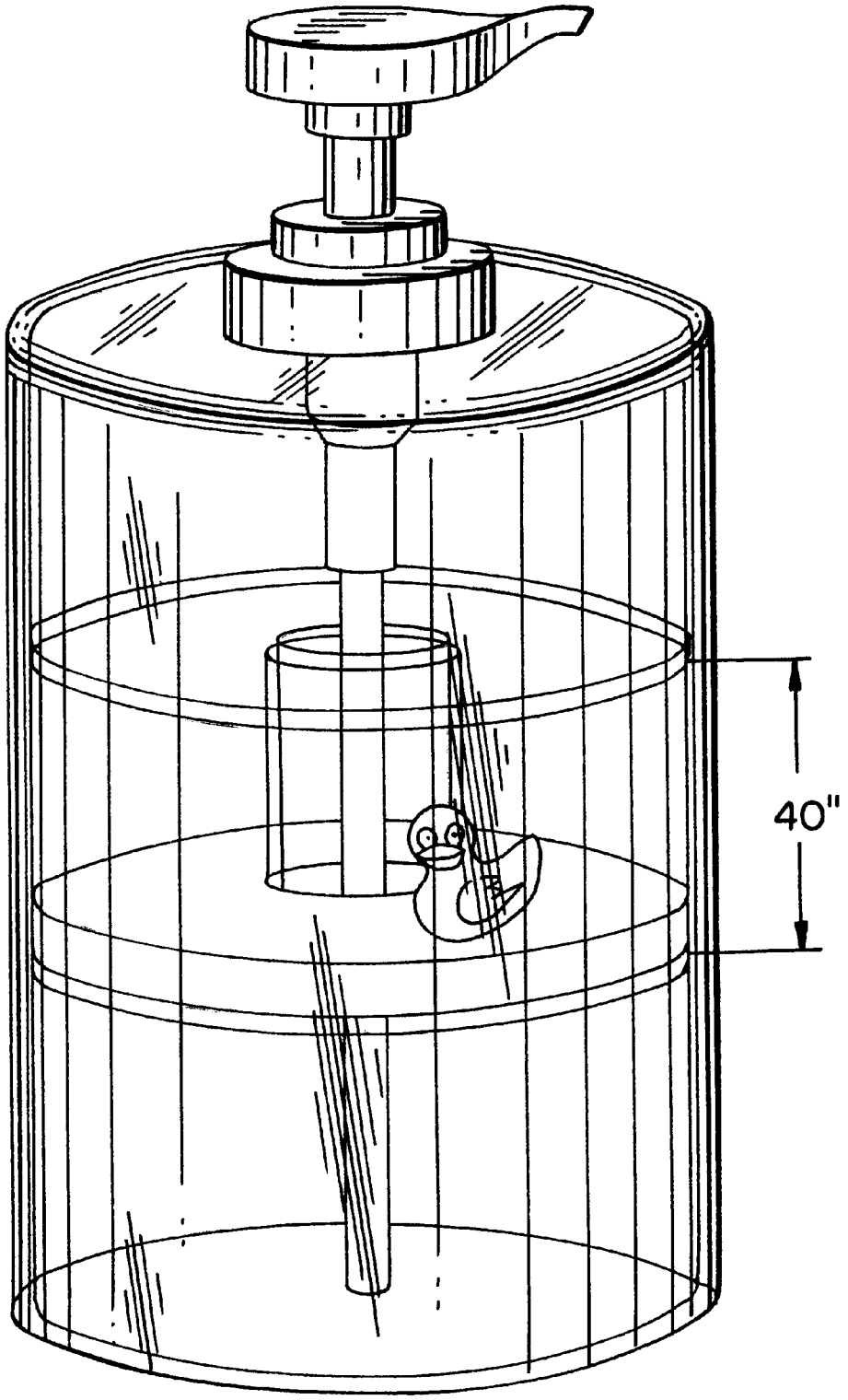
Figure 42F:
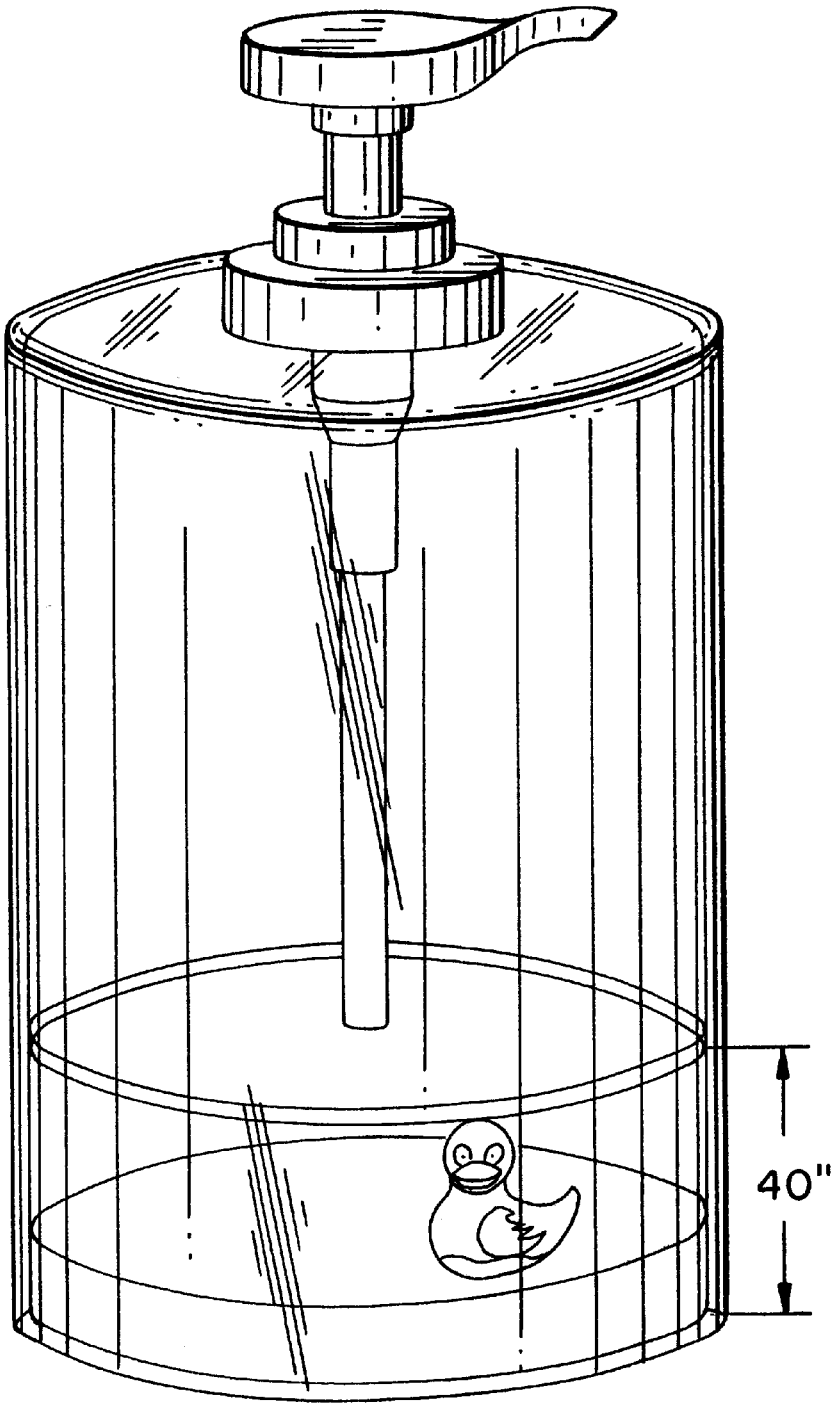
Figure 42G:
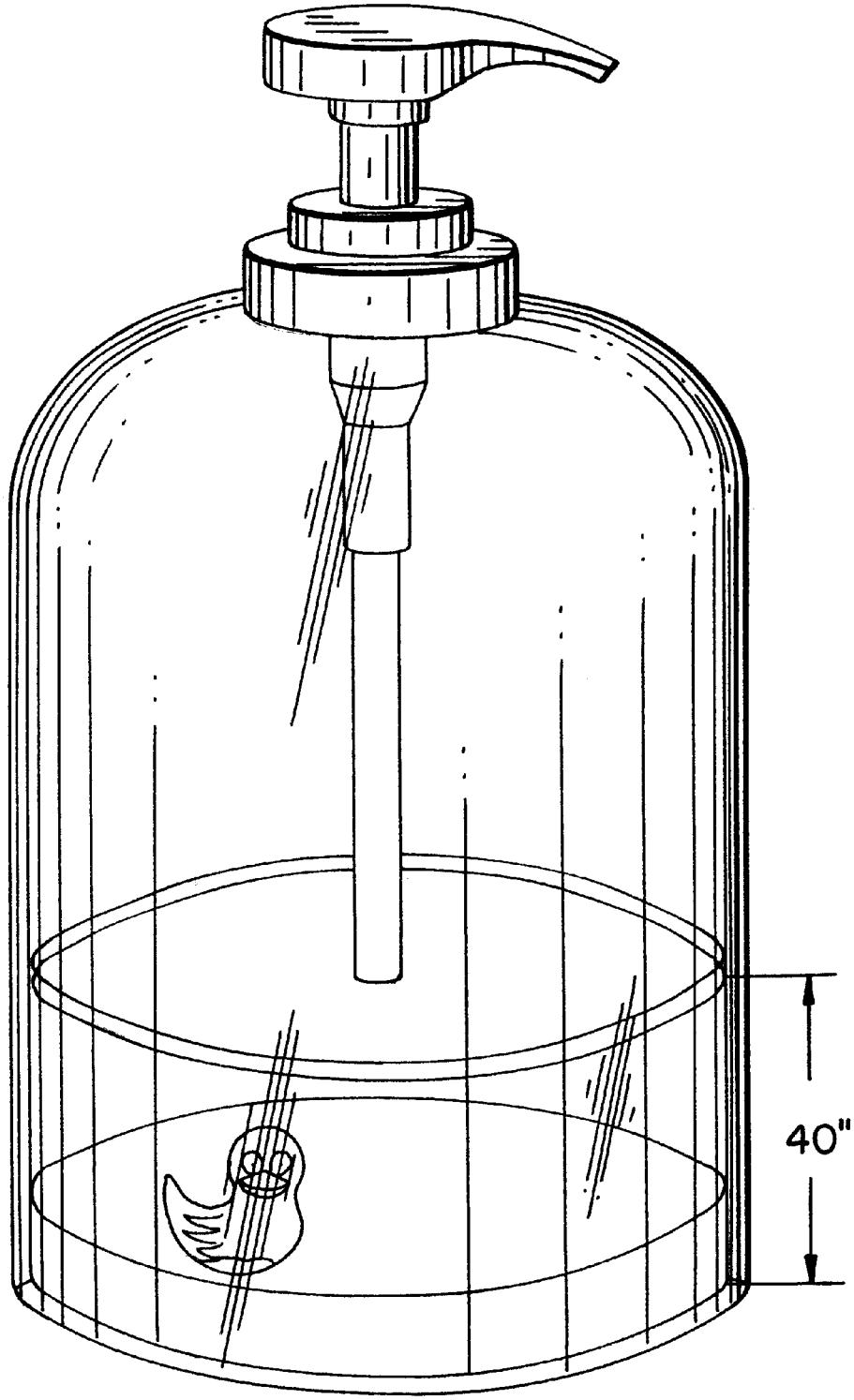
Figure 42H:
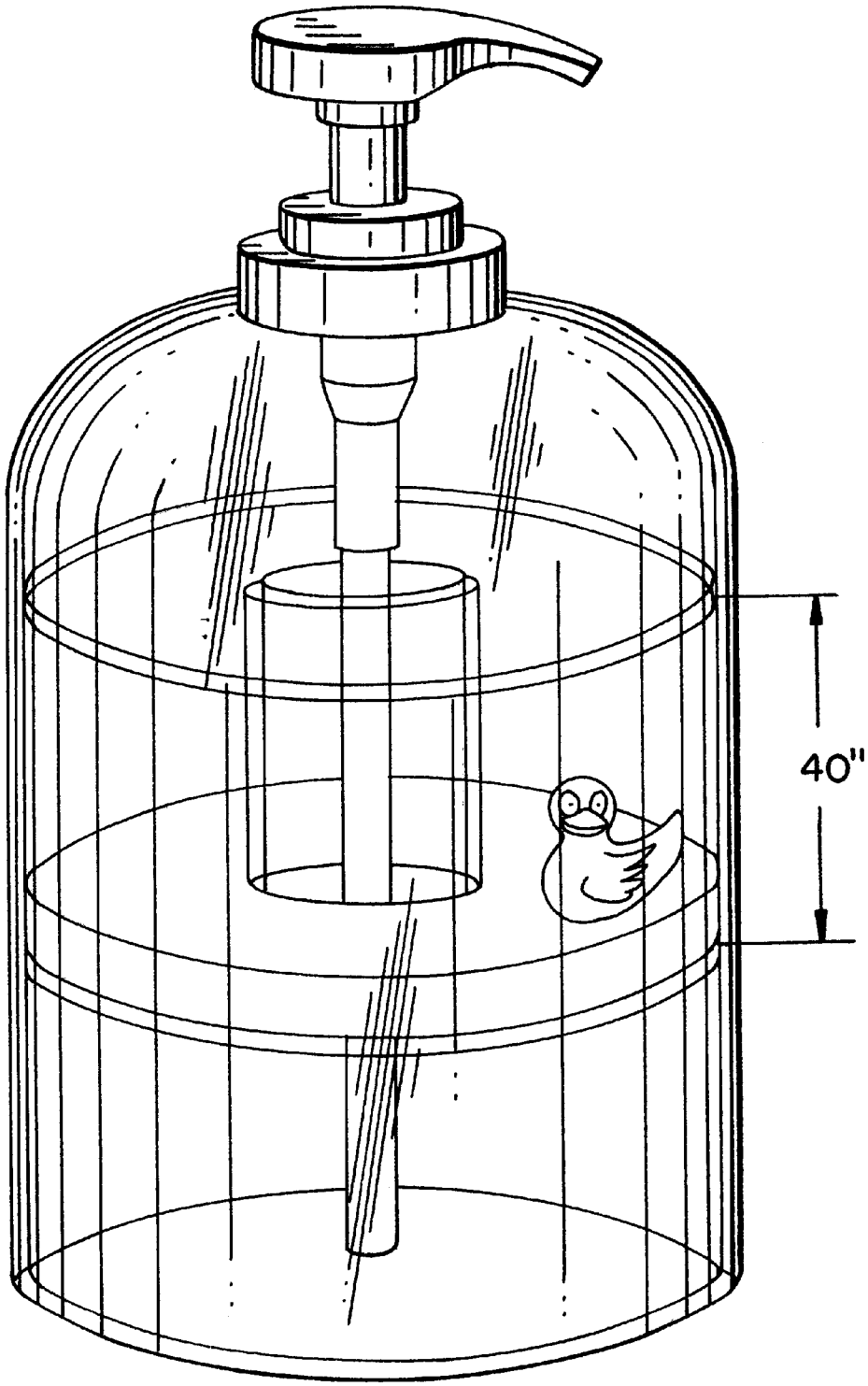
Figure 42I:
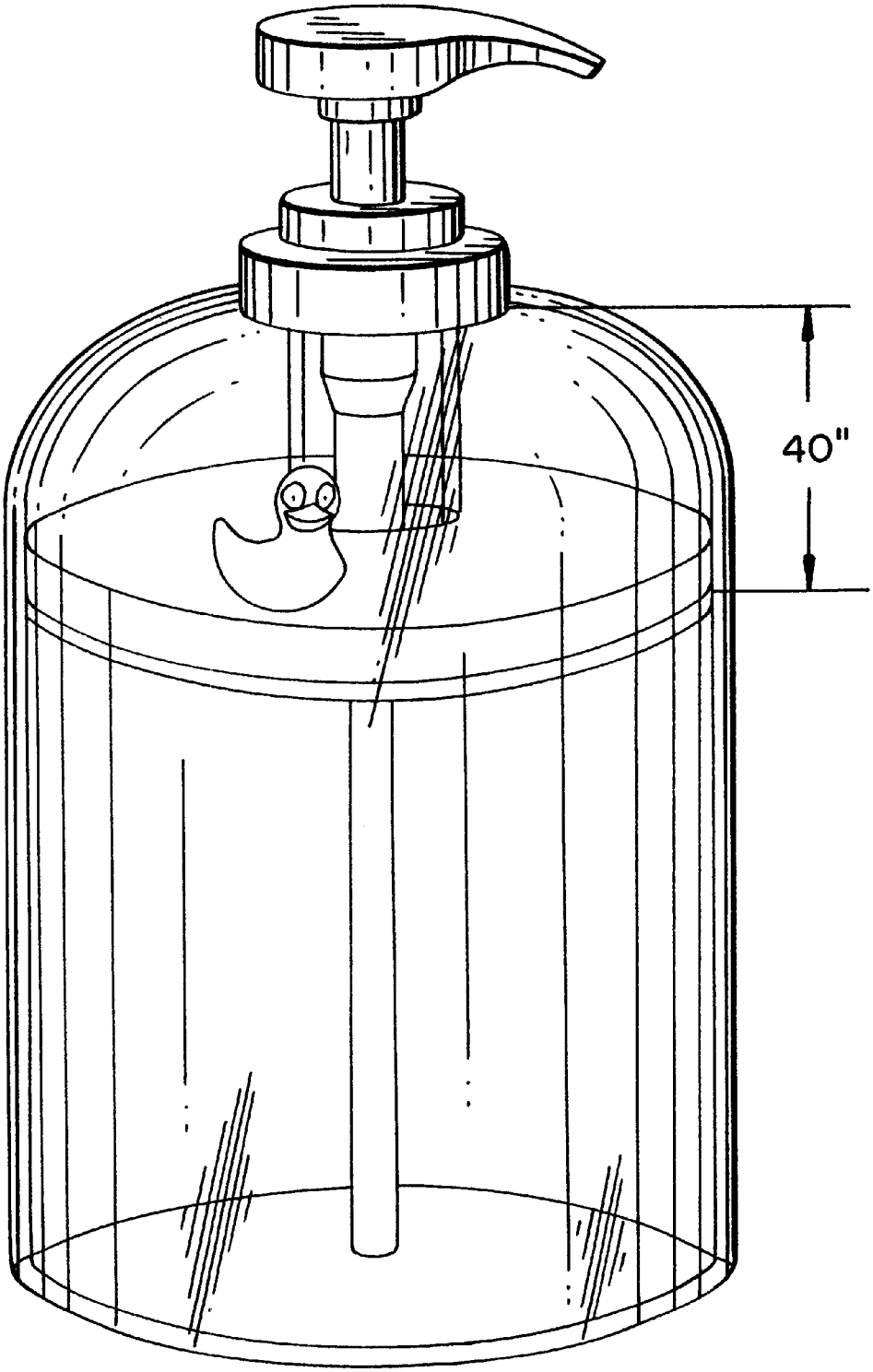
Figure 42J:
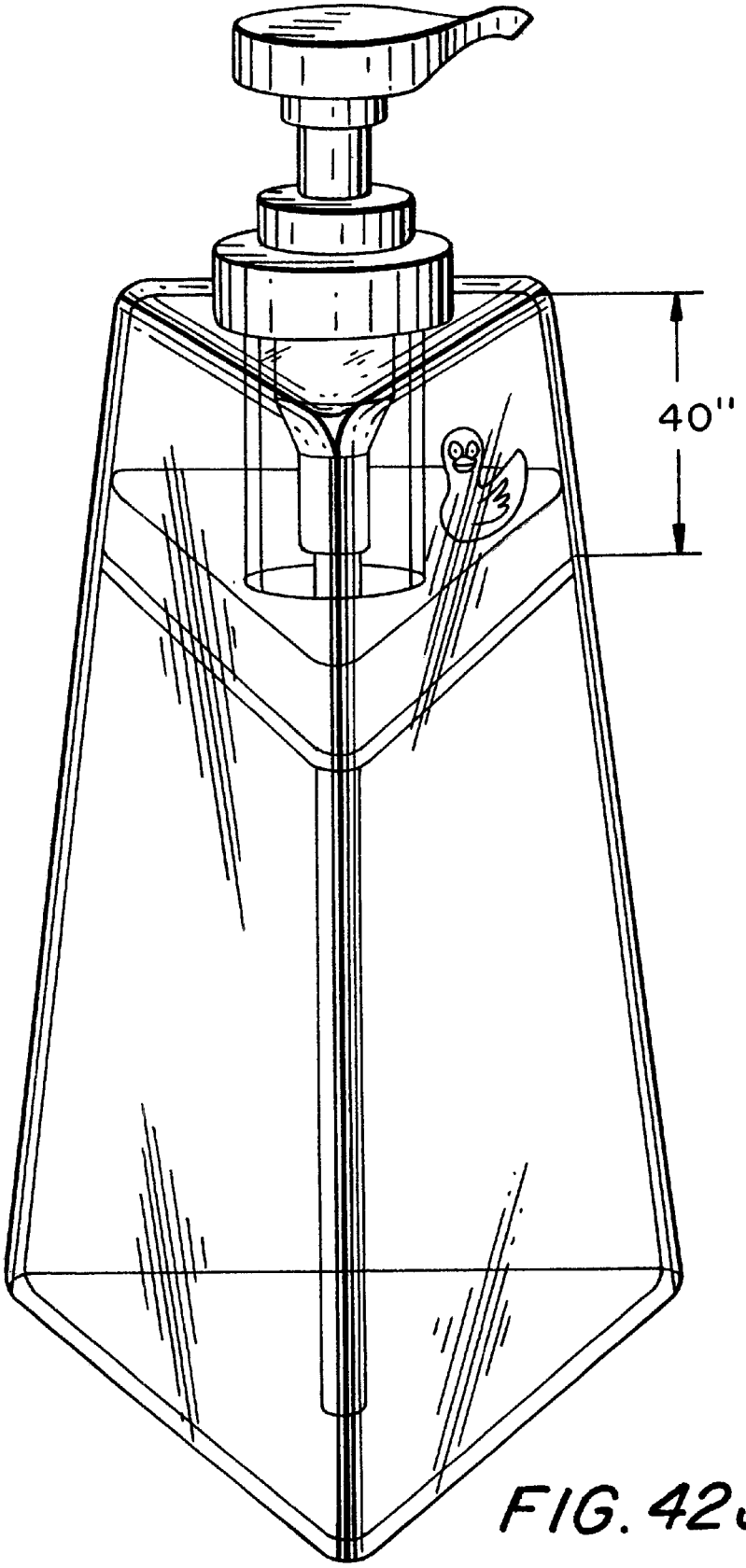
Figure 42K:
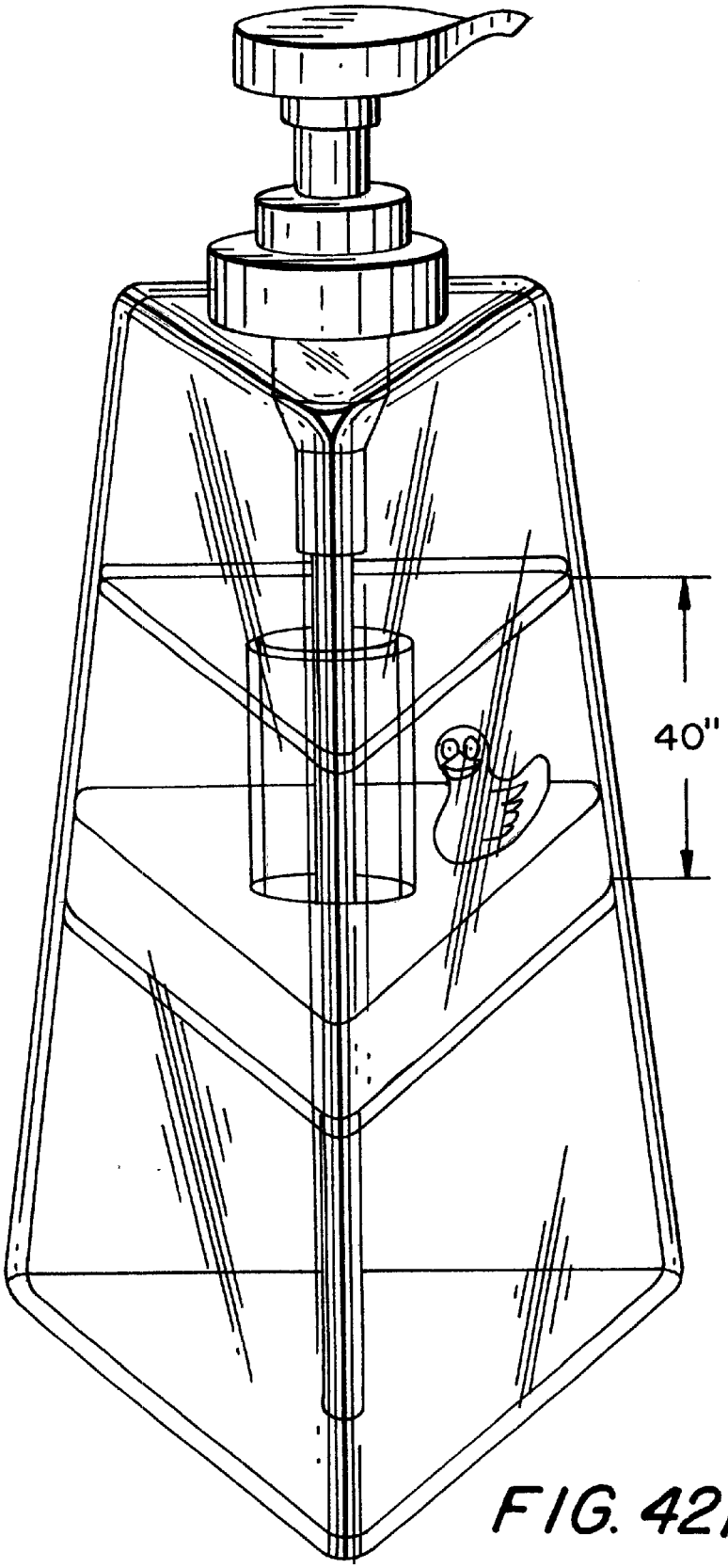
Figure 42L:
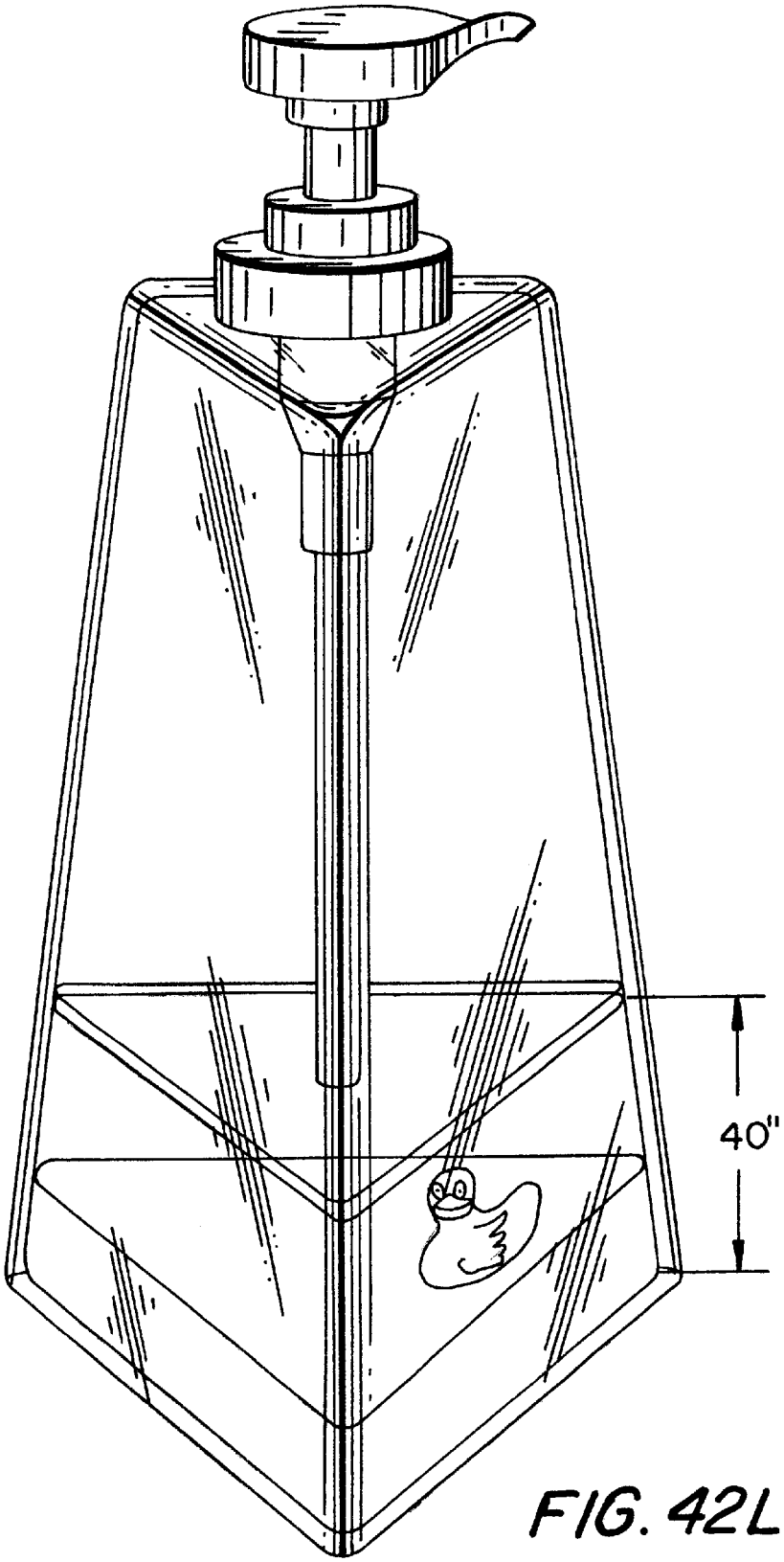
Figure 43:
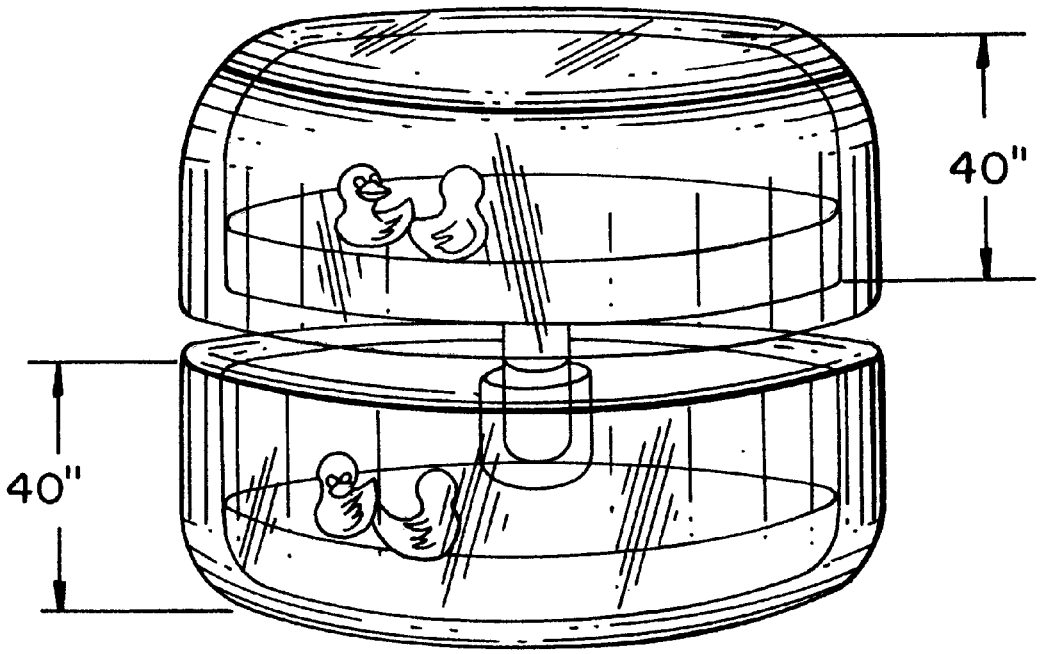
FIG. 43 shows a yo-yo in accordance with the present invention.
Figure 44:
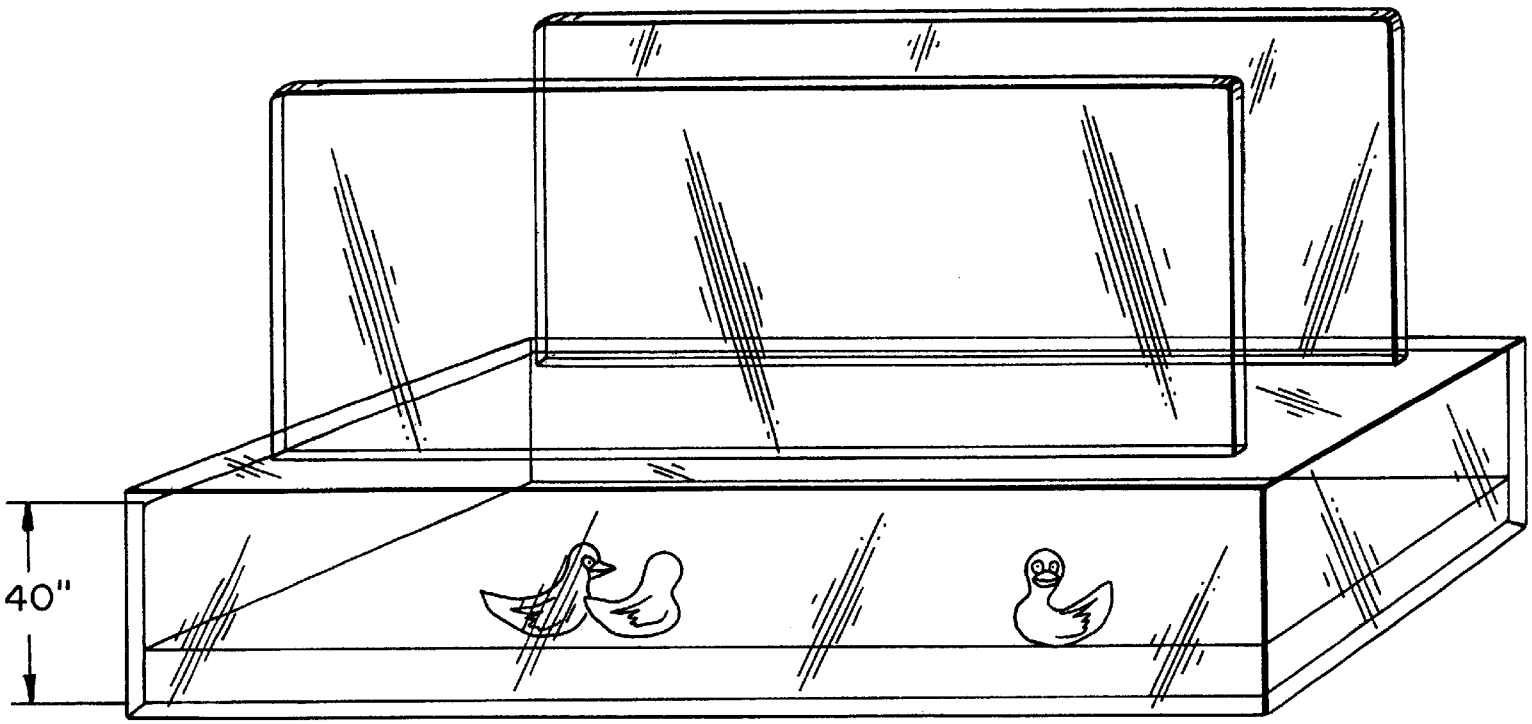
FIG. 44 shows a napkin holder in accordance with the present invention.
Figure 45A:
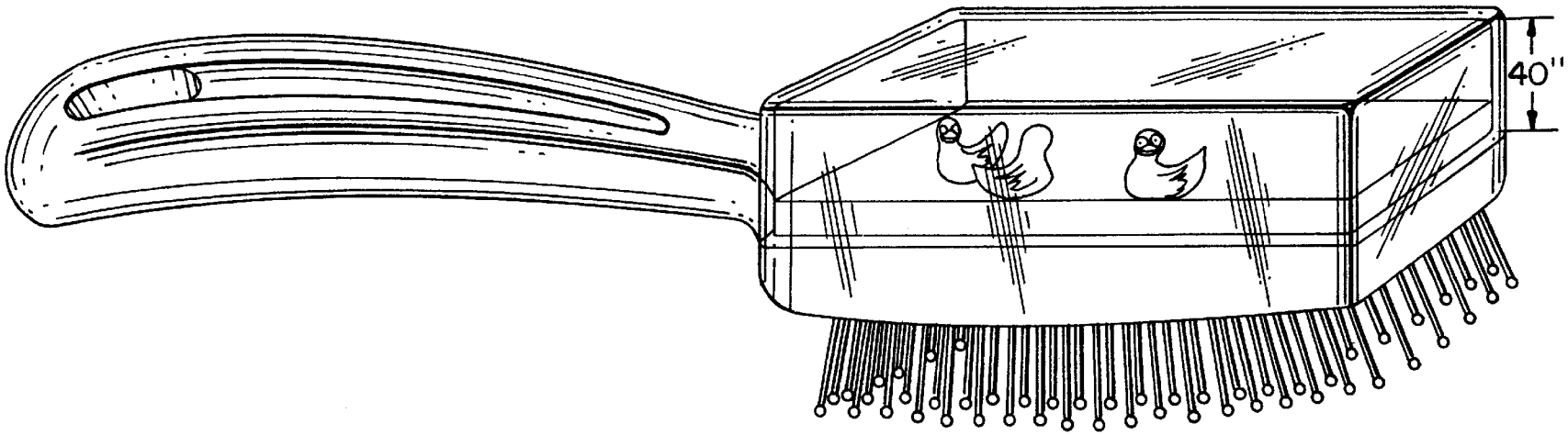
FIGS. 45A and 45B show variations of a hairbrush in accordance with the present invention.
Figure 45B:
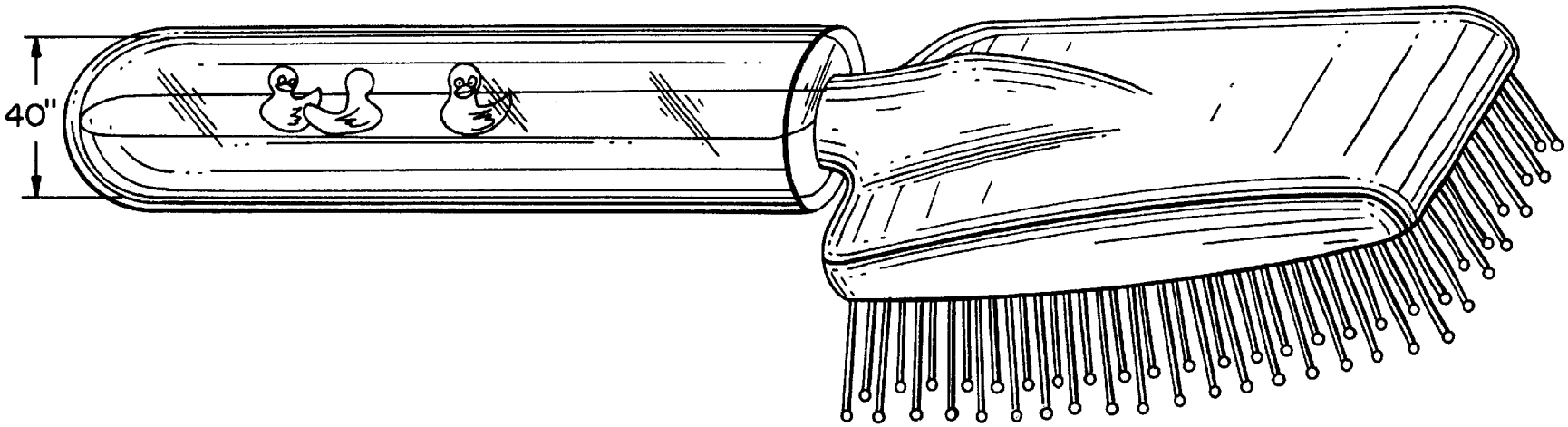
Figure 46:
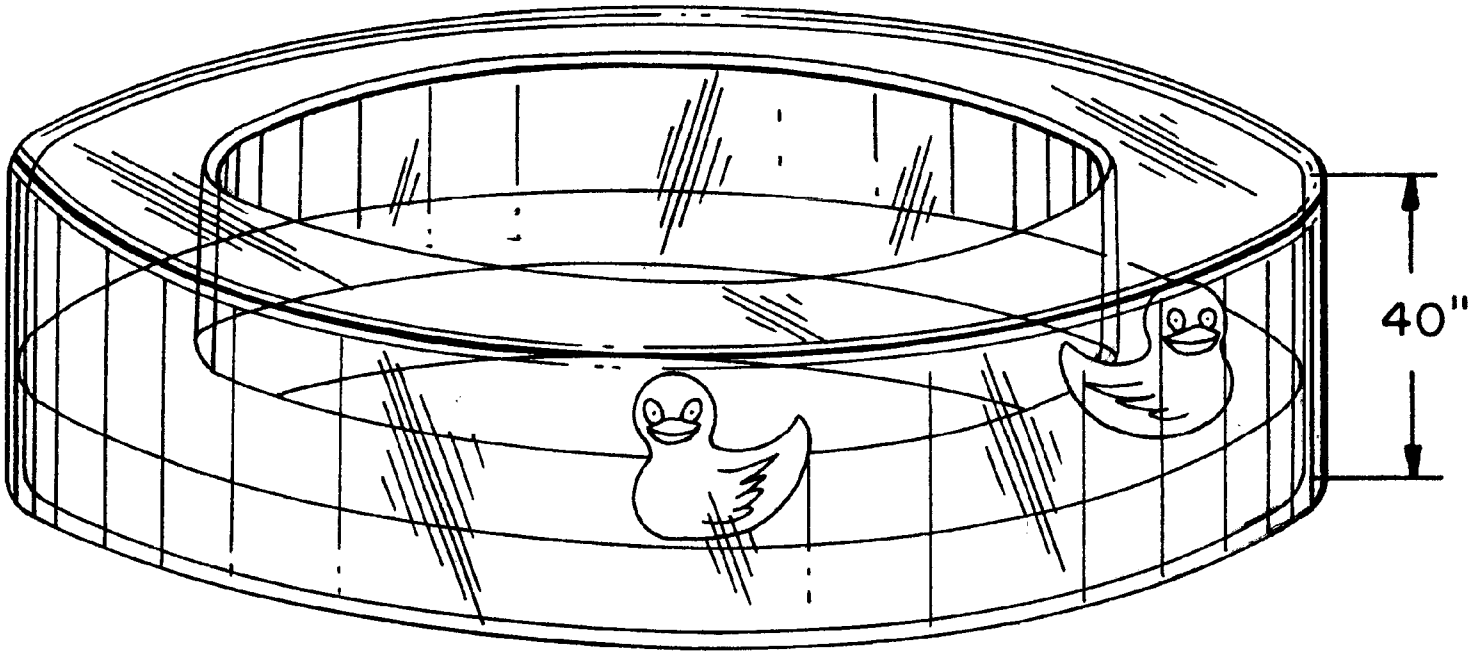
FIG. 46 shows a coaster in accordance with the present invention.
Figure 47A:
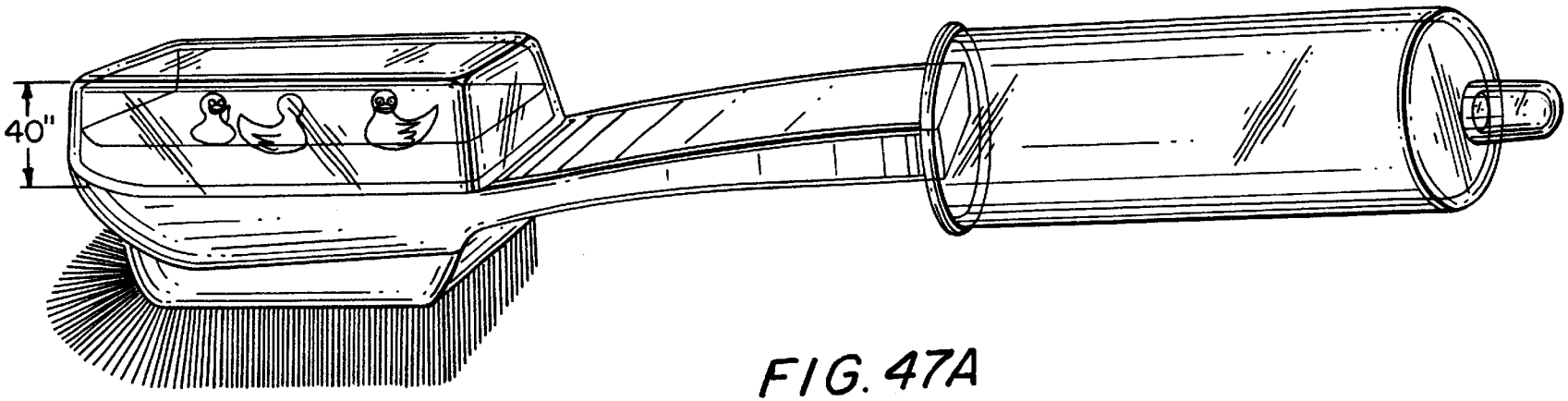
FIGS. 47A to 47C show a series of variations of kitchen brushes in accordance with the present invention.
Figure 47B:
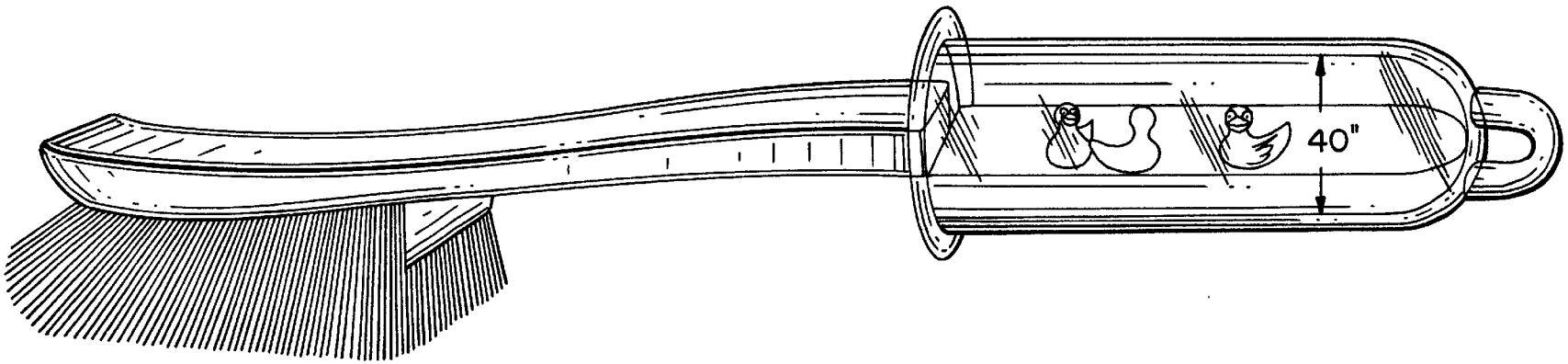
Figure 47C:
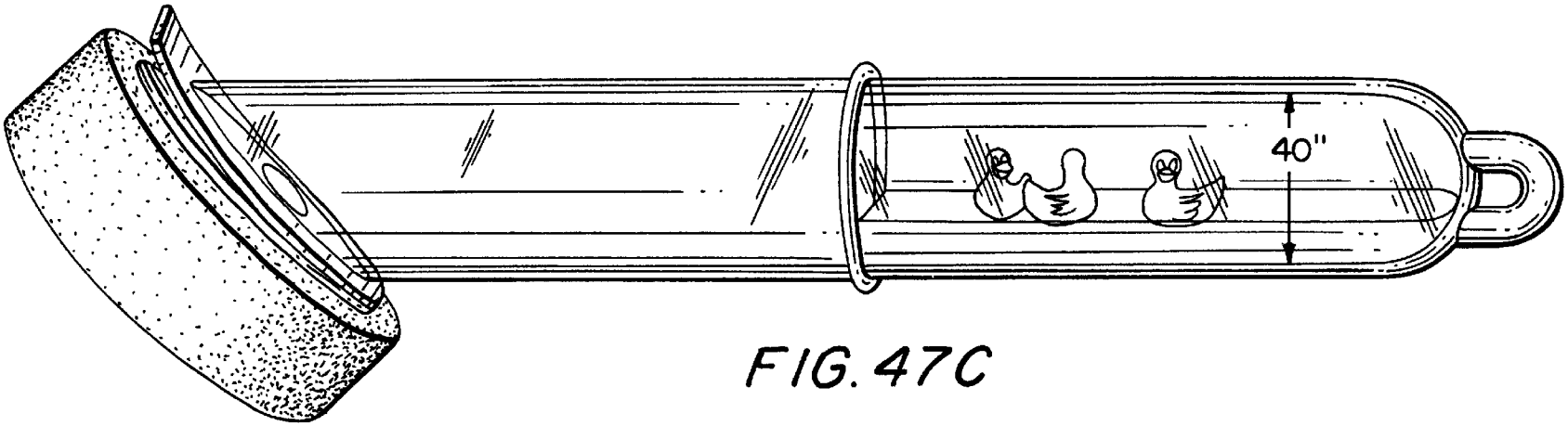
Figure 48:
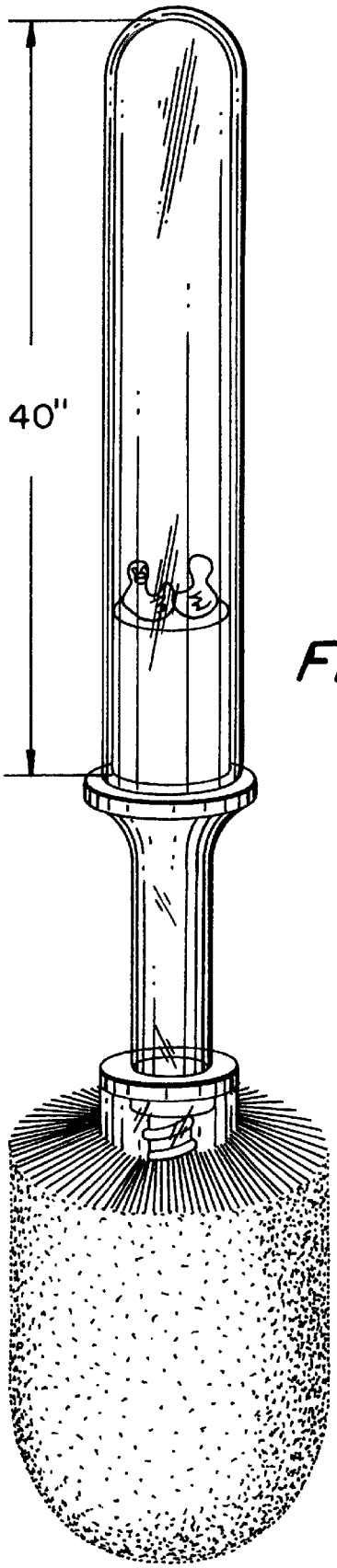
FIG. 48 shows a toilet brush in accordance with the present invention.
Figure 49:
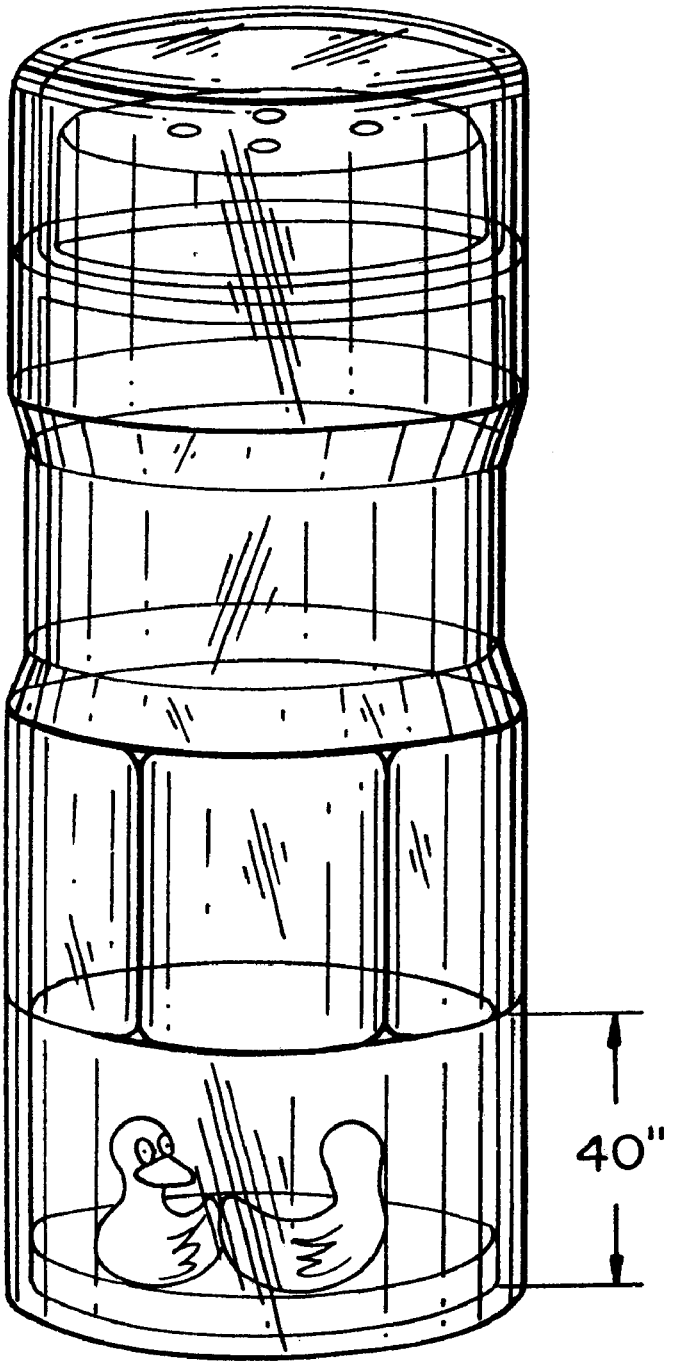
FIG. 49 shows a salt shaker in accordance with the present invention.
Figure 50:
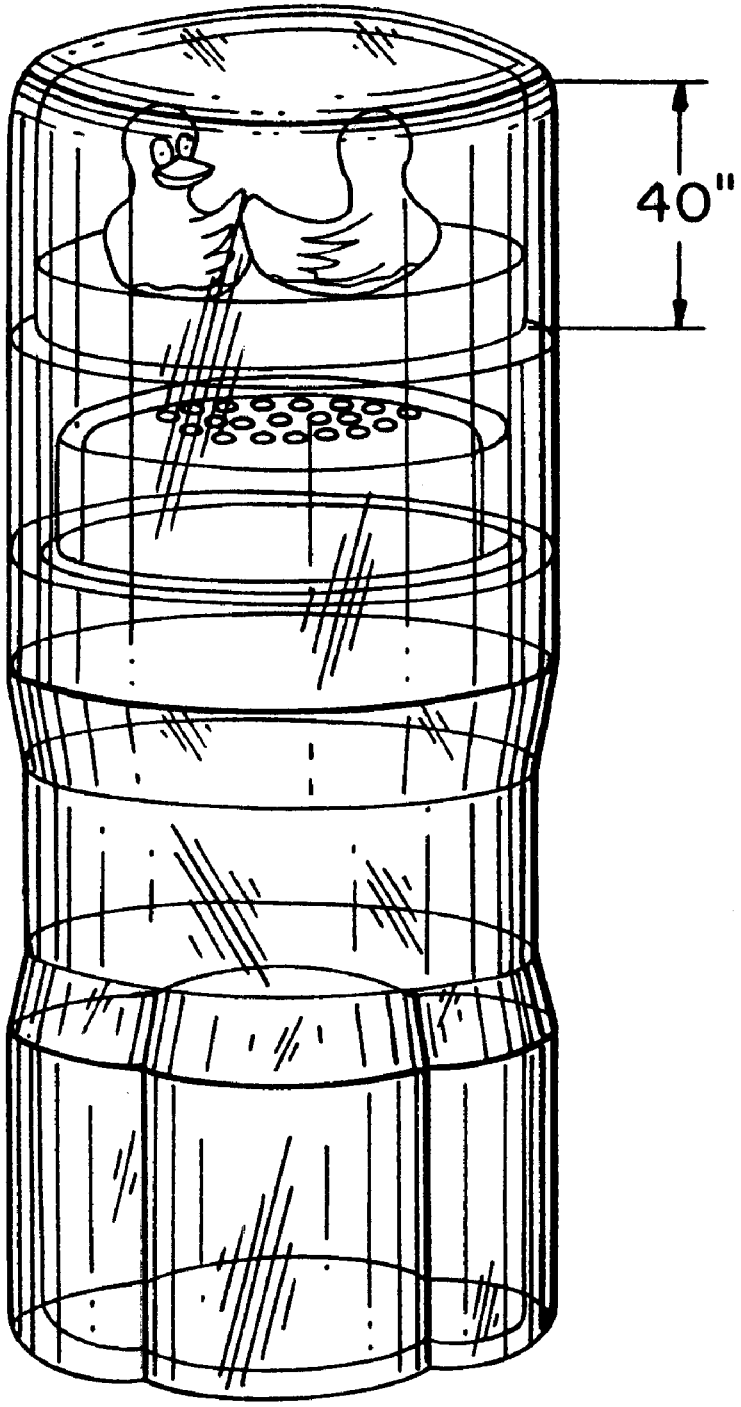
FIG. 50 shows a pepper shaker in accordance with the present invention.
Figure 51:
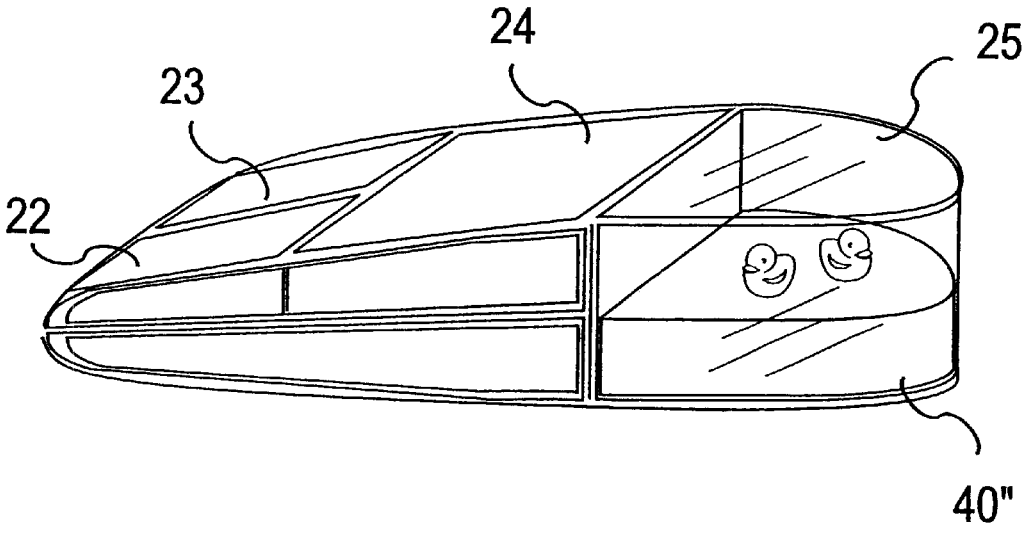
FIG. 51 shows a computer pointer device in accordance with the present invention wherein the decorative sealed vessel is positioned in the housing of the computer mouse.
Figure 52:
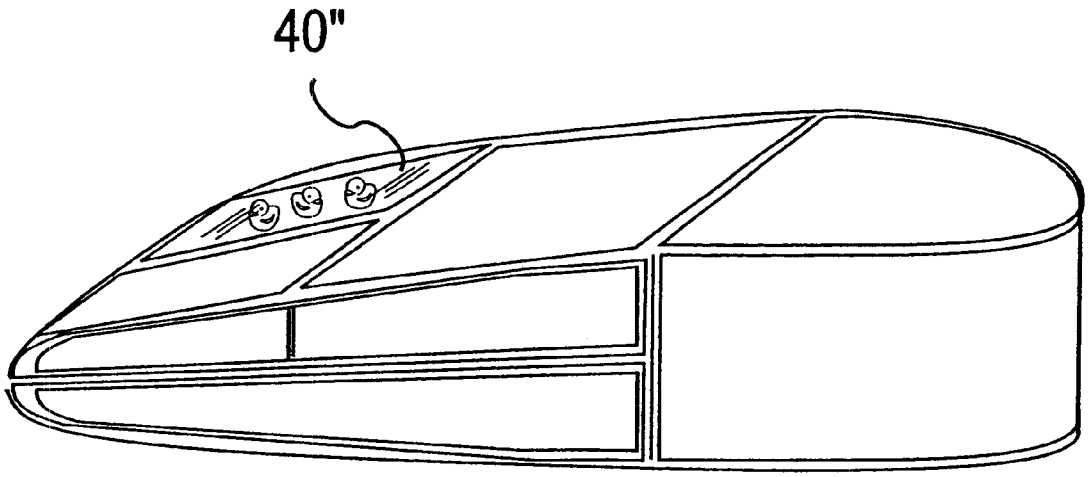
FIG. 52 shows a computer pointer device in accordance with the present invention wherein the decorative sealed vessel is placed in the right button of the mouse.
Figure 53:
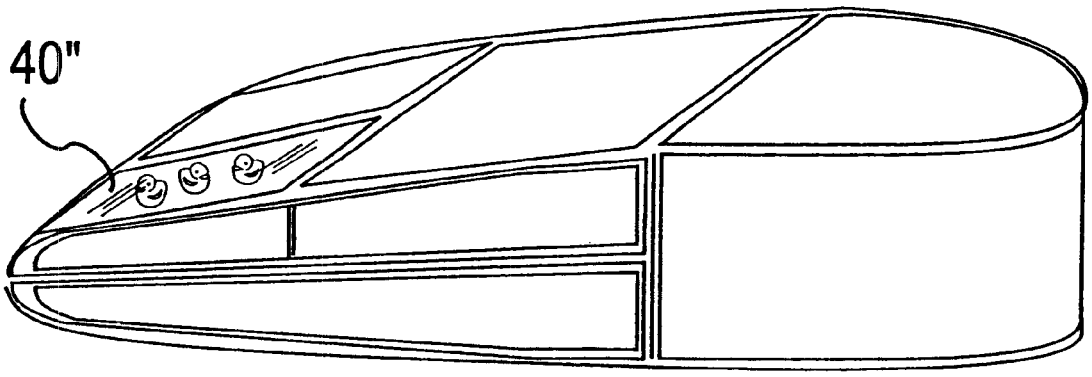
FIG. 53 shows a computer pointer device mouse in accordance with the present invention, wherein the decorative sealed vessel is placed in the left button of the mouse.
Figure 54:
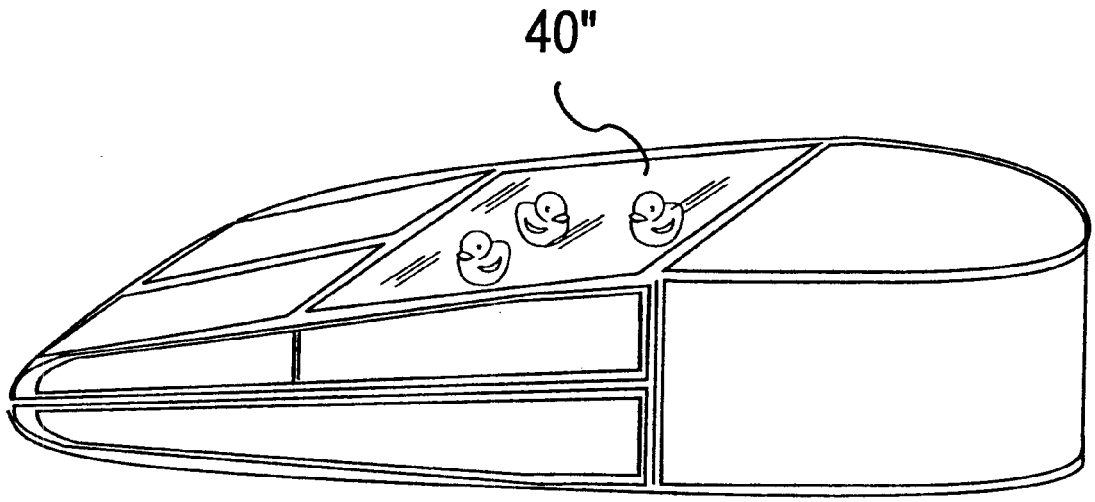
FIG. 54 shows a computer pointer device in accordance with the present invention wherein the decorative vessel is placed in the middle button of the mouse.

Reference is made to all of the Figures, and the computer pointing device, examplarily illustrated in FIGS. 51 to 54.

As will be appreciated from the following, FIGS. 51 to 54 are a computer pointer device comprised of a main housing 25 and a decorative sealed vessel 40" at various locations of the computer pointer device. The main housing can be made from a rigid or soft or flexible material, preferably plastic or polymer, or resin or any suitable material. Referring to FIGS. 51 to 54, the decorative sealed vessel 40" can be positioned at the main housing 25, right button 23, left button 22 or middle button 24 or any other portion of the computer pointer device of choice.

The sealed vessel 5 can contain a first liquid 1, a second liquid 2, and at least one decorative structure 3 suspended and contained within the sealed vessel 5. The first liquid 1, or the second liquid 2, or both the first and the second liquids, are optionally colored. Sealing means 6, between the open vessel 4 and the sealed vessel 5, is such that there is substantially no admixture of the content in the open vessel 4 and the first and the second liquids contained within the sealed vessel 5. The decorative structure 3 is weighted as to maintain and ensure an upright configuration and wherein the decorative structure 3 is insoluble in both the first and the second liquids and floats on the first liquid 1 and is within second liquid 2. The sealed vessel can have discrete portions which prohibit viewing of the contents of the vessel. Thus, the sealed vessel can be selectively clear, transparent, translucent, colored, frosted or any combinations thereof. Further, the walls of the sealed vessel can be made of materials of varying thickness, thereby producing a magnifying effect when the objects within the vessel are viewed. Thus, FIGS. 51 to 54 can be an aesthetically pleasing pointer device. In addition, the computer pointer device can be shaped and sized as a traditional computer mouse or any shape or size of desire or it can be shaped to coordinate with, in contrast to or compliment the decorative structure disposed within the sealed vessel.

The decorative structure can be a sculpture or a three dimensional particle or other aesthetically pleasing device or a three-dimensional drawing; or can be a form of advertisement, such as a trademark or logo (which also can be on the face of the first or second vessels).

It is to be further understood that any utilitarian description herein of any component of the computer mouse of the invention, is not to be construed as a statement that the appearance of any component of the invention is necessarily only functional in nature. Surface ornamentation or configuration of the container or any components thereof is attributable to ornamental considerations.

Having thus described in detail preferred embodiments of the present invention, it is to be understood that the invention defined by the appended claims is not to be limited to particular details set forth in the above description as many apparent variations thereof are possible without departing from the spirit or scope of the invention.

What is claimed is:

1. A computer pointer device comprising a decorative sealed vessel having:

a first liquid, a second liquid, at least one structure, wherein the structure is insoluble in both the first and second liquids, and floats on the first liquid; the first and second liquids are immiscible; the first and second liquids have densities such that the first liquid is beneath the second liquid;

wherein the structure can maintain its upright position and remain in suspension permanently; and wherein the decorative sealed vessel is an integral portion of the computer pointer device.

2. The computer pointer device as claimed in claim 1 wherein the sealed vessel is positioned posterior to a main housing of the control.

3. The computer pointer device as claimed in claim 1, wherein the structure resembles a mouse.

4. The computer pointer device as claimed in claim 1, wherein the decorative sealed vessel replaces a right button of the computer pointer device.

5. The computer pointer device as claimed in claim 1, wherein the decorative sealed vessel replaces a left button of the computer pointer device.

6. The computer pointer device as claimed in claim 1, wherein the decorative sealed vessel replaces a middle button of the computer pointer device.

7. The computer pointer device as claimed in claim 1, wherein the first liquid and the second liquid are both colorless.

8. A computer pointer device comprising a decorative sealed vessel including:

at least one liquid, at least one structure, wherein the structure is insoluble in the liquid and floats on the liquid, and wherein the decorative sealed vessel is an integral portion of the computer pointer device.

9. The computer pointer device as claimed in claim 8 is a computer mouse.

10. The computer pointer device as claimed in claim 1, wherein the first and the second liquid have contrasting or complimenting colors.

* * * * *

UNITED STATES PATENT AND TRADEMARK OFFICE

CERTIFICATE OF CORRECTION

PATENT NO. : 6,380,926 B1
DATED : April 30, 2002
INVENTOR(S) : Stanley Ho

It is certified that error appears in the above-identified patent and that said Letters Patent is hereby corrected as shown below:

Title page,
Item [63], Related U.S. Application Data, after "Dec. 17, 1999," insert -- which is a continuation of application No. 09/289,864, filed on Apr. 12, 1999, --

Column 1,
Line 2, after "This application is a Continuation-in-Part application of U.S. Ser. No. 09/446,447, filed Dec. 17, 1999." insert -- Which is a continuation of U.S. Ser. No. 09/289,864, filed Apr. 12, 1999. --

Signed and Sealed this

Nineteenth Day of November, 2002

*Attest:*

*Attesting Officer*

JAMES E. ROGAN
*Director of the United States Patent and Trademark Office*